US012753694B2

(12) United States Patent
Pell et al.

(10) Patent No.: US 12,753,694 B2
(45) **Date of Patent: *Oct. 6, 2026**

(54) FLUID PROPULSION SYSTEM

(71) Applicant: 3SILK, Inc., Durham, NC (US)

(72) Inventors: Charles Pell, Durham, NC (US); Hugh Crenshaw, Durham, NC (US); Ryan Moody, Durham, NC (US)

(73) Assignee: 3SILK, Inc., Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/981,799

(22) Filed: Dec. 16, 2024

(65) Prior Publication Data

US 2025/0116196 A1 Apr. 10, 2025

Related U.S. Application Data

(63) Continuation of application No. 17/810,892, filed on Jul. 6, 2022, now Pat. No. 12,168,937.

(60) Provisional application No. 63/259,316, filed on Jul. 7, 2021.

(51) Int. Cl.
*F01D 5/02* (2006.01)
*B63H 1/12* (2006.01)

(52) U.S. Cl.
CPC ..... *F01D 5/021* (2013.01); *B63H 1/12* (2013.01); *B63H 2001/122* (2013.01)

(58) Field of Classification Search
CPC ..... F01D 5/021; B63H 2001/122; B63H 1/12
See application file for complete search history.

(56) References Cited

U.S. PATENT DOCUMENTS

| | | | | |
|---|---|---|---|---|
| 747,654 | A | 12/1903 | Shaw | |
| 2002/0185050 | A1 * | 12/2002 | Hilleman | B63H 5/08 114/151 |
| 2017/0259183 | A1 * | 9/2017 | Matloff | B64U 10/13 |
| 2020/0017181 | A1 | 1/2020 | Restea | |

FOREIGN PATENT DOCUMENTS

| | | | | |
|---|---|---|---|---|
| CN | 102159453 | A | 8/2011 | |
| CN | 105939925 | A | 9/2016 | |
| WO | WO-03056139 | A1 * | 7/2003 | B01F 7/00341 |

OTHER PUBLICATIONS

Bang Laboratories, Inc., Material Properties of PolyStyrene and Poly(Methyl methacrylate) (PMMA) Microspheres, Apr. 28, 2015 (Year: 2015).*

International Search Report and Written Opinion corresponding for International Patent Application No. PCT/US2022/073492, mailed Nov. 11, 2022, (15 pages).

Bang Laboratories, Inc., "Material Properties of Polystyrene and Poly(methyl methacrylate) (PMMA) Microspheres", Tech Support Doc 0021—Apr. 28, 2015. Retrieved from: https://www.bangslabs.com/material-properties-polystyrene-and-polymethyl-methacrylate-pmma-microspheres, (2 pages).

* cited by examiner

*Primary Examiner* — Andrew J Marien
(74) *Attorney, Agent, or Firm* — Myers Bigel, P.A.

(57) ABSTRACT

A propulsor is described in which rotation of the frustum of a right circular cylinder generates thrust. Variants of this basic geometrical shape are also described that enable multiple means for propelling fluid past the propulsor.

15 Claims, 47 Drawing Sheets

20
35
25
A
65

20
AFT
70
45
40
50
10
15 (and also 30)
65
A
FORE

AFT
90
60
55
70
15
10
75
50
20
40
17
85
Thrust, 95
FORE
65
A

FORE
AFT
A
65
40
41
42
50
10
45
20
48
47
15 (and also 110)
16
17
100

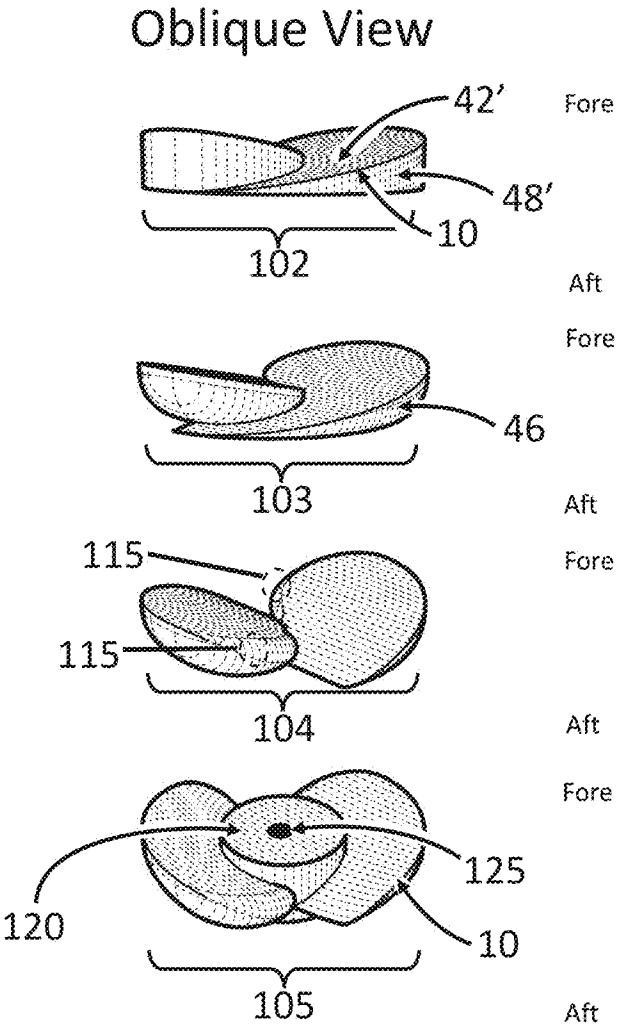
FIG. 4A-1
FIG. 4B-1
FIG. 4C-1
FIG. 4D-1
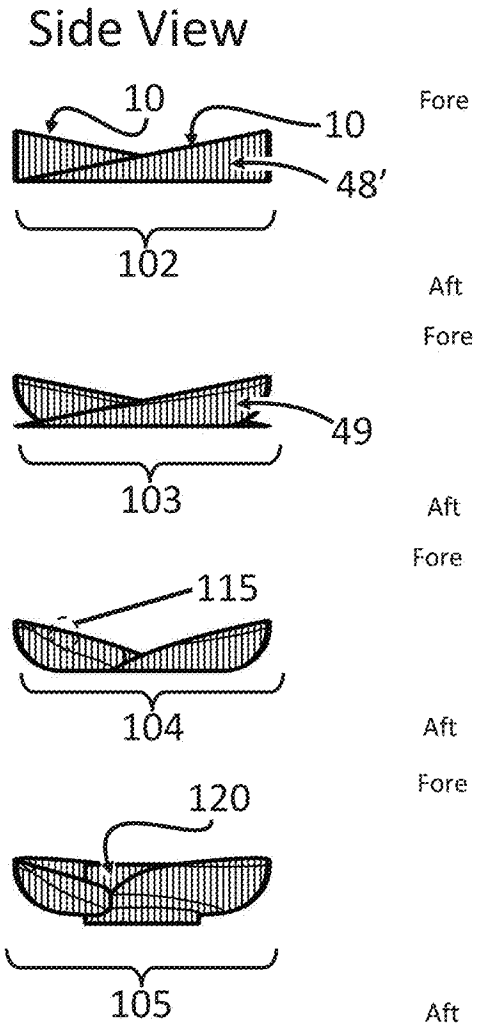
FIG. 4A-2
FIG. 4B-2
FIG. 4C-2
FIG. 4D-2

A "bound edge vortex":
Pressure differential resolved on one surface creates vortex, *exploited* for thrust Thrust, 95
Net Flow
A
65
10
P
T
40
15
45
B
N
K || A
I
J MB plane
A
B
N
T
P
I
J
K ∥ A
1
15
40
45
46
50
65
10
300
305
310
315
320
325
330
335
340
345

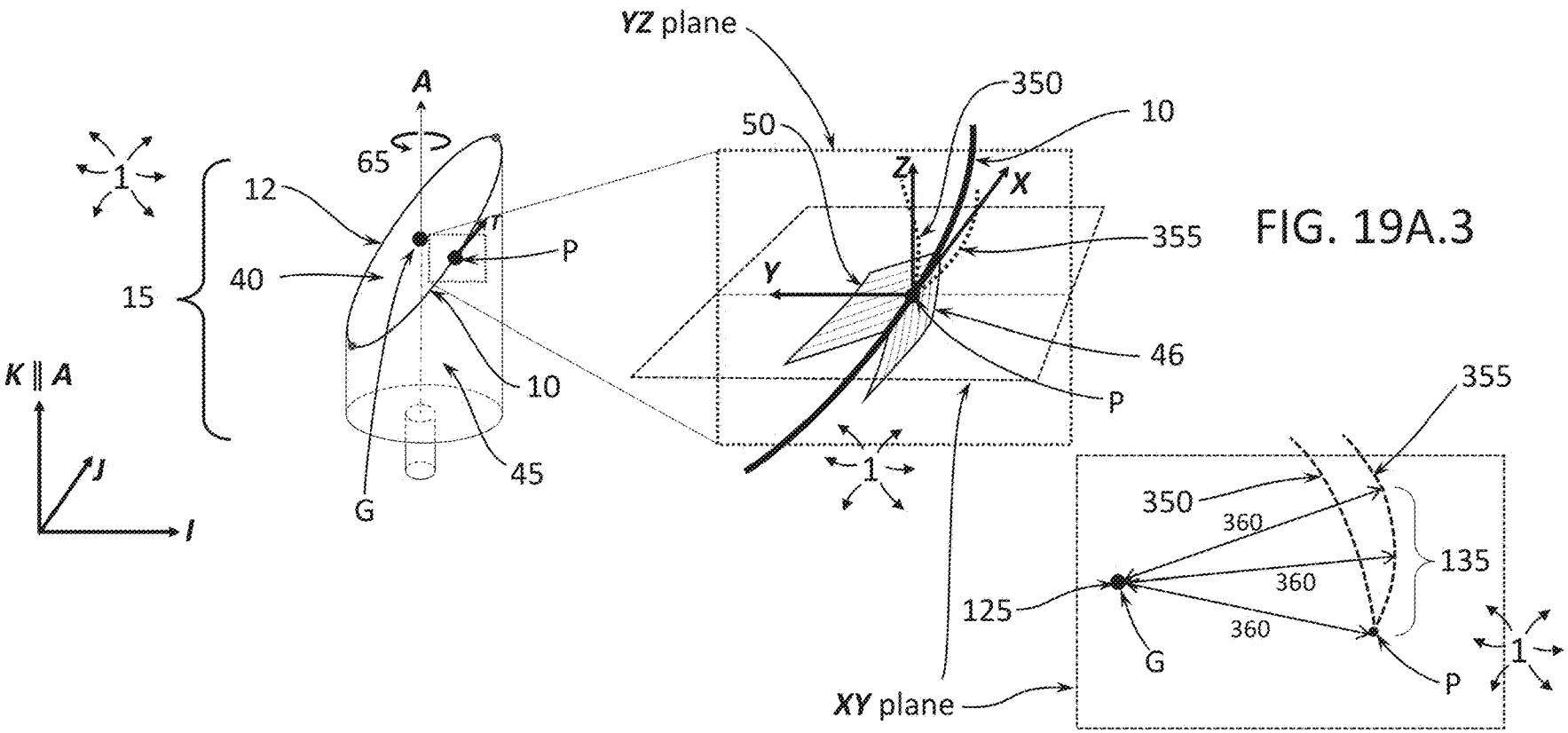
FIG. 19A.1
FIG. 19A.2
FIG. 19A.3
YZ plane
XY plane
K || A
J
I
A
65
12
40
15
10
45
P
G
50
46
355
350
X
Y
Z
135
360
125

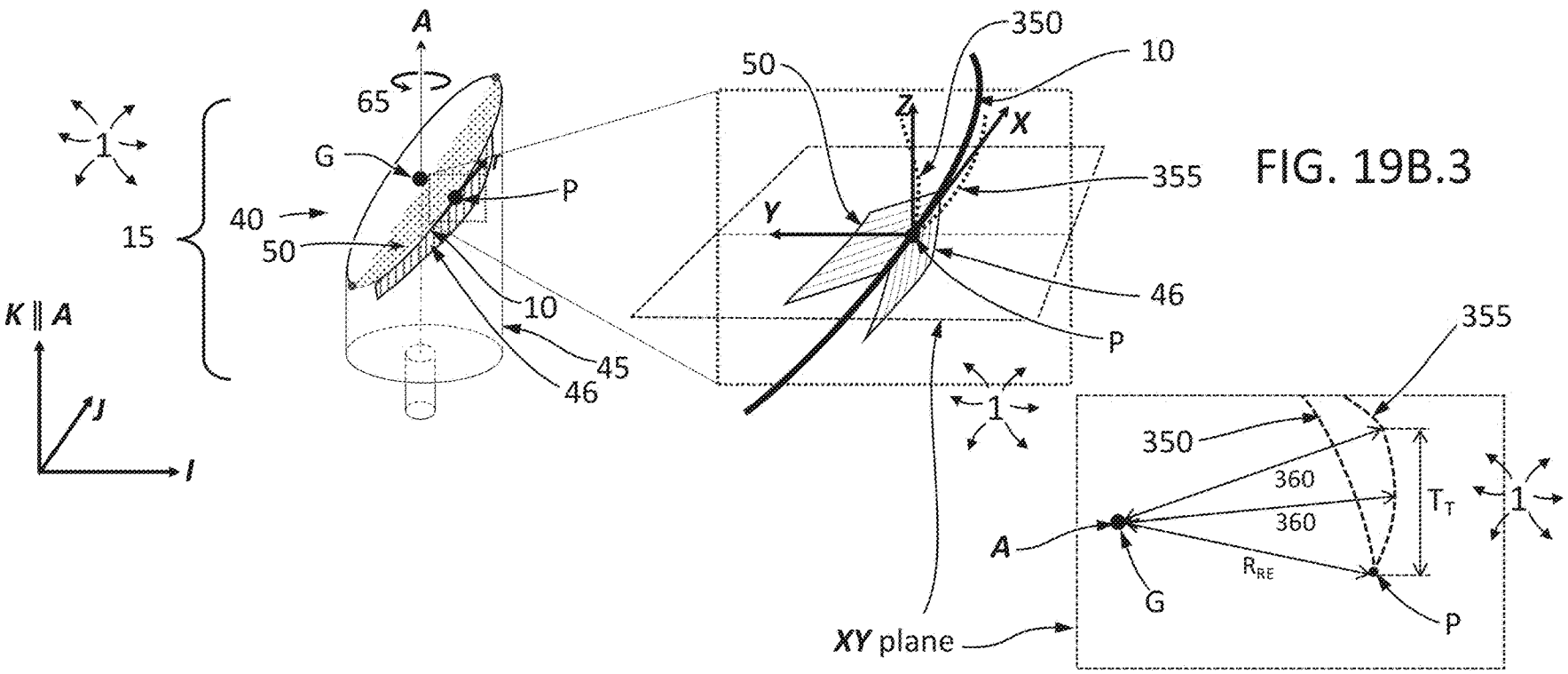
FIG. 19B.1
FIG. 19B.2
FIG. 19B.3
K || A
J
I
15
40
50
G
65
A
P
10
45
46
50
Y
Z
X
350
10
355
46
P
1
XY plane
A
G
350
360
360
$R_{RE}$
$T_T$
P
355
1

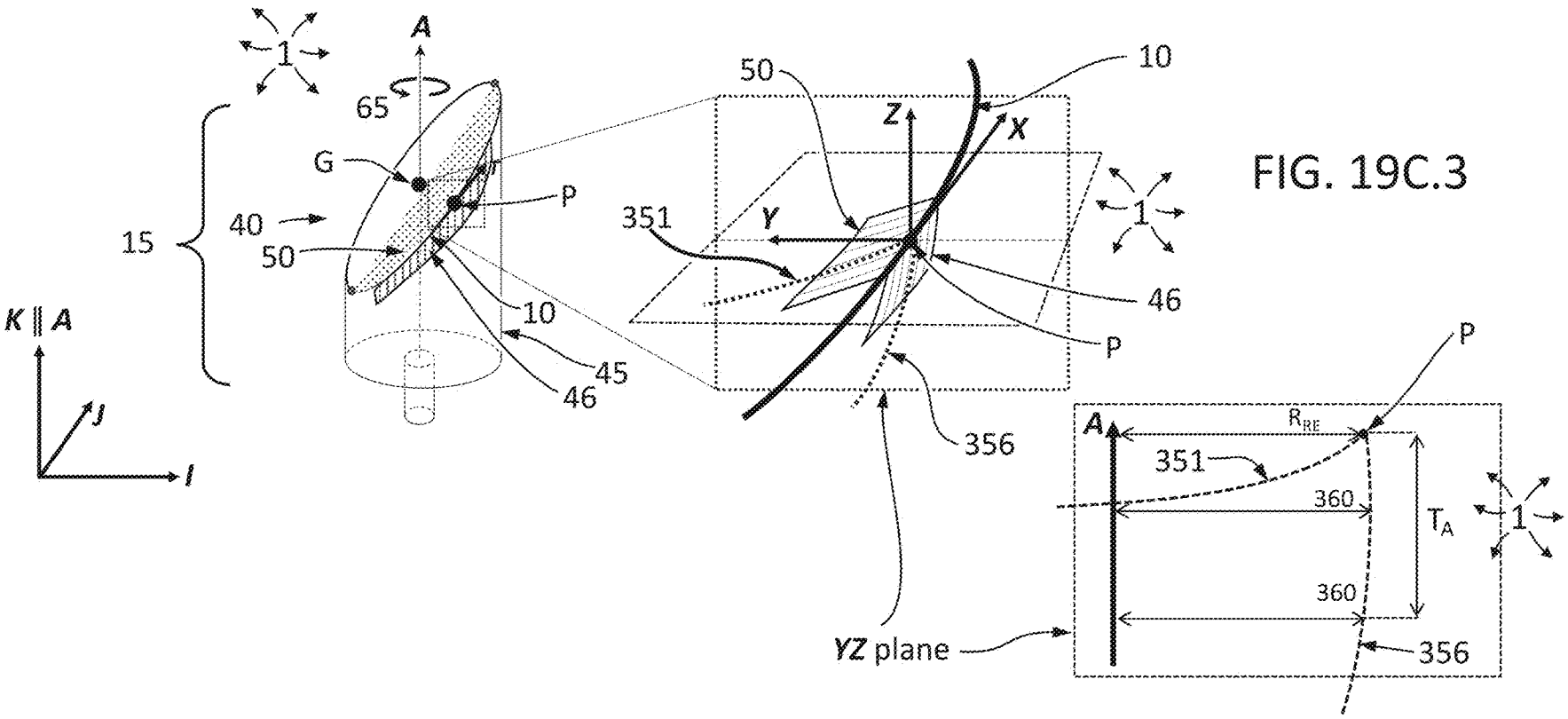
FIG. 19C.1
FIG. 19C.2
FIG. 19C.3
15
40
50
65
G
A
P
10
45
46
351
Y
Z
X
356
YZ plane
$R_{RIE}$
360
$T_A$
K || A
J
I

700

700

700

Static steering with an Eddy

FLUID PROPULSION SYSTEM

PRIORITY CLAIM

The present application is a continuation of and claims priority to U.S. patent application Ser. No. 17/810,892, filed on Jul. 6, 2022, now U.S. Pat. No. 12,168,937, and entitled "Fluid Propulsion System", which claims priority to U.S. Provisional Patent Application Ser. No. 63/259,316, filed on Jul. 7, 2021 and entitled "Methods and Devices for Fluid Propulsion," the contents of which is incorporated herein by reference in its entirety. The present application is also related to U.S. Provisional Patent Application Ser. No. 63/258,111, filed on Apr. 10, 2021 and entitled "Methods and Devices for Fluid Propulsion" the contents of which is incorporated herein by reference in its entirety.

FIELD OF THE INVENTION

The technology of the disclosure relates generally to fluid-flow-inducing turbomachinery that may be used for propulsion through a fluid, such as for a mobile vehicle like a drone that travels through air, or one that travels through water, like a boat or a submarine, or for a sessile device propelling fluid relative to itself, for example a pump or fan.

BACKGROUND OF THE INVENTION

After 200 years, propeller technology has reached a performance plateau, but most everyday propeller output falls far short of that plateau. The greater share of propeller design improvements and performance gains occurred mostly early on, when the design space was relatively less well explored than today. Since then, propeller design appears to have exhausted the available efficiency of lift-based foils (aka, propeller "blades"). By now, progress is increasingly incremental, resulting in ever-smaller performance improvements whilst at the same time those gains are becoming exponentially more expensive to achieve. Worse, although modern propellers can be remarkably efficient (for example, strategic vessels like nuclear submarines enjoy top marks, exceeding 90%, though only when expertly piloted under ideal conditions, while most large commercial vessels make do with 60% or so, and only when cruising at a constant speed), real-world performance for most vessels never sees those numbers, for many reasons. Manufacturing highly refined propellers is expensive, and constant operational vigilance and incessant maintenance is required, or performance decays rapidly. Thus, the lion's share of fielded propellers is subject to multiple propulsive compromises due to cost constraints and manufacturing limitations, for example, to accommodate high-volume injection molding or inexpensive metal casting; add to this burden wildly changing operating conditions, widely varying loads, the often less-than-ideal level of operator training, a huge proportion of time idling, and extreme sensitivity to debris of any kind suspended in the water column. Given these factors, in practice most propellers on the millions of private vessels operate at efficiencies of less than 40% and may chronically run well short of 30%, wasting energy and so needlessly enlarging their carbon footprint.

Further, two centuries of practice has crystallized the form of propellers as thin, cantilevered blades (aka, "foils," derived from the word for thin leaf) that despite being made from aluminum, marine alloy bronze, stainless steel, or the like, are fragile in the face of an endless host of hazards literally impacting props, damaging them via erosion, causing nicks in their sharp edges, bending blades, or outright snapping off one or more blades. Boaters commonly run aground on sand bars, oyster beds, rocks, logs, and boulders, leaving propellers a tangled mess of crumbled metal or fragmented plastic. This can disable a vessel, ruining the day and possibly endangering the life and limb of everyone aboard.

On top of those problems, propellers are widely recognized to be quite dangerous. It is not inaccurate to describe modern propellers as spinning knives: anything alive that comes into contact with a spinning propeller is quickly sliced into ribbons. Each year boat propellers injure or kill well over 100 people in the United States alone. Injuries from propellers are amongst the most gruesome encountered by emergency doctors; amputations (by the propeller, or later by a surgeon) are common, as are fatalities. Mostly the victims are friends and family, struck before anyone could react, as the rapidly spinning propeller's effects are instant. Many of the tragedies occur when the throttle is set to "idle," because propellers often still turn at injurious speed. And, propellers kill millions of marine mammals, turtles, and other wildlife each year. Whaling kills ~1,000 whales each year, but boat strikes kill 20,000 whales per year, with the single biggest cause of death being propeller strikes. Even when just sitting still, propellers are sharp enough to severely lacerate bystanders who bump into the propeller or even just brush against the sharpened blade edges. Indeed, the industry recognizes the danger posed by a static propeller, because rigid safety enclosures for propellers are now commonplace items, even for boats in dry storage.

Given the foregoing substantial problems with propellers, there is a need for an improved turbomachine fluid propulsor. The improved propulsor should offer greater efficiency despite cost constraints and manufacturing limitations. An improved fluid propulsor must deliver greater thrust and speed under real-world operating conditions. The improved fluid propulsor must prove exceptionally robust in the face of the many physical insults encountered in daily use. Ideally, an improved fluid propulsor will be safe both underway and stopped, even to the point of being incapable of slicing people or wildlife. There is also a need for exploiting novel fluid effects enabling thrust exceeding that produced by propeller blades.

SUMMARY OF THE INVENTION

Aspects disclosed in the detailed description include fluid propulsion systems. In an exemplary aspect, a device for inducing fluid flow relative to itself, comprises a body configured to be brought into contact with a fluid, the body possessing a fore end, an aft end, and an axis of rotation about which the body is configured to rotate, and a central hub possessing torque acceptance means configured to accept and convey a torque from a torque generator to the body, and where the torque so conveyed manifests as a rotational velocity of the body of the device about the axis of rotation and driving every point on the surface of body with a rotational motion in a plane perpendicular to the axis of rotation, and at least one monolithic cantilevered lobe extending radially away from the axis of rotation, the lobe possessing one proximal end affixed to the hub, and a distal end, with the lobe further possessing a receding surface substantially inclined with respect to the axis of rotation such that the receding surface recedes away from the fluid as the body rotates, and a rump surface that encloses substantially the rest of the lobe, and where the receding surface and the rump surface intersect, forming there a receding edge, and where the receding edge is bordered by an adjacent rump surface that from every point on the receding edge extends axially aft along the rump surface from the receding edge at least an axial thickness, and from every point on the receding edge extends around the rump surface from the receding edge in the direction of rotational motion at least a transverse thickness, and where, providing a fluid in contact with the body, the rotational velocity of the body about axis of rotation results in a counter-flow over the device, and the adjacent rump surface being so configured such that counter-flow over the adjacent rump surface has substantially no radial component, and has a component in the direction opposite the direction of rotational motion, so that the counter-flow flows past the receding edge at an angle having little or no radial component and with a non-zero component in the direction opposite the rotational motion, and where the receding surface, being pulled away from the fluid by the rotational velocity thus induces a low-pressure region directly over the receding surface such that the low-pressure region travels with the receding surface as the body rotates with respect to the fluid, and where the low-pressure region, being directly adjacent to the counter-flow that is flowing past the receding edge, thus generates a bound edge vortex over a substantial portion of the receding surface, where the bound edge vortex rotates in the opposite direction as the rotational velocity, and where the bound edge vortex further reduces the fluid pressure over the receding surface, and the inclination of the receding surface relative to the axis of rotation causes the vortex to have a substantial aft-directed axial component of fluid flow that generates forward thrust on the body of the device.

BRIEF DESCRIPTION OF THE DRAWINGS

FIGS. 2A through 2D illustrate how a one-lobed Eddy Propulsor can be modified to have 2 lobes.

FIGS. 4A-1 through 4D-2 show sequential modifications to a flattened two-lobed Eddy Propulsor to create an Eddy Propulsor for pushing.

FIGS. 12A and 12B show Eddy Propulsors having convex, flat, and concave faces.

FIGS. 14B through 14C-2 show an Eddy Propulsor with a blunt edge on the side of the face opposite the receding edge.

FIGS. 19A.1 to 19A.3 show the receding circumferential plate of an Eddy Propulsor.

FIGS. 19B.1 to 19B.3 illustrate the transverse thickness $T_T$ of an Eddy Propulsor.

FIGS. 19C.1 to 19C.3 illustrate the transverse thickness $T_T$ of an Eddy Propulsor.

DETAILED DESCRIPTION

Figures 1A, 1B, 1C:
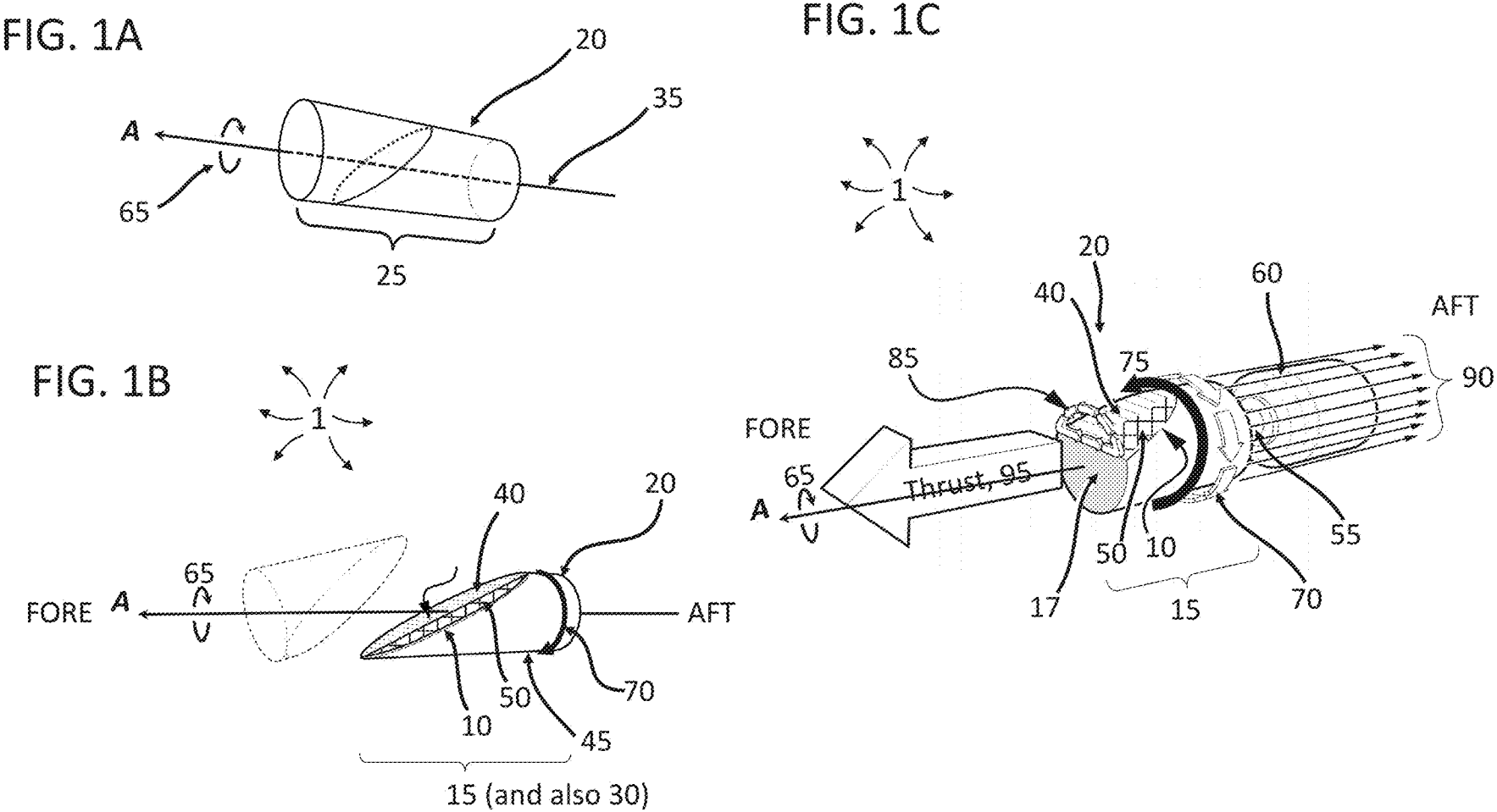
FIGS. 1A through 1C illustrate a first embodiment of the invention, called an Eddy Propulsor, comprising the frustum of a circular cylinder immersed in a fluid and rotated around its central axis to create a bound edge vortex possessing a component of fluid velocity in the aft-direction and generating forward thrust.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the figures. It will be understood that these terms and those discussed above are intended to encompass different orientations of the device in addition to the orientation depicted in the figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

The remainder of this Detailed Description is divided into 4 sections:

- Section 1—An Introduction to Eddy Propulsors
- Section 2—one-lobed and two-lobed Eddy Propulsors Configured as Pulling Propulsors
- Section 3—Eddy Propulsors Configured as Pushing Propulsors
- Section 4—Other Aspects and Applications of Eddy Propulsors

Section 1—An Introduction to Eddy Propulsors

FIGS. 1A and 1B illustrate a first aspect of a novel propulsor that we call an "Eddy Propulsor" 15 (FIG. 1B) that is at least partly immersed in a fluid 1 (FIG. 1B explicitly) and configured for inducing fluid flow relative to itself. The body 20 of the Eddy Propulsor 15 is simply a circular cylinder 25 cut obliquely to create an oblique frustum 30 of a circular cylinder 25 that is then spun around its central axis 35 which is thus the axis of rotation A. Features of propulsor 15 are: a face 40 inclined to the axis of rotation A; a rump surface 45 that encloses the rest of the propulsor 15; a receding surface 50 (shown by the different cross-hatch in FIG. 1B) on one side of the face 40 that "recedes" from the fluid 1 as the propulsor 15 rotates; and a receding edge 10 formed by the intersection of the receding surface 50 and the rump surface 45 and is thus inclined with respect to the axis of rotation A.

As further illustrated in FIG. 1C, the body 20 of Eddy Propulsor 15 possesses a torque transmission means 55 (e.g. a drive shaft) configured to accept and convey a torque from a torque generator 60 (e.g. a motor) to the body 20, and where the torque so conveyed manifests as a rotational velocity 65 (FIGS. 1A and 1B) of the body 20 about the axis of rotation A and driving every point on the surface of body 20 with a rotational motion 70 about the axis of rotation A. The fluid 1 moves as a counter-flow 75 over the rump surface 45 opposite the direction of rotational motion 70 of the body 20. Here, a cross-section 17 is shown of the Eddy Propulsor 15 to better convey the shape of Eddy Propulsor 15 and formation of a bound edge vortex 85. Simultaneously, the receding surface 50 on the face 40 moves away, or recedes from the fluid 1, creating a low-pressure region over the receding surface 50; the counterflow 75 flows over the receding edge 10; and on flowing over the receding edge 10 and encountering the low pressure over the receding surface 50, the counter-flow turns into a bound edge vortex 85.

As the receding surface 50 with the low-pressure region 80 over the receding face 50 and the receding edge 10 move with the body 20 of Eddy Propulsor 15, so does the vortex 85—thus, it's called a bound edge vortex 85. The bound edge vortex 85 further reduces the pressure over the receding surface 50, and the inclination of the receding surface 50 relative to the axis of rotation A causes the bound edge vortex 85 to have a substantial aft-directed axial component 90 of fluid flow that generates forward thrust 95 on the body 20 of the device.

Flow generated by novel Eddy Propulsor 15 is surprisingly brisk resulting in significant thrust as will be disclosed later. The propulsor 15 has been used to drive air, fresh water, and saltwater, and has generated thrust at Reynolds numbers from 10^1 to 10^6, and such tests suggest that the propulsor 15 will propel any fluid.

Interestingly, this aspect of Eddy Propulsor 15 generates equal amounts of thrust when rotated in either sense because either side of the face 40 possesses a receding edge and a receding surface 50, depending on the sense of rotation. This is one demonstration that a receding surface and a receding edge generate flow in Eddy Propulsor 15.

The Eddy Propulsor 15 shown in FIGS. 1A and 1B, may be made from a homogeneous solid, and so is here unbalanced, which can generate significant vibrations, which would be unwelcome in most applications.

Figures 1, 2, 2A, 2B, 2C, 2D:
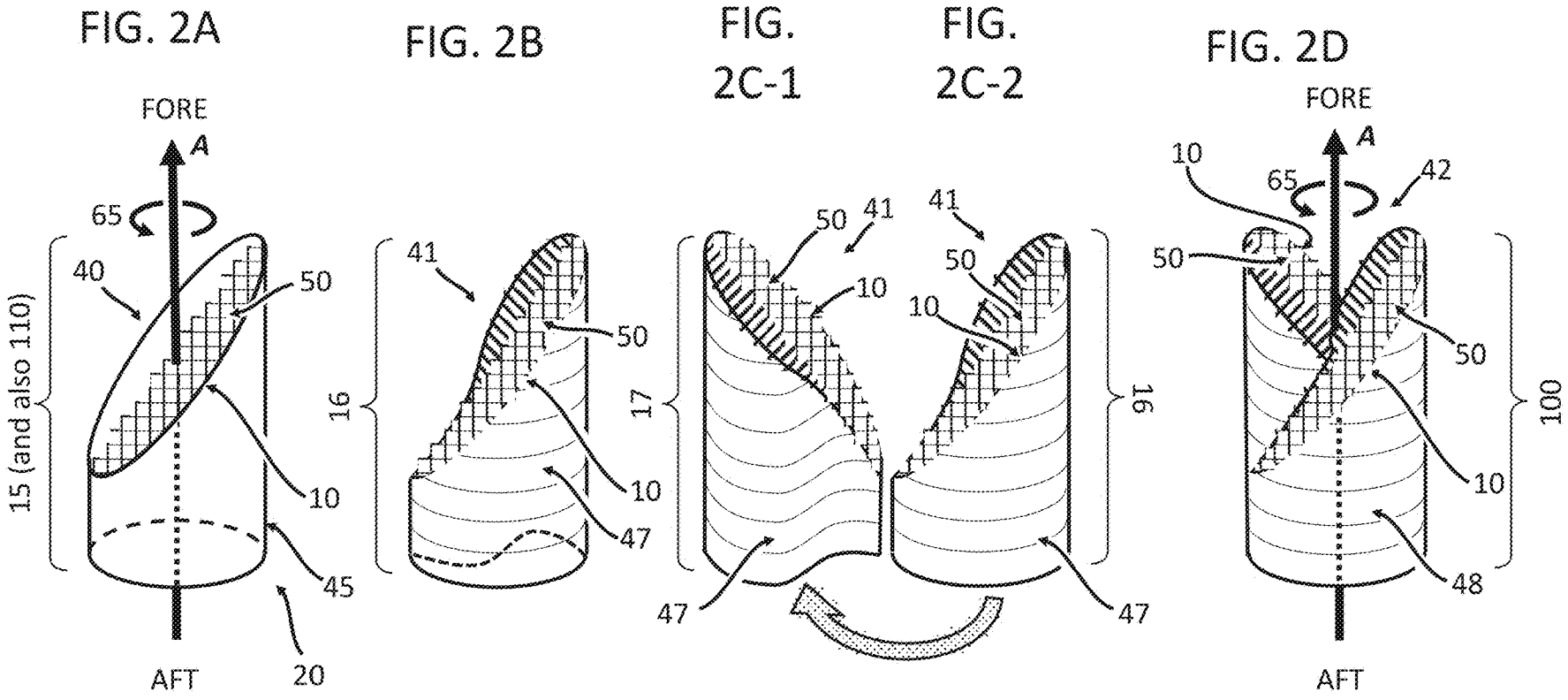

FIGS. 2A to 2D show one way of balancing an Eddy Propulsor 15. FIG. 2A shows an Eddy Propulsor 15 as seen in FIGS. 1A to 1C with a face 40, a receding edge 10, and a receding surface 50. FIG. 2B shows an Eddy Propulsor 16 similar to Eddy Propulsor 15 but in which the body 20 has been modified to remove most of the face 40 that does not comprise the receding surface 50, forming a somewhat teardrop shaped modified face 41 and modified rump surface 47 but retaining the receding edge 10 and the receding surface 50. FIGS. 2C-1 and 2C-2 show the modified Eddy Propulsor 41 being "twinned" and rotated. In FIG. 2D the two modified Eddy Propulsors 41 from FIGS. 2C-1 and 2C-2 are combined into a single modified Eddy Propulsor, a two-lobed Eddy Propulsor 100. This two-lobed Eddy Propulsor 100 has a modified face 42 (being the combination of modified faces 41) with two receding edges 10, two receding faces 50, and a modified rump surface 48. This two-lobed Eddy Propulsor 100 also generates surprisingly large thrust as Eddy Propulsor 100 rotates about its axis of rotation A, but with significantly less vibration owing to Eddy Propulsor 100 now being balanced. Note that two-lobed Eddy Propulsor 100 generates much less thrust when rotated with opposite sense. Similar Eddy Propulsors can be crafted with 3 or more lobes.

These Eddy Propulsors (Eddy Propulsor 15, here forward termed a one-lobed Eddy Propulsor 110) and two-lobed Eddy Propulsors 100 can easily be implemented in "puller" configurations, such as when a motor is mounted aft of the Eddy Propulsor and thrust generated by the Eddy Propulsor pulls the motor forward (as in FIG. 1B). However, these embodiments are not as easily implemented in a "pusher" configuration with the motor forward of the Eddy Propulsor, such as is found in almost all configurations of propellers on boats. Note that both "puller" and "pusher" configurations develop thrust in the same axial direction with respect to the receding face; the distinction is largely whether a driveshaft is affixed from the forward or aft direction.

Figures 3A, 3B, 3C:
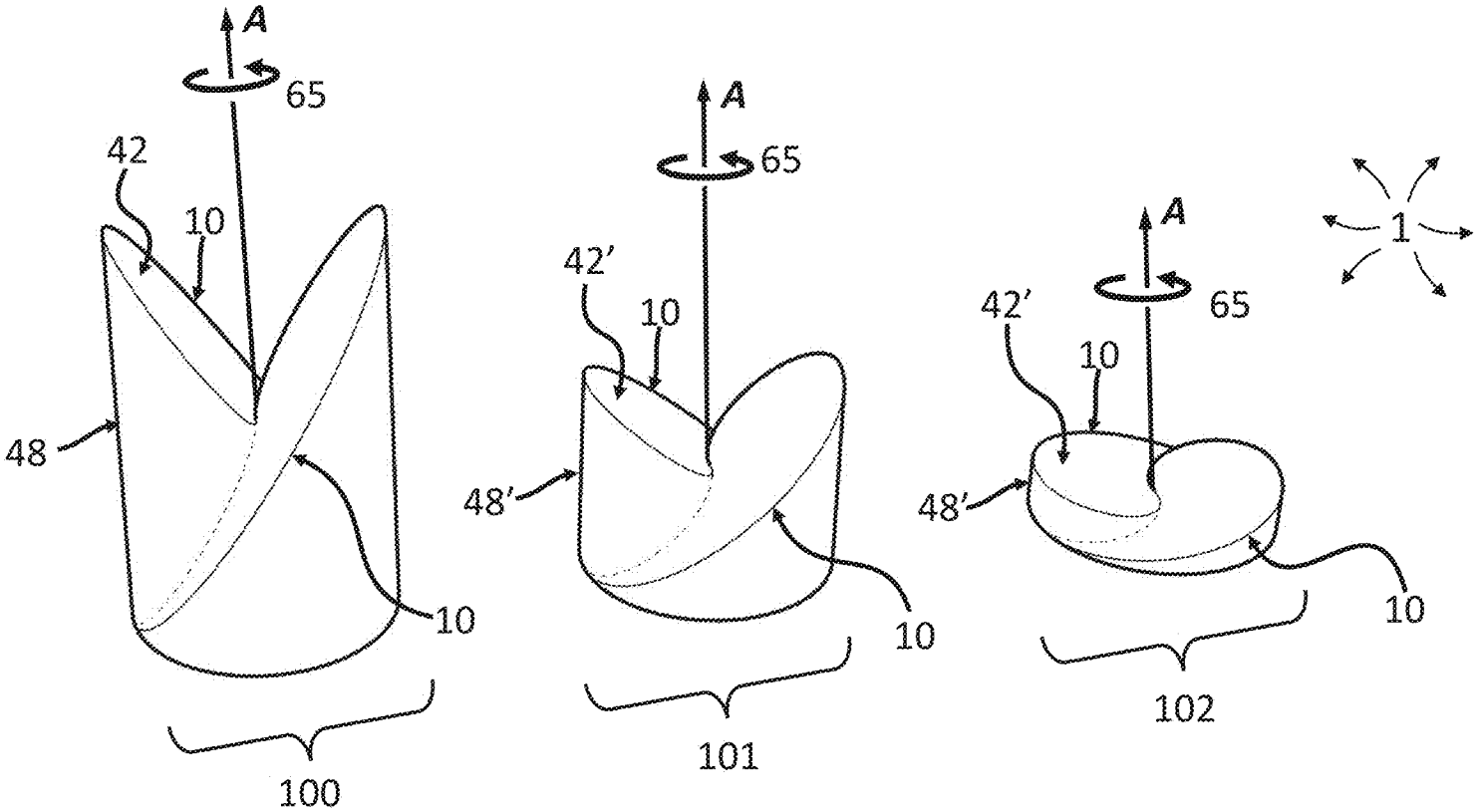
FIGS. 3A through 3C demonstrate "flattening" of an Eddy Propulsor along its axis of rotation.

A notable feature of one-lobed 110 and two-lobed Eddy Propulsors 100 is that the combination of receding edge 10 and receding surface 50 creates a bound edge vortex 85 over the face 40 (or equivalently over face 41), and this configuration may be adapted to be more amenable to direct replacement of propellers on existing, unmodified boats. FIGS. 3A to 3C show the first step in this approach. FIG. 3A shows a two-lobed Eddy Propulsor 100 with modified face 42. FIGS. 3B and 3C show an axially compressed two-lobed Eddy Propulsor 101 along its axis of rotation A, ending with a greatly flattened two-lobed Eddy Propulsor 102 with flattened face 42' and flattened rump surface 48'.

The flattened two-lobed Eddy Propulsor 102 may be further modified to create a pusher Eddy Propulsor as shown in FIGS. 4A-1 through 4D-2 which show oblique and side views of successively modified Eddy Propulsors, concluding with a pusher Eddy Propulsor in FIGS. 4D-1 and 4D-2. FIGS. 4A-1 and 4A-2 show the flattened Eddy Propulsor 102 from FIG. 3C having a flattened modified face 42', a modified rump surface 48', and two receding edges 10. FIGS. 4B-1 and 4B-2 show a rounded rump surface 49 in pusher Eddy Propulsor 103. FIGS. 4C-1 and 4C-2 show a further modified pusher Eddy Propulsor 104 in which the edges 115 are rounded opposite the receding edge 10 on each lobe. FIGS. 4D-1 and 4D-2 show a final version of a pusher Eddy Propulsor 105 in which a hub 120 possessing a bore 125 for accepting a drive shaft has been added. In all cases, the receding edges 10 continue to function normally.

Figure 5:
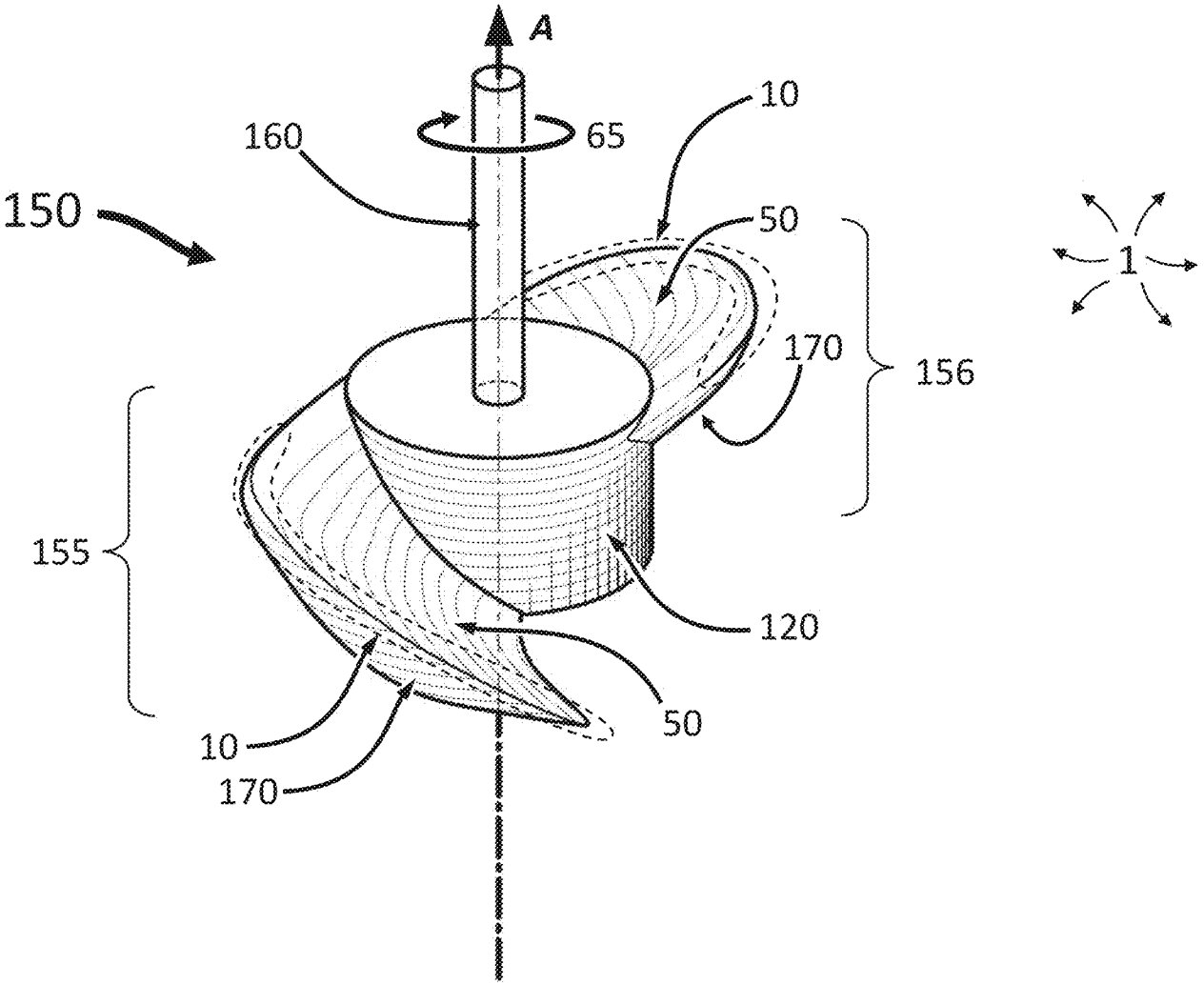
FIG. 5 provides an example of an Eddy Propulsor for pushing.

FIG. 5 shows a similar, further evolution of an Eddy Propulsor at least partially immersed in the fluid 1. This is a two-lobed Eddy Propulsor 150 having a first lobe 155 and a second lobe 156 attached to a hub 120 to which is affixed a drive shaft 160 turning the Eddy Propulsor 150 on axis of rotation A with rotational velocity 65. Each lobe has a receding surface 50, a receding edge 10, and a rump surface 170.

Eddy Propulsors similar to Eddy Propulsor 150 have been tested as drop-in replacements for boat propellers, and these Eddy Propulsors have proven superior to boat propellers in many characteristics, as will be discussed in detail later.

Figure 6A:
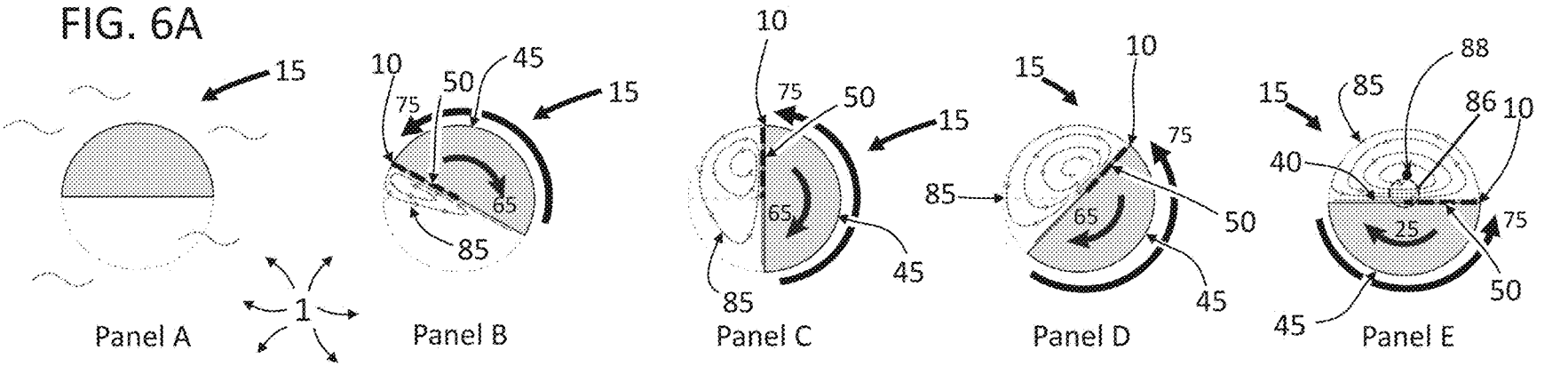
FIG. 6A Panel A through 6B Panel E show how a bound edge vortex forms on the face of an Eddy Propulsor.

Section 2—One-Lobed and Two-Lobed Eddy Propulsors Configured as Pulling Propulsors FIG. 6A presents cross-sections of Eddy Propulsor 15 immersed in a fluid 1 and configured in a pulling configuration, as discussed earlier and rotating with rotational velocity 65. In Panel A, Eddy Propulsor 15 is stationary. In Panel B, Eddy Propulsor 15 begins to rotate with rotational velocity 65 and the bound edge vortex 85 starts to form as the counter-flow 75 moves over the rump surface 45 and past the receding edge 10. In Panels C-D the bound edge vortex 85 continues to develop, and in Panel E the bound edge vortex 85 is fully developed. While evident in the earlier panels, the flow due to the bound edge vortex 85 and adjacent to the face 40 has a vortex core 88 at a distance from the face 40 and a prominent portion 86 flowing across the face toward the receding edge 10.

Figure 6B:
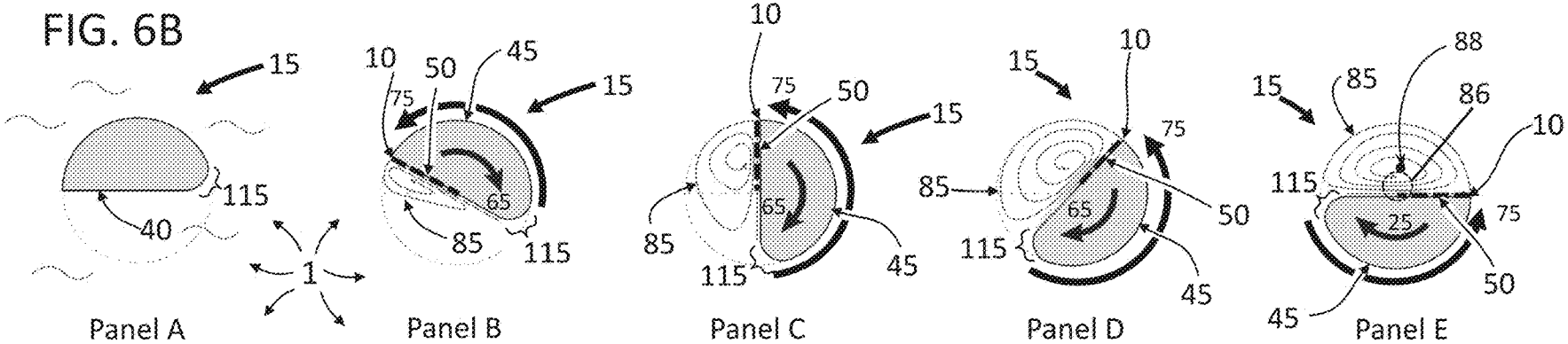

FIG. 6B shows a similar set of panels for an Eddy Propulsor 15 having a blunt forward edge 115 opposite the receding edge 10. This effectively increases the proportion of the face 40 formed by the receding face 50.

Referring back to FIG. 1C, the torque-generating device 60 may be an electric motor mounted coaxially with the axis of rotation A of Eddy Propulsor 15, and connected to the Eddy Propulsor 10, for example by mounting the Eddy Propulsor 10 coaxially directly onto a drive shaft as the torque acceptance means 55. Alternatively, the torque-generating device 60 may be any of a number of commonly used sources of torque generation, for example combustion engines, pneumatic motors, hydraulic motors, elastic strain energy motors, or torque supplied via flowing fluids (wind, air). The torque-generating device 60 may be located non-coaxially with respect to the axis of rotation of an Eddy Propulsor, and transmit the desired torque through familiar torque-transmitting means such as right-angle gears, helical gears, a toothed belt, a chain, or similar mechanical means of transferring the torque from the torque-generating device to the Eddy Propulsor. The torque-generating device may also be located remotely, some distance from Eddy Propulsor, with the torque being supplied to the Eddy Propulsor via appropriate torque-transmitting means such as one or more flexible torque cables, articulated drive shafts, hydraulic means, or other means of remotely conveying torque to drive rotation of the Eddy Propulsor about the axis of rotation. In yet another embodiment, the body of an Eddy Propulsor may itself comprise all or a portion of the torque-generating device, where the desired torque is generated by or within the Eddy Propulsor, for example via the body being a hollow shell forming the external rotor of an electric motor around a stator located substantially internally within the volume of the Eddy Propulsor, an arrangement that might be used for example on an underwater vehicle, or, by the body of the Eddy Propulsor forming an internal rotor inside a stator that is located substantially outside the Eddy Propulsor, and so surrounding the Eddy Propulsor, as might be used inside a pipe as a pump, as discussed later, where the wall of the pipe may contain the stator. Still another arrangement is where the body of the Eddy Propulsor is configured to convert an impinging fluid flow into a useful torque to cause the Eddy Propulsor to rotate about the axis of rotation, whether first for reorienting the Eddy Propulsor, or second, for driving the Eddy Propulsor's rotation about the axis of rotation to generate thrust, or third, for driving the rotation of an Eddy Propulsor adapted with one or more of the aforementioned rotor, stator, magnets, or similar electrical components, and as disclosed above capable of transducing electric power input into rotation of the Eddy Propulsor as an electric motor, but here also capable of transducing the rotation of the Eddy Propulsor into electric power output, as in an electric generator.

It is important to recognize that thrust generated by an Eddy Propulsor arises from the aftward component of velocity in the bound edge vortex. This is most unlike the thrust generated by a conventional propeller, and an Eddy Propulsor differs from a propeller in many important and beneficial ways.

Figure 7:
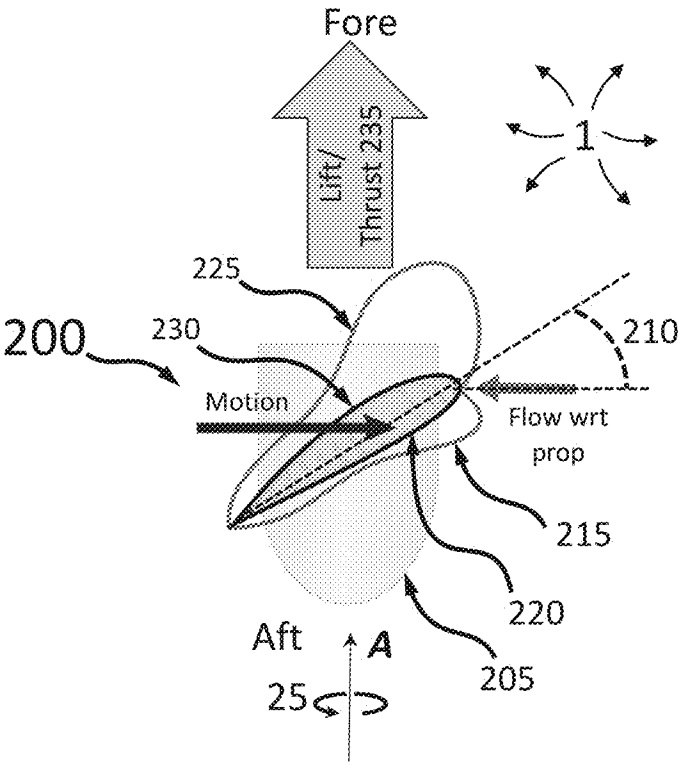
FIG. 7 (Prior art)
FIG. 7 (Prior art) is used to explain how the thrust generated by the bound edge vortex of an Eddy Propulsor is fundamentally different from lift, or thrust, generated by a conventional wing.
Figure 8A:
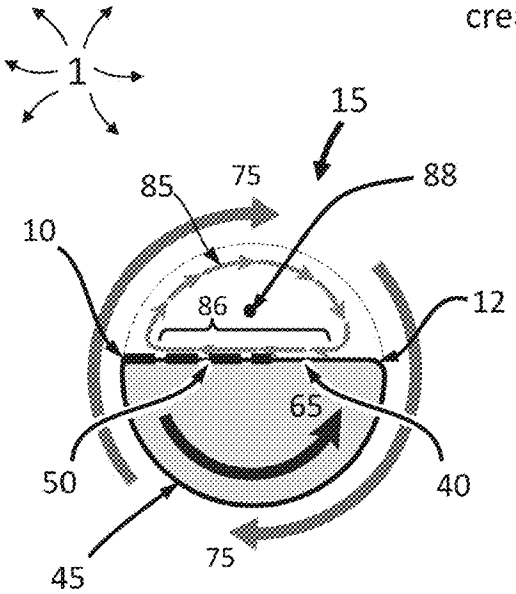
FIGS. 8A through 8C further explain how rotation of an Eddy Propulsor generates a bound edge vortex that generates a net aftward flow and a forward thrust.
Figure 8B:
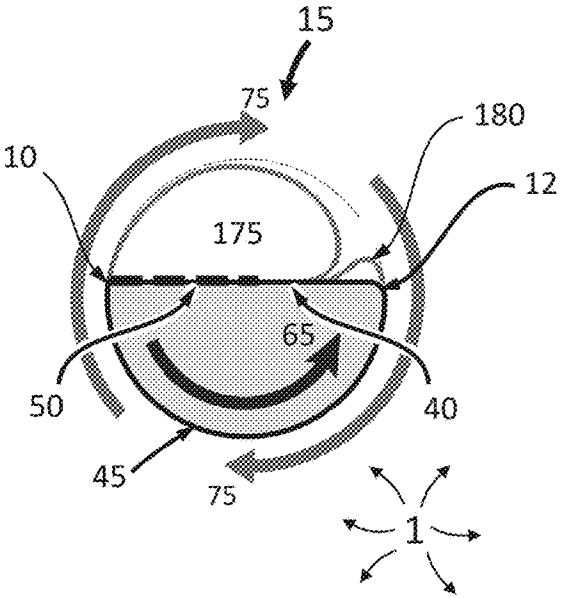
Figure 8C:
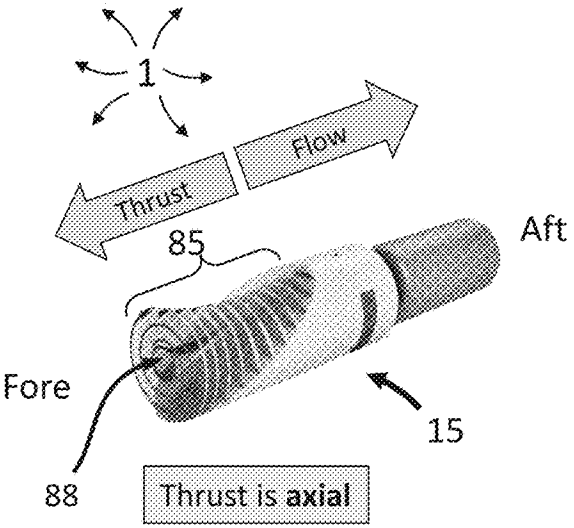

Consider FIG. 7 in comparison to FIGS. 8A to 8C which demonstrate how the blade of a propeller (FIG. 7) generates thrust by a different phenomenon than an Eddy Propulsor (FIGS. 8A-8C).

In FIG. 7, the blade of a propeller 200 or a wing immersed in a fluid 1 generates thrust via lift as discussed in all introductory physics courses. Here, a blade 200 projects outward from a hub 205 that rotates along axis of rotation A with rotational velocity 65. Blade 200 moves at an angle 210 through the fluid 1 (the "angle of attack") creating net circulation on the blade (not shown) which creates a region of increased pressure 215 along the blade's 200 aft side 220 and a region of low pressure 225 on the blade's 200 fore side 230. This pressure differential generates thrust 235 (frequently called "lift") on the blade 200, but at the inevitable cost of creating a distal vortex that hinders the purpose.

Because of this problem, the field teaches directly away from practicing aspects of the present disclosure. Specifically, the distal vortex associated with a traditional lifting or thrusting foil (such as a wing or a propeller blade) is anathema to practitioners because that distal vortex negatively impacts performance. It greatly increases induced drag and so reduces the effective angle of attack of that foil, which reduces lift (i.e., thrust), which then requires increasing the angle of attack to compensate, which increases the drag even further. Failing to eliminate or minimize a vortex anywhere near a wing or propeller blade cuts the lift (i.e., thrust) by a third or more, a profoundly powerful incentive to go to great lengths to avoid creating a vortex anywhere near the surface of the wing or propeller blade. Over a century of sustained study and effort has gone into minimizing distal vortices and keeping them as far away from the foil body as is humanly practicable. This effort takes the form of solutions which are not practical for many applications. At odds with this venerable body of practice stands the Eddy Propulsor, which by exploiting a novel fluid effect, non-intuitively maximizes the vortex over the greatest possible extent of the receding surface to generate thrust in a new way.

An Eddy Propulsor 15 is shown in cross-section in FIG. 8A. Rotation of Eddy Propulsor 15 is driven counter-clockwise by rotational velocity 65. FIG. 8A shows the counter-flow 75 of fluid 1 surrounding the Eddy Propulsor 15 moves clockwise with respect to the Eddy Propulsor 15, and so a bound edge vortex 85 forms also with clockwise rotation over the face 40 and, more specifically, over the receding surface 50. FIG. 8B shows the pressure distribution over the face of Eddy Propulsor 15. A large region of low pressure 175 spans the face 40 from the receding edge 10 toward the edge of the face 12 opposite the receding edge 10, and a smaller region of increased pressure 180 resides over the face 50 near the edge of the face opposite the receding edge 10. Thus, regions of lower pressure 175 and higher pressure 180 can reside on the same face 40, side-by-side, and this is one factor driving the bound edge vortex 85 with its flow 86 across the face 40 of Eddy Propulsor 15. These two cross-sections do not show the aft flow of fluid that generates thrust. FIG. 8C shows a 3D rendering of the bound edge vortex 85 with core 88. This bound edge vortex 85 generates a large aft flow which imparts forward thrust on Eddy Propulsor 15.

Figure 9B:
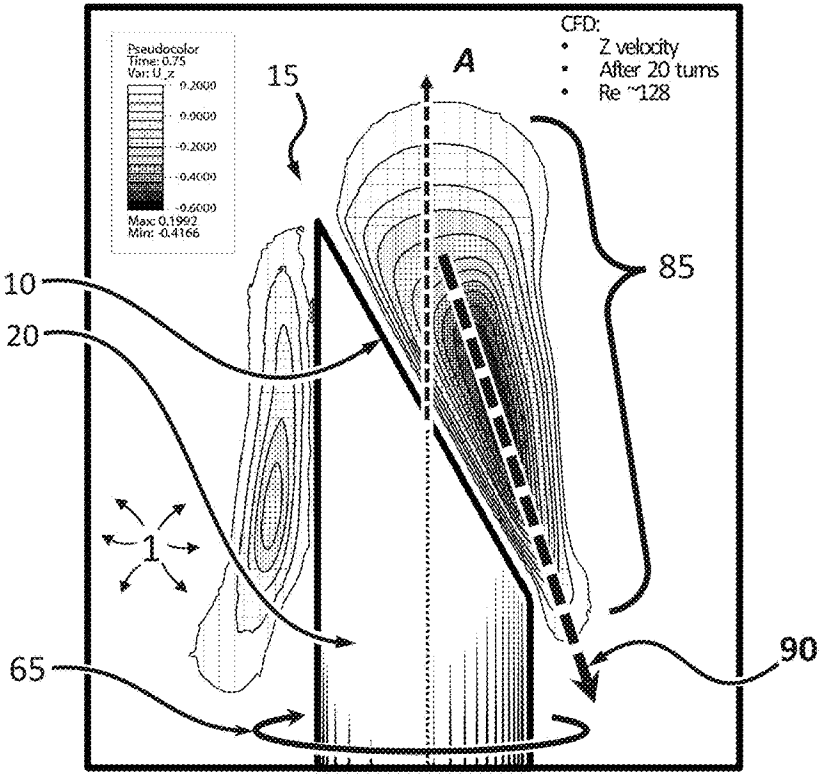
FIGS. 9A and 9B show the flow field around an Eddy Propulsor produced by a computational fluid dynamic simulation.
Figure 9A:
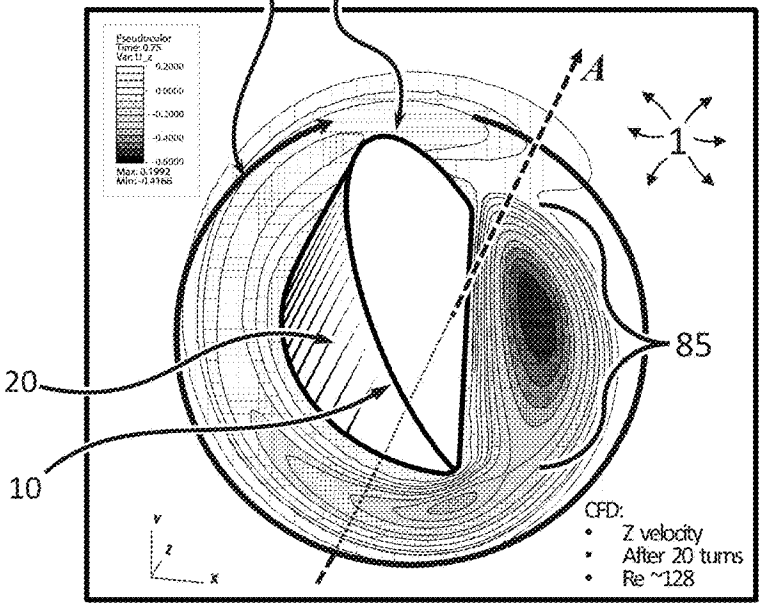

The flows generated by a one-lobed Eddy 110 are more clearly demonstrated in FIGS. 9A to 9D. FIGS. 9A and 9B show top/oblique and side views, respectively, of results of computational fluid dynamics modeling of a one-lobed Eddy Propulsor 110 rotating about axis of rotation A. FIG. 9A, showing a top/oblique view, and FIG. 9B, depicting a side view, shows the magnitude of the aftward flow 90. The central region of bound edge vortex 85 showing faster velocities corresponds with the predicted area of low pressure inside the bound edge vortex 85 seen in FIG. 8B.

Figure 9D:
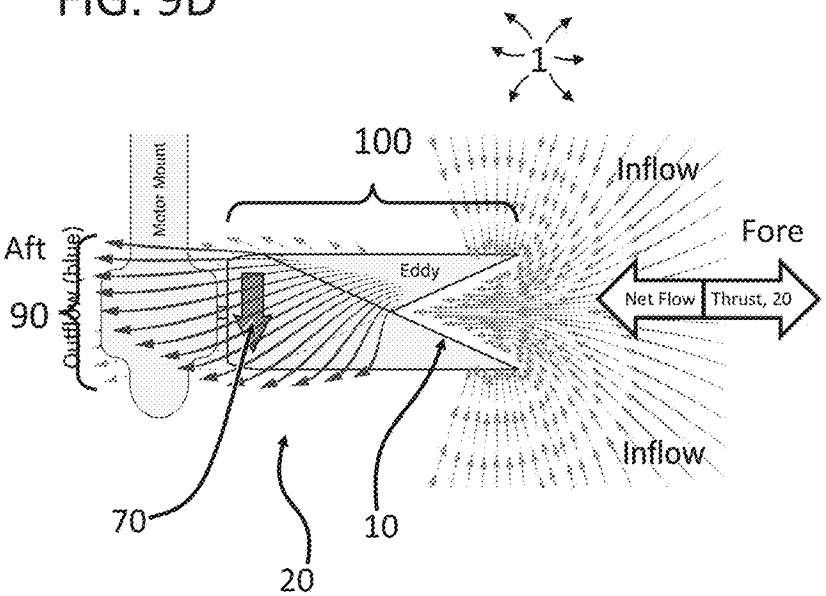
FIGS. 9C and 9D show the flow field around an Eddy Propulsor visualized from particle tracings.
Figure 9C:
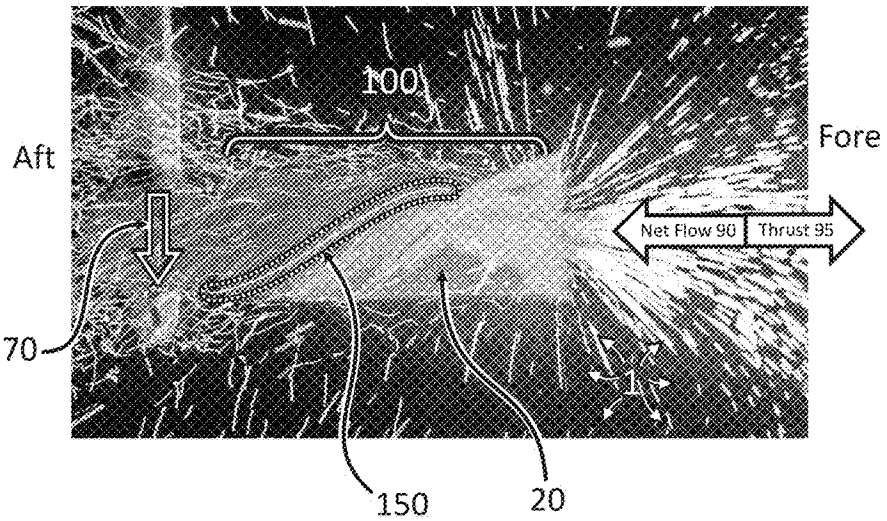

FIGS. 9C and 9D more clearly show the flow generated by a two-lobed Eddy 100 with body 20. FIG. 9C shows a streak photograph of a real two-lobed Eddy Propulsor 100 in water that has been seeded with neutral density fluorescent particles (illumination by UV light to stimulate fluorescence). The two-lobed Eddy Propulsor 100 was rotating at about 30 Hz, and this image combines 10 video images (0.33 seconds total duration) to create the white streaks. A strong aftward net flow is clearly visible as the particles are pulled in aftward from the forward end of the Eddy Propulsor 100 and radially inward from around the length of the Eddy Propulsor 100 and emit aft of the Eddy Propulsor 100, thereby generating forward thrust 95. Importantly, some particles were moving so quickly that they formed a streak (e.g., streak 150, outlined in FIG. 9C) on a single frame of video (integration time <33 ms), traveling approximately 50 mm aft (the Eddy Propulsor is about 50 mm long), yielding an aft speed of >1.5 meters per second. FIG. 9D shows a depiction of the flow field from particle tracings of video such as that used in FIG. 9C.

Figure 10A:
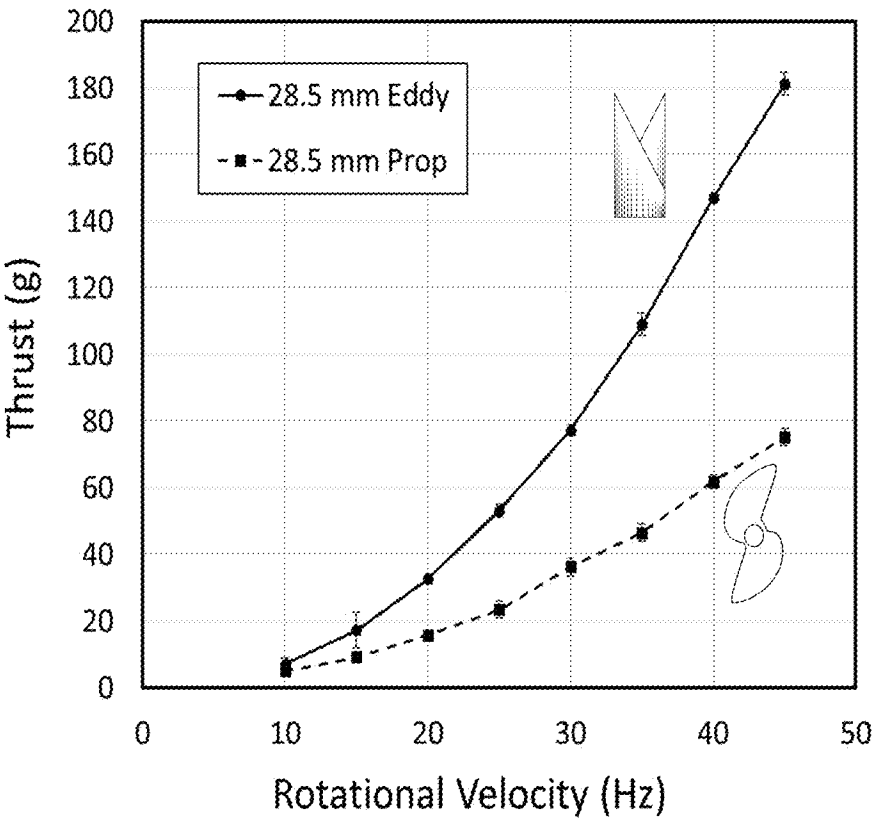
FIGS. 10A and 10B show the thrust generated by Eddy Propulsors and conventional propellers of the same diameters.
Figure 10B:
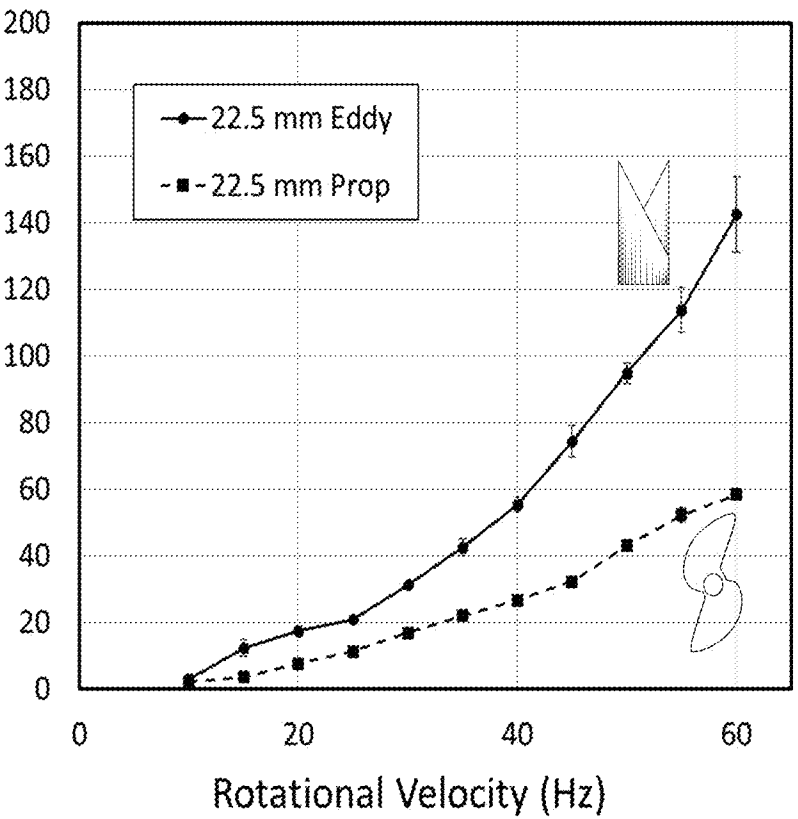

Demonstrably, an Eddy Propulsor produces significant thrust. FIGS. 10A and 10B show the thrust generated by two-lobed Eddy Propulsors and 2-blade propellers having the same diameter. In FIG. 10A both the Eddy Propulsor and the propeller have a diameter of 28.5 mm. In FIG. 10B both the Eddy Propulsor and the propeller have a diameter of 22.4 mm. The plots for both show the thrust (grams) as rotational velocity (Hz) varies. Both graphs show similar results. The Eddy Propulsor generates more than twice the thrust of the propeller at all rotational velocities. Otherwise, thrust increases with increasing rotational speed for both propulsors, as expected.

Among other important advantages, FIGS. 1C, 6A, 6B, 8A-8C, and 9A to 9B demonstrate that an Eddy Propulsor 15 generates a bound edge vortex 85 having a center of rotation at its core 88 at a distance from the various surfaces of that Eddy Propulsor. This allows, for example, an Eddy Propulsor 15 to create a strong, low-pressure vortex core 88 that faces forward, draws fluid aftward toward and past its aft end, all without exposing the surfaces of that Eddy Propulsor 15 to the lowest-pressure region that, in other propulsors such as propellers, is associated with cavitation, erosion of the surface of the propeller, and noise.

Figures 11A, 11B, 11C:
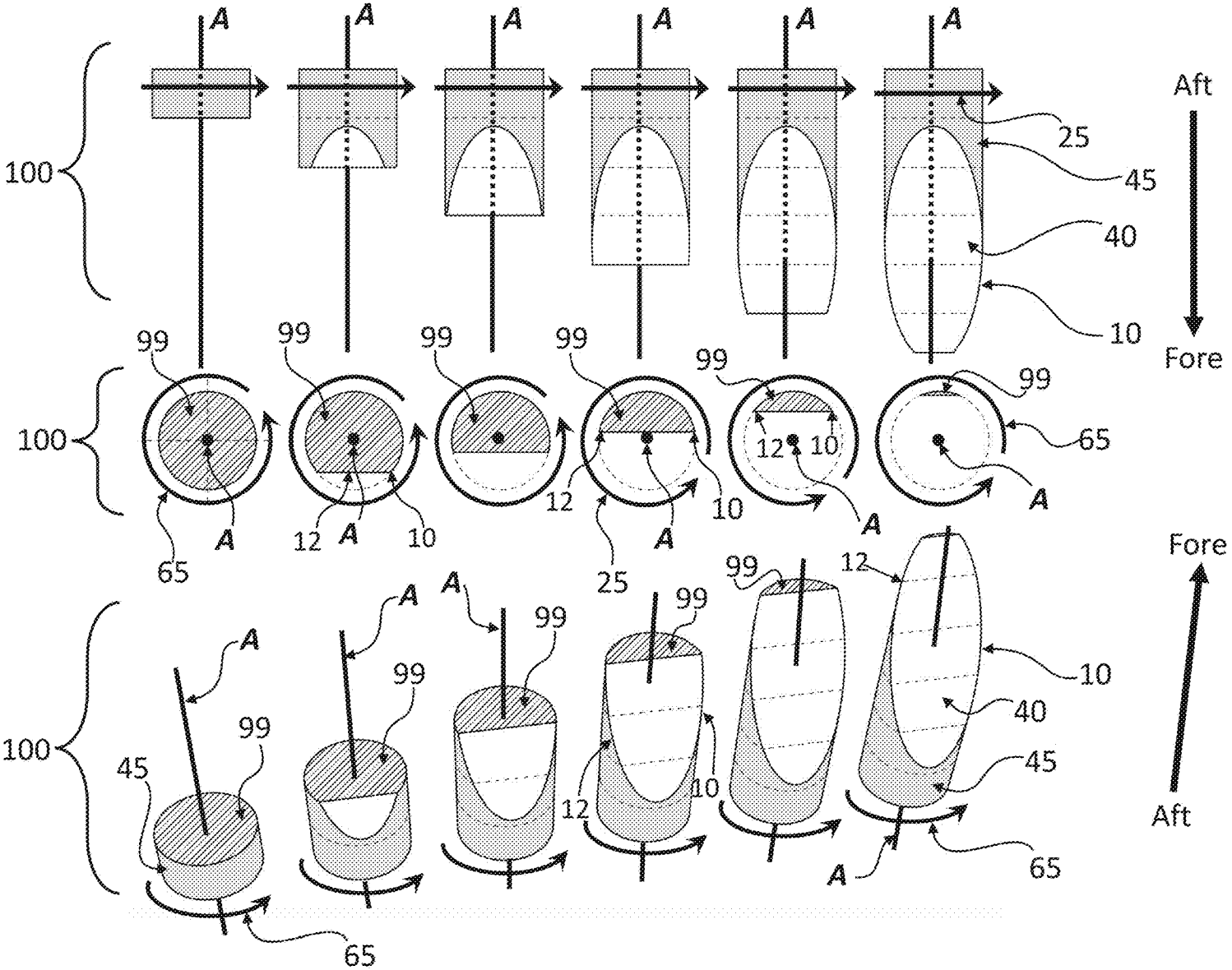
FIGS. 11A through 11C further illustrate the shape of an Eddy Propulsor having a flat face.

FIGS. 11A through 11C depict how the cross section of one embodiment of a one-lobed Eddy Propulsor 110 changes as a function of position along the one-lobed Eddy Propulsor 110. The one-lobed Eddy Propulsor 110 is shown with a rotational velocity 65 about the axis of rotation A, and possessing a rump surface 45, a face 50, and a receding edge 10. In FIGS. 11A through 11C, we can also see examples of the cross-sectional shape 99 that is revealed by sectioning the one-lobed Eddy Propulsor 100 six times in a plane perpendicular to the axis of rotation A. In this depicted embodiment, the shape of the cross-section 99 changes continuously along the axis of rotation A of the one-lobed Eddy Propulsor 100, but for clarity we have limited the samples of the cross-sectional shape 99. In FIG. 11A, we can see the one-lobed Eddy Propulsor 110 sectioned in six steps, progressively from fore to aft of the one-lobed Eddy Propulsor 110, and in FIG. 11B below 11A, we can see the resulting six cross-sectional shapes 99 revealed in each slice. FIG. 11C is provided to more clearly reveal the 3D form of this embodiment of the one-lobed Eddy Propulsor 110 as the six slices expose the cross-sectional shapes 99. In the slice furthest to the left in each of FIGS. 11A, 11B, and 11C, we can see that the slice aftmost reveals a circular cross-section, as that slice has yet to reach the longitudinal position intersecting the face 50 of the one-lobed Eddy Propulsor 110. Note that in this first cross-section 99, the receding edge 10 has yet to appear. In the next five slices, each more forward, we can see that the face 50 begets a straight line bounded by two corners of the cross-section 99, the corners marking the appearance of the receding edge 10 and the edge opposite the receding edge 10. Note that the fourth, fifth, and sixth slices produce a cross-sectional shape 99 that does not intersect the axis of rotation A, meaning that the rotation due to rotational velocity 65 of this monolithic one-lobed Eddy Propulsor 110 about the axis of rotation A causes at least part of the Eddy Propulsor 110 (for example the face 50 and the receding edge 10) to orbit, spin, or otherwise rotate around the axis of rotation A at a distance from the axis of rotation A.

Figure 12A:
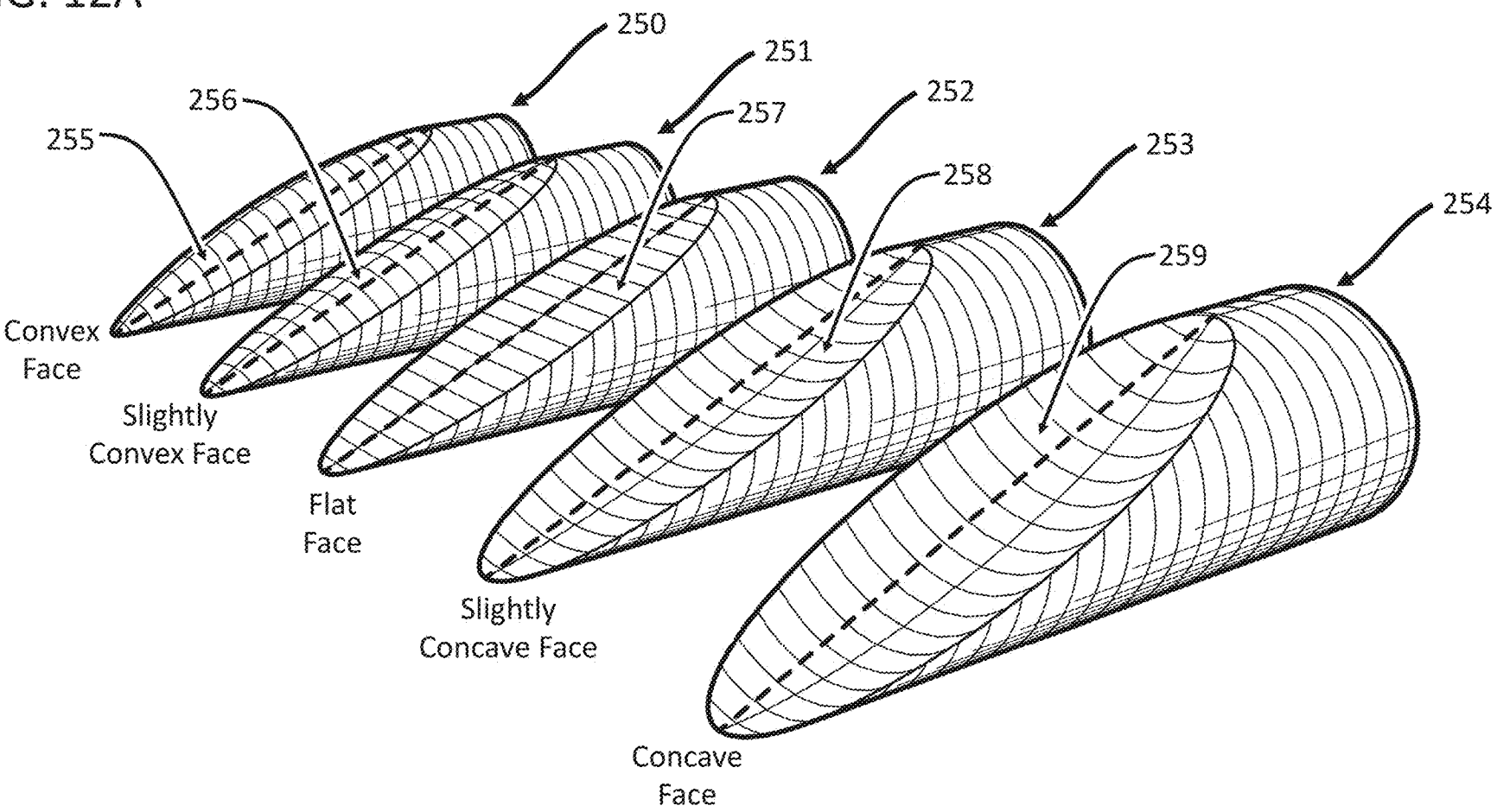
Figures 1, 2, 3, 4, 5, 12B:
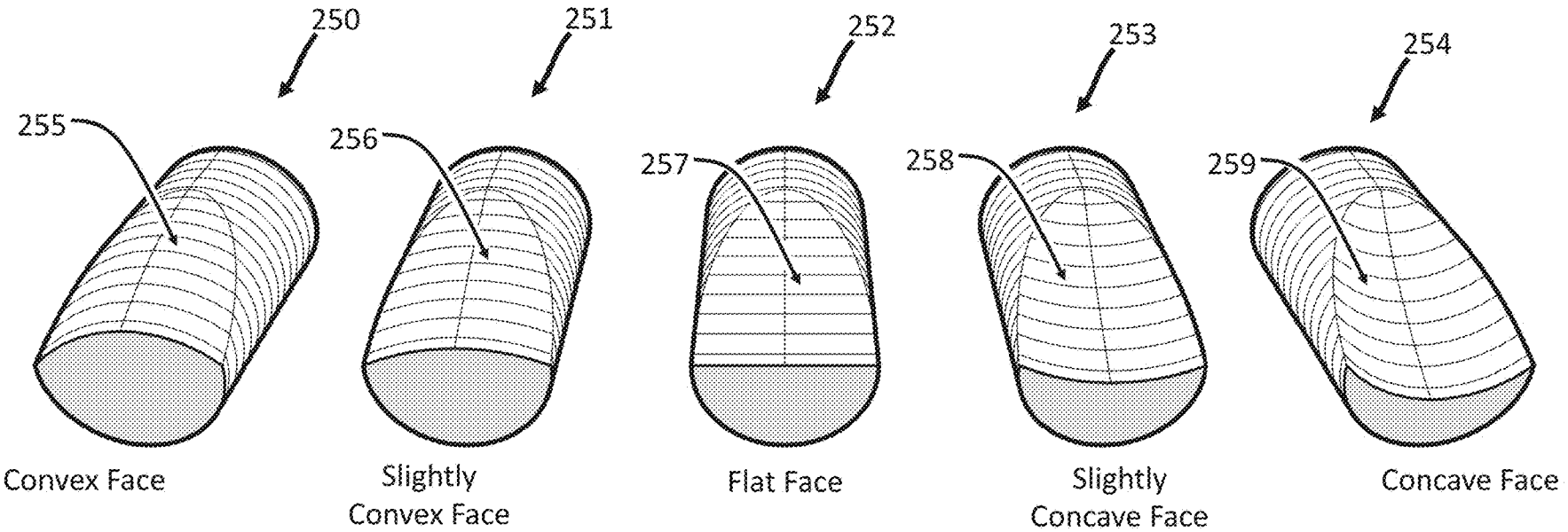

The at least one face 50 of a one-lobed Eddy Propulsor 15 is planar in the embodiments disclosed thus far, but as shown in FIGS. 12A and 12B, the at least one face of an Eddy Propulsor can be concave or convex, or the at least one face might have a more complex surface. FIG. 12A shows oblique views of the one-lobed Eddy Propulsors 250-254, and FIG. 12B shows an end-on view with a cross-section through the one-lobed Eddy Propulsors 250-254 to show the Eddy Propulsors' profiles. The five Eddy Propulsors in FIGS. 12A and 12B show a gradient from convex face on the left 255 to concave face on the right 259 with the center Eddy Propulsor having a flat face 257.

Figure 13:
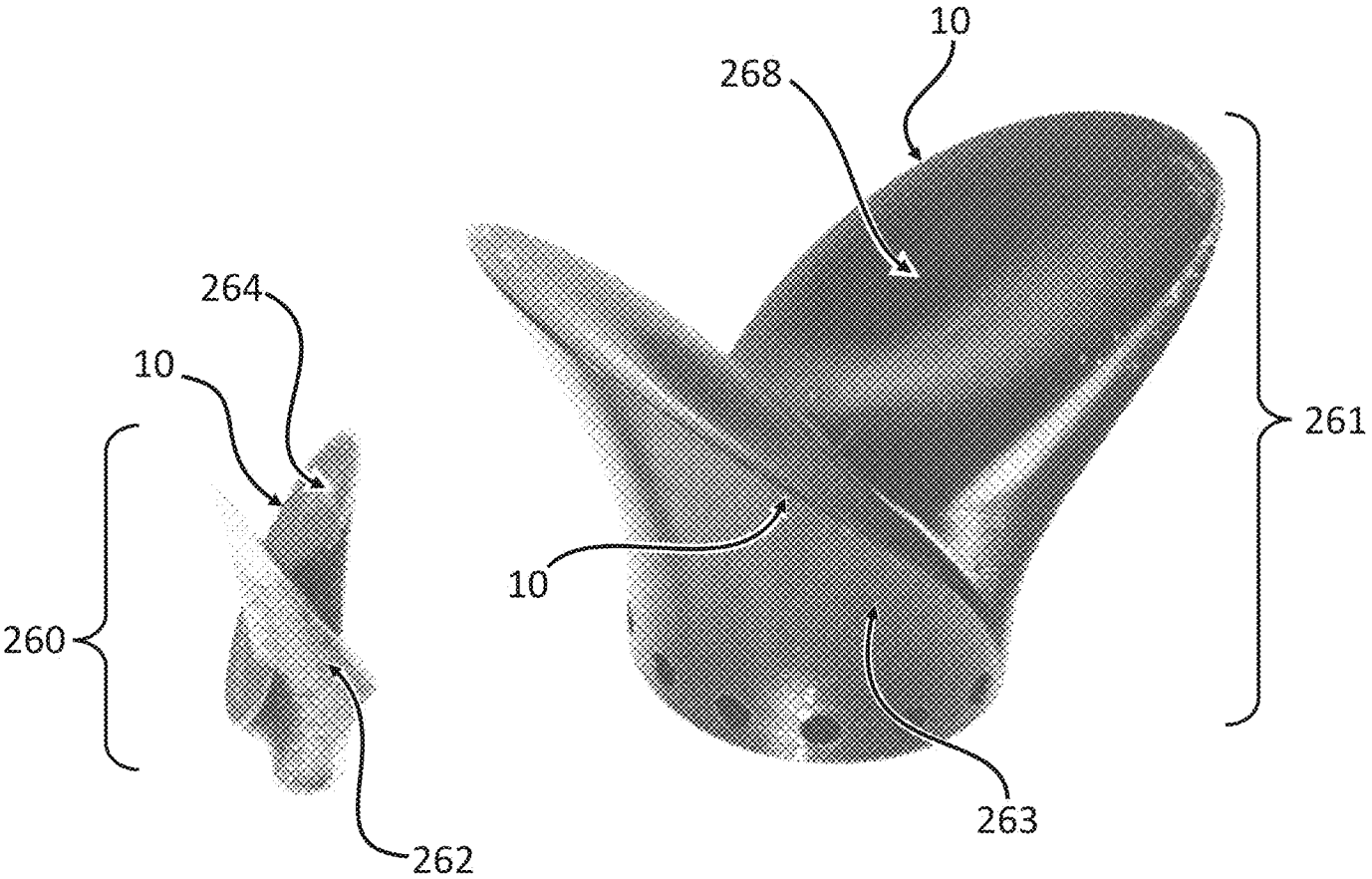
FIG. 13 shows two two-lobed Eddy Propulsors having rump surfaces and faces with complex shapes.

Similarly, in FIGS. 1A and 1B the at least one rump surface 45 is depicted as being a circular cylinder such that all points on the at least one rump surface 45 are an equal radial distance from the axis of rotation A. The face and rump surface of an Eddy Propulsor need not be so configured and may instead be composed of more complex surfaces. FIG. 13 shows examples of more complex face and rump surfaces on two different two-lobed Eddy Propulsors, 260 and 261 possessing different complex faces 264 and 268 and complex rump surfaces 262 and 263, respectively.

Figure 14A:
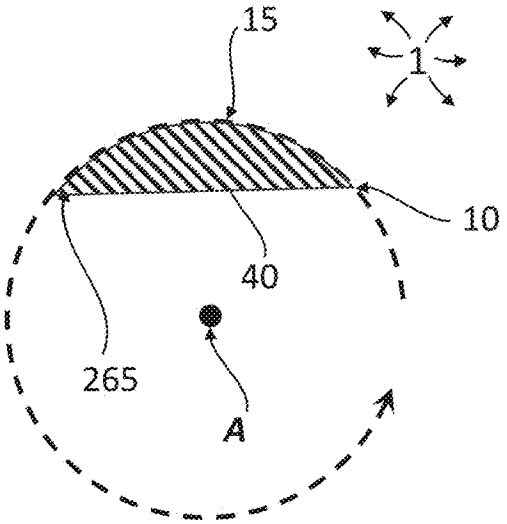
FIG. 14A shows an Eddy Propulsor with a sharp edge on the side of the face opposite the receding edge.
Figure 14B:
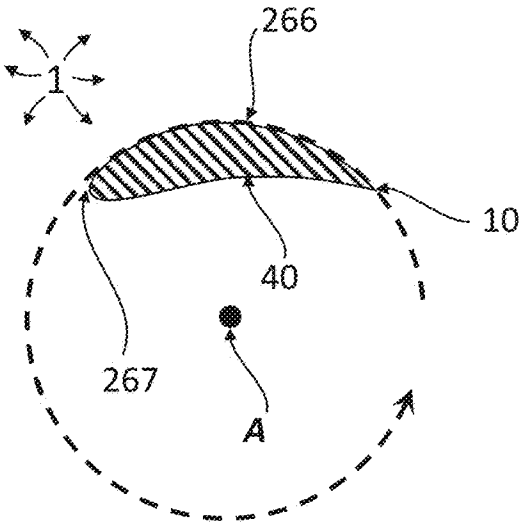
Figures 1, 14C:
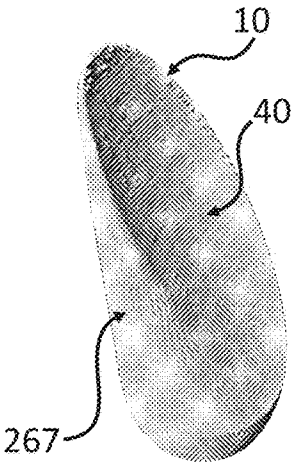
Figures 2, 14C:
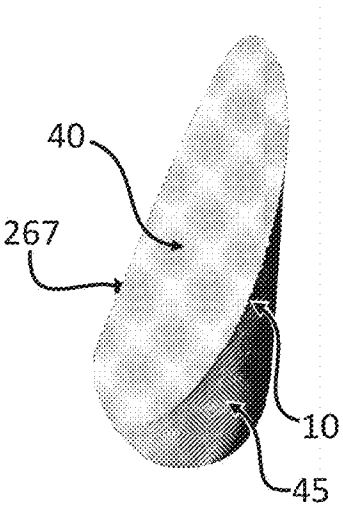

Another possible variation in the design of Eddy Propulsors is in the nature of the edge opposite the receding edge 10 on the at least one face 40 of the Eddy Propulsor. In most of the previously discussed aspects, this edge is sharp (as in FIG. 6A). This edge can also be blunt as in FIG. 6B. FIG. 14A shows one cross-section through such an Eddy Propulsor 15 having a sharp edge 265 opposite receding edge 10. FIG. 14B shows another Eddy Propulsor 266 having a blunt edge 267 opposite receding edge 10. Such a one-lobed Eddy having a blunt edge 267 has a cross-section through the Eddy Propulsor that is a more tear-drop shaped. Note that the Eddy Propulsor in FIGS. 14B, 14C-1, and 14C-2 also has a concave face. FIGS. 14B through 14C-2 show examples of Eddy Propulsors having a blunt leading edge 267, and Eddy Propulsors can have other types and shapes of non-sharp edges.

Conversely, the receding edge 10 of an Eddy Propulsor must have a sharp or substantially sharp edge at most points. The bound edge vortex forms at the receding edge of the at least one face of an Eddy Propulsor, and the shape of the receding edge influences the bound edge vortex.

Further description will benefit by defining three different reference frames: IJK which is 3-space and stationary with K parallel to the axis of rotation A and two different frames of reference that can be defined at any point P on the receding edge: TNB and XYZ. (Note that this description uses the notation that a vector is bold-face and italicized, e.g., T, whereas the magnitude of that vector is neither bold nor italicized, e.g., T.)

Figures 15A, 15B:
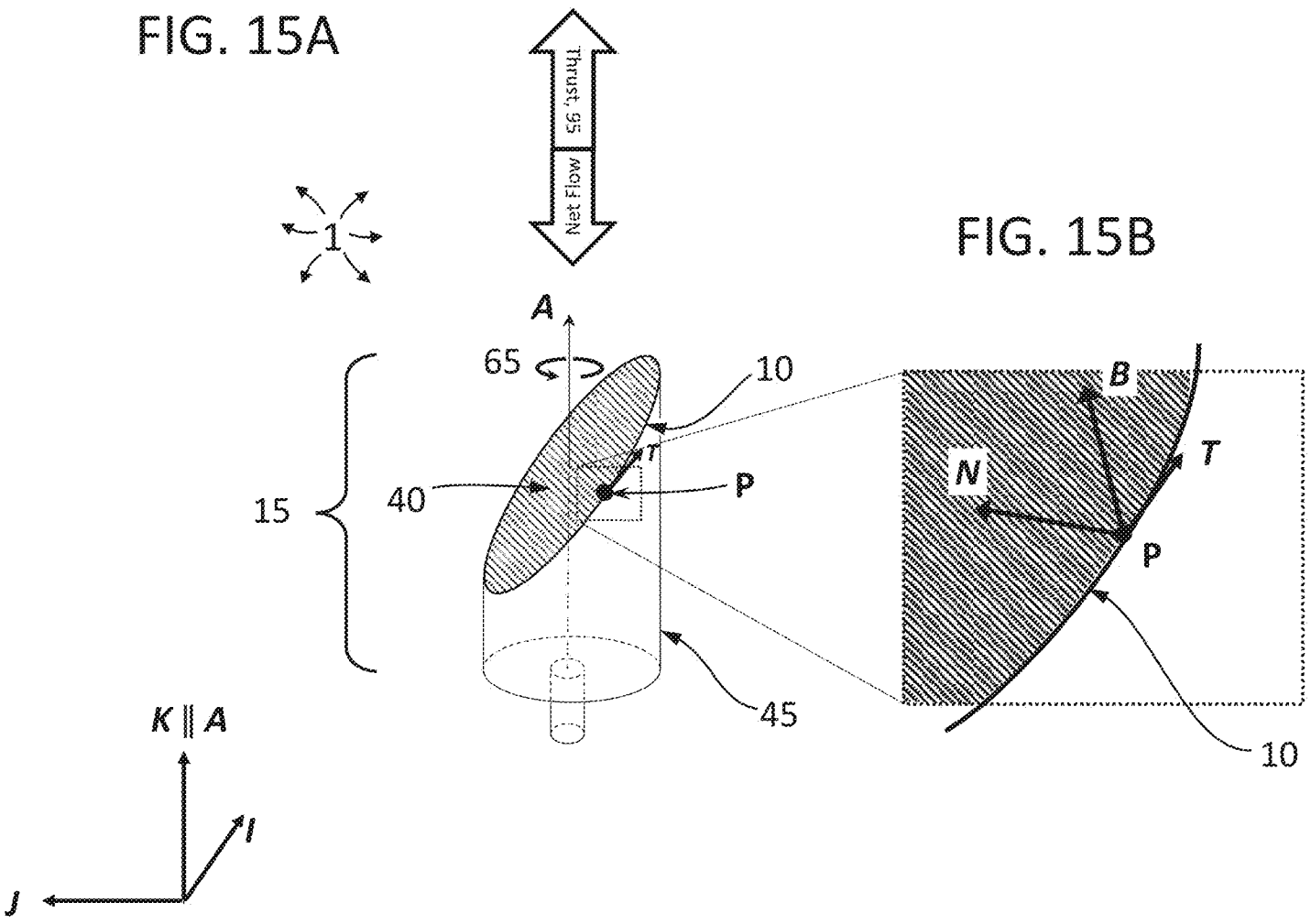
FIGS. 15A and 15B show the TNB reference frame in relation to the receding edge of a one-lobed Eddy Propulsor.

FIGS. 15A and 15B depict the tangent-normal-binormal TNB reference frame commonly used in differential geometry (e.g., P. Gillett, "Calculus and Analytic Geometry", $2^{nd}$ ed., DC Heath and Co. 1984, Chapter 6, section 6). (FIG. 15A shows the entire Eddy Propulsor 15, and FIG. 15B shows an enlargement of the features around point P on the receding edge 10.) TNB can be defined at any point P on the receding edge 10. The tangent T is a unit vector pointing in the direction of the local tangent. The normal vector N is a unit vector perpendicular to T and lying in the plane in which T instantaneously turns at point P. The binormal vector B is the cross-product of T and N ($\mathbf{B}=\mathbf{T}\times\mathbf{N}$) and is thus perpendicular to both T and N, forming a right-hand reference frame. We define the "local radius" R', which is parallel to N and has the magnitude of the inverse of the local curvature k which has units of inverse length ($R'=N/\kappa$). (Note for clarification: a circle has a curvature K defined as the inverse of the radius of the circle, κ=1/radius). Again, IJK is a reference frame fixed in space with K parallel to the axis of rotation A.

Figures 16A, 16B:
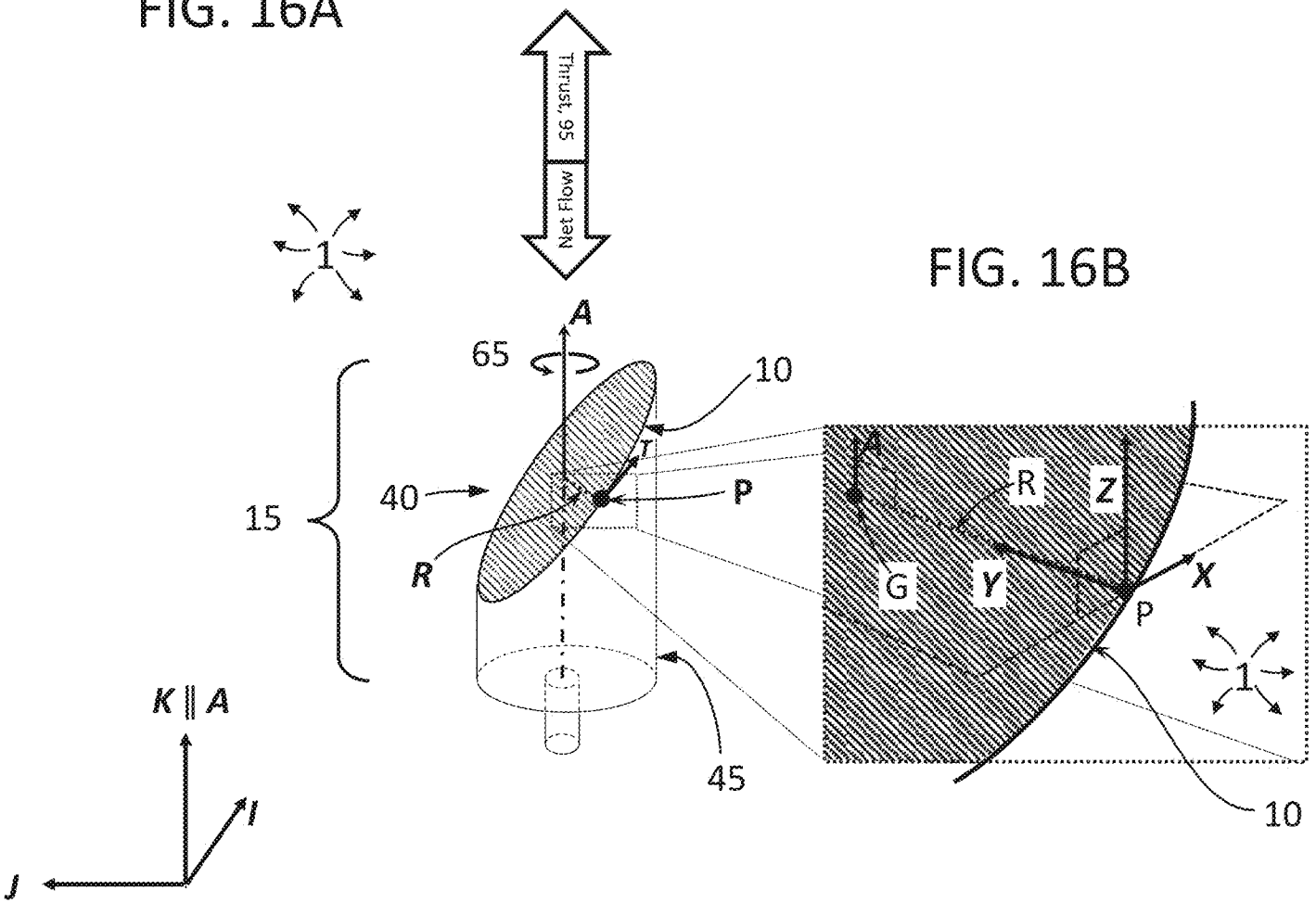
FIGS. 16A and 16B show the XYZ reference frame in relation to the receding edge of a one-lobed Eddy Propulsor.

FIGS. 16A and 16B depict the XYZ reference frame at any point P on the receding edge. (FIG. 16A shows the entire Eddy Propulsor 15, and FIG. 16B shows an enlargement of the features around point P on the receding edge 10.) Z is parallel to the axis of rotation A, and X and Y are orthogonal axes and are both perpendicular to the axis of rotation A. Y points toward the axis of rotation A and is perpendicular to A. X is the cross-product of Y and Z (X=Y×Z). (Note: the XY-plane is thus parallel to the IJ-plane.) Here, we define the "global radius" R which is a line parallel to Y (and thus lying in the XY-plane) extending from point P to the axis of rotation A. These relationships also define a point G which is the intercept of the axis of rotation A and the global radius R. For clarification, G is thus the point of intercept of the axis of rotation A and the XY-plane where the XY-plane also contains point P, and thus the magnitude R of the global radius R (R=|R|) is the distance between P and G.

Note that the XY-plane is transverse to Z and thus to the axis of rotation A. Similarly, the axis of rotation A lies in the YZ-plane. The XY-plane is thus sometimes referred to as a "transverse" plane, and the YZ-plane is sometimes referred to as a "parallel" plane.

The TNB and XYZ reference frames can be defined at every point on the receding edge 10 of an Eddy Propulsor. Note that the local radius R' and the global radius R are not necessarily parallel or co-planar and are not necessarily of equal magnitude (R does not necessarily equal 1/κ). Note also that the global radius R and the rotational velocity 65 yield the rotational speed $U_\omega$ of the point P in space given by $U_\omega=2\pi R\omega$ (ignoring translation of the Eddy Propulsor, such as moving forward through the fluid) where ω is the magnitude of the rotational velocity 65 about the axis of rotation A and the motion is in the X-direction). Note also that XYZ can be defined for any point on the surface of the Eddy Propulsor (the face and the rump surface) such that, ignoring translation of the Eddy Propulsor 15, all points on the surface of the Eddy Propulsor 15 move parallel to the XY-plane with a rotational speed $U_\omega$ given by each point's global radius R and directed in that point's X-direction.

Figures 17A, 17B, 17C, 17D:
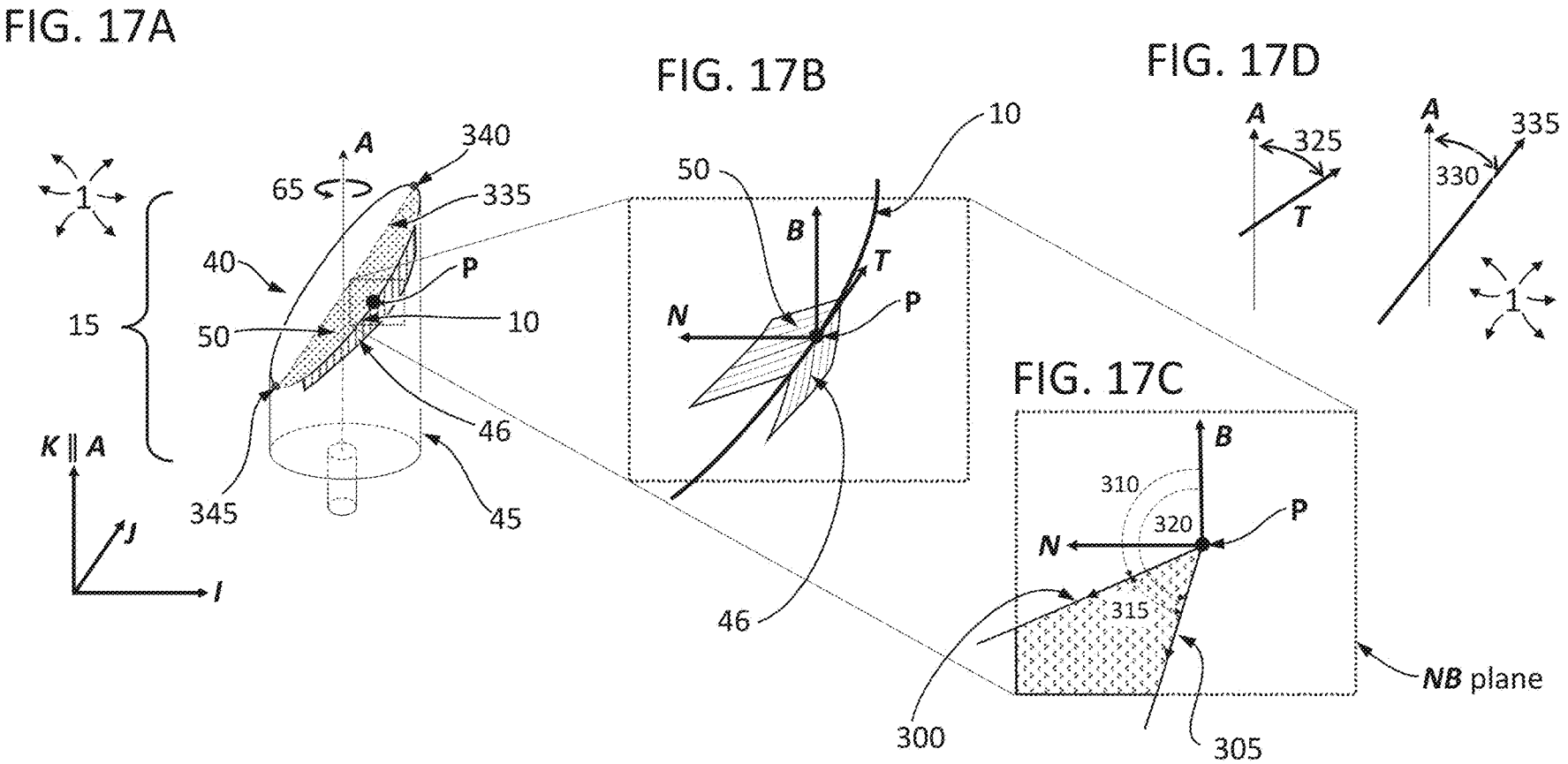
FIGS. 17A to 17D show the TNB reference frame in relation to the receding edge to define angles describing the receding edge.

FIGS. 17A to 17D show point P and the TNB reference frame on the receding edge 10 of an Eddy Propulsor 15. (FIG. 17A shows the entire Eddy Propulsor 15; FIG. 17B shows an enlargement of the features around point P on the receding edge 10; FIG. 17C shows an NB-plane cross-section through the Eddy Propulsor at the receding edge 10; and FIG. 17D illustrates the global angle of inclination 330 and the local angle of inclination 325.) The receding surface 50 is the portion of the face 40 adjacent to the point P, and the adjacent rump surface 46 is the portion of the rump surface 45 adjacent to point P. Two intercepts with the NB-plane are defined: a first intercept 300 with the receding surface 50, and a second intercept 305 with the adjacent rump surface 46. These two intercepts define 3 angles: the receding face angle 310 between B and the intercept 300 of the receding surface 50; the receding edge angle 315 formed by the intercept 300 and the intercept 305; and the receding rump angle 320 formed by B and the intercept 305. Note that the receding rump angle 320 equals the sum of the receding face angle 310 and the receding edge angle 315. Note also that in this instance these angles can vary along the length of the receding edge 10 of the depicted Eddy Propulsor 15. In the example given here in FIG. 17, the receding edge angle 315 is 90° at the midpoint of the receding edge 10, increases aftward, and decreases forward. We also define the local angle of inclination 325 at a point P on the receding edge 10 as the angle between the tangent vector T and the axis of rotation A. The local angle of inclination 325 is thus defined locally at every point P on the receding edge 10. In a first exemplary aspect the local angle of inclination 325 can vary from 0° to 90°, in a more specific aspect from 1° to 85°, and in an even more specific aspect from 10° to 80°. Additionally, a global angle of inclination 330 is defined as the angle formed by the axis of rotation A and a line 335 connecting the foremost point 340 and the aftmost point 345 on the receding edge 10 of an Eddy Propulsor 15. The global angle of inclination 330 can vary in a first exemplary aspect from 0° to 90°, in a more specific aspect from 1° to 85°, and in a more specific aspect from 15° to 75°.

Figures 18A, 18B:
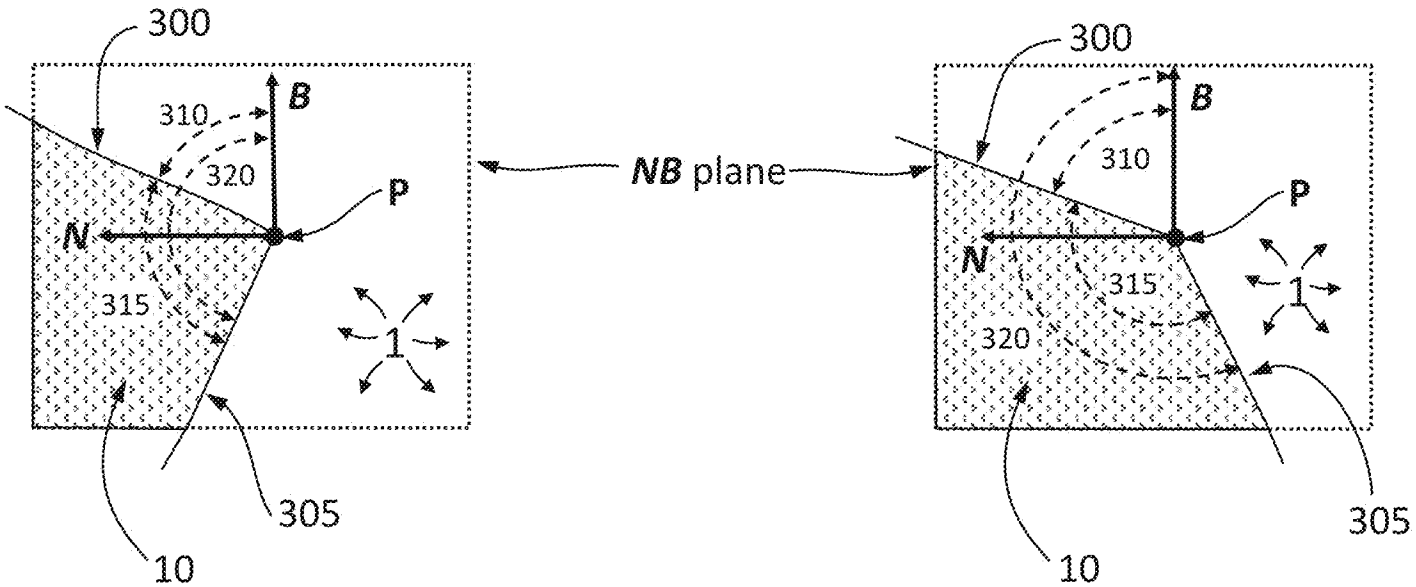
FIGS. 18A and 18B show exemplary angles of the receding edge of an Eddy Propulsor.

FIGS. 18A and 18B shows two different Eddy Propulsors 100 having different receding face angles 310, receding edge angles 315, and receding rump angles 320 to illustrate the variety of angles on the receding edge. In FIG. 18A, the receding edge angle 315 is approximately 90°, the receding face angle 310 is less than 90°, and the receding rump angle 320 is greater than 90° but less than 180°. In FIG. 18B, the receding edge angle 315 is greater than 90°, the receding face angle 310 is less than 90°, receding edge angle 315; the receding face angle 310, and the receding rump angle 320, as would be measured with an angle gage in a machine shop, can range from 1° to 160°, 5° to 150°, and 90° to 250°, respectively; in a more specific aspect from 10° to 100°, 10° to 135°, and 135° to 225°, respectively; and in an even more specific aspect from 20° to 90°, 20° to 120°, and 130° to 215°, respectively.

FIGS. 19A.1 to 19A.3 show the XYZ reference frame at point P on the receding edge 10 of an Eddy Propulsor 15. (FIG. 19.A.1 shows the Eddy Propulsor 15; FIG. 19.A.2 presents an enlarged view around point P on the receding edge 10; and FIG. 19.A.3 shows only the XY-plane for clarity.) To repeat, the Z axis is parallel to the axis of rotation A, and the XY-plane is normal to the Z axis with Y pointing at the axis of rotation A. As in FIG. 17, the receding surface 50 is the portion of the face 40 adjacent to point P, and the receding rump surface 46 is the portion of the rump surface 45 adjacent to point P. Two intersects with the XY-plane are defined in FIG. 19A. 3: the intercept 350 with the receding surface 50, and the intercept 355 with the receding rump surface 46. As described above, all points on the surface of the Eddy Propulsor 15 move circumferentially in the XY-plane and, thus, all points on the intercept 355 move circumferentially. We define a length, the radial span 360, between (a) point G on the XY-plane (the intercept of the axis of rotation A and the XY-plane, as defined in FIG. 16) and (b) any point on the XY-plane. We further define a region, the receding circumferential plate 135, as that region along the receding rump surface/XY intercept 355 in which all points on the intercept 355 have approximately the same radial span 360, where approximately is defined as less than +/−20% or, alternatively, as less than +/−10%. This region, the receding circumferential plate 135 interacts with fluid prior to its movement past the receding edge 10 as the Eddy 15 rotates and thus determines the nature of its flow and thus the establishment of the receding edge vortex. The receding circumferential plate 135 can have a length along the intercept 120 of at least 1% of the radial distance of point P, or in a less specific example of at least 5% of the radial distance of point P.

FIGS. 19B.1 to 19B.3 and 19C.1 to 19C.3 present an alternate description of the adjacent rump surface 46 (relative to the description presented in FIGS. 19A.1 to 19A.3).

Specifically, FIGS. 19B.1 to 19B.3 and 19C.1 to 19C.3 describe two parameters the transverse thickness $T_T$ and the axial thickness $T_A$. The adjacent rump surface 365 is bounded at point P by the receding edge 10, the axial thickness $T_A$ parallel to Z from point P, and the transverse thickness $T_T$ parallel to X from point P. To repeat, the Z axis is parallel to the axis or rotation A, and the XY-plane is normal, or "transverse", to the Z axis with Y pointing at the axis of rotation A. Additionally, the receding edge radius $R_{RE}$ at point P is defined as being equal to the radial span $R_P$ at point P. (Note this is the same as the length of the "global radius" R described earlier.)

FIGS. 19B.1 to 19B.3 illustrate the transverse thickness $T_T$. (FIG. 19.B.1 shows the Eddy Propulsor 15; FIG. 19B.2 presents an enlarged view around point P on the receding edge 10; and FIG. 19B.3 shows only the XY-plane for clarity.) The receding surface 50 is the portion of the face 40 adjacent to point P, and the adjacent rump surface 46 is the portion of the rump surface 45 adjacent to point P. Two intersects with the XY-plane were defined in FIG. 19A.3: the intercept 350 with the receding surface 50, and the intercept 355 with the adjacent rump surface 46. The adjacent rump surface 365 extends transversely (i.e., parallel to X) from the receding edge at point P a distance equal to the transverse thickness $T_T$. The transverse thickness $T_T$ is not less than, for example, 1% of the receding edge radius $R_{RE}$; in a more specific aspect not less than 5% of the receding edge radius $R_{RE}$, and in a more specific aspect not less than 10% of the receding edge radius $R_{RE}$. Within the transverse thickness $T_T$, all points on the intercept 355 have approximately the same radial span 360 as the receding edge radius $R_{RE}$. Here, approximately is defined as within +/−20% of the receding edge radius $R_{RE}$, more narrowly, within +/−10% and, even more so, within +/−5%.

FIGS. 19C.1 to 19C.3 illustrate the axial thickness $T_A$. (FIG. 19C.1 shows the Eddy Propulsor; FIG. 19C.2 presents an enlarged view around point P on the receding edge 10; and FIG. 19B.3 shows only the YZ-plane for clarity.) FIG. 19B.3 shows the YZ-plane and its intercepts 351 and 356 with the receding surface 50 and the adjacent rump surface 46, respectively. The adjacent rump surface 365 extends axially (i.e. parallel to Z and thus to the rotational velocity A) from the receding edge at point P a distance equal to the axial thickness $T_A$. The axial thickness $T_A$ is not less than 1% of the receding edge radius $R_{RE}$; in a more specific aspect 5% of the receding edge radius $R_{RE}$, and in a more specific aspect 10% of the receding edge radius $R_{RE}$. Within this axial thickness, all points on the intercept 356 have approximately the same radial span 360. Here approximately is defined as within +/−20% of the receding edge radius $R_{RE}$, more narrowly, within +/−10%, and, even more so, within +/−5%.

To reiterate, as an Eddy Propulsor rotates, the adjacent rump surface, and specifically the adjacent rump surface, shape the motion of the fluid as the Eddy Propulsor rotates, flowing over the adjacent rump surface and past the receding edge. The receding surface creates a negative pressure region immediately above the receding surface. The sharp receding edge presents a discontinuity between the flow over the adjacent rump surface and the negative pressure over the receding surface, when combined with the local angle of inclination of the receding edge, causes the fluid flowing past the receding edge to create a bound edge vortex over the receding surface. The bound edge vortex over the receding surface is canted such that the core of the bound edge vortex is approximately parallel to the receding face of the Eddy Propulsor and thus has a significant fore-to-aft component of velocity. The fore-to-aft component of velocity drives fluid aftward and creates thrust as the Eddy Propulsor rotates. To reiterate, that bound edge vortex is CAPTURED, or BOUND, over the receding face of the Eddy Propulsor and remains over the receding face of the Eddy Propulsor, driving fluid aftward and thus creating thrust, as long as the Eddy Propulsor rotates.

Figure 20C:
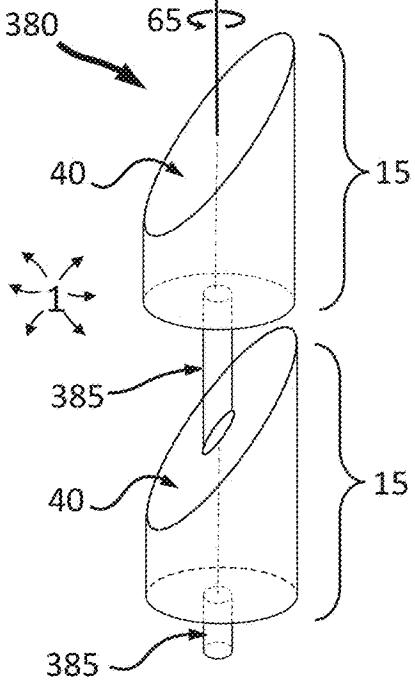
FIG. 20C demonstrates two or more Eddy Propulsors affixed one after the other onto a common drive shaft, with the Eddy Propulsors having the same rotational phase on the drive shaft.
Figure 20B:
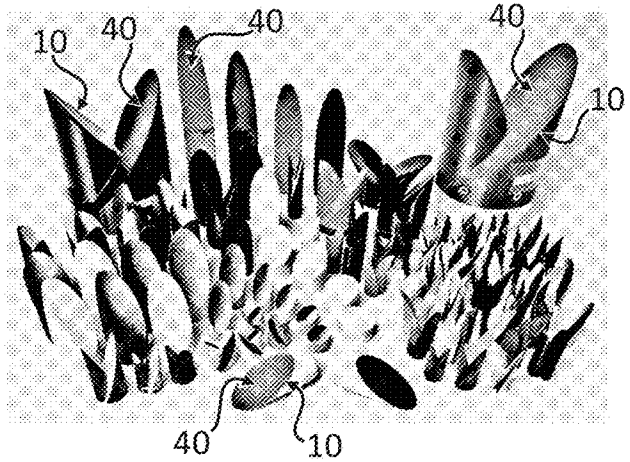
FIG. 20B shows a selection of Eddy Propulsors having multiple lobes and diverse shapes and sizes.
Figure 20A:
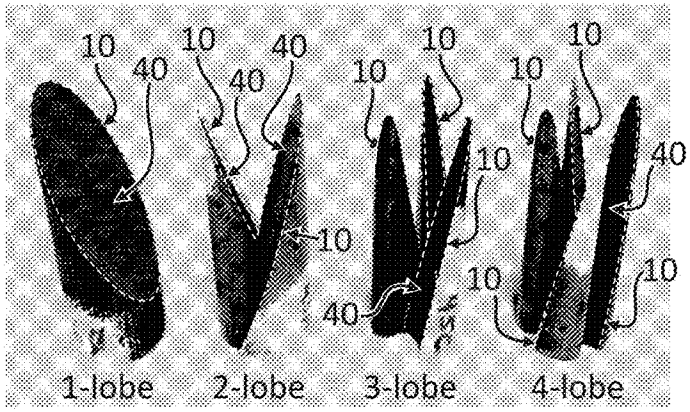
FIG. 20A shows Eddy Propulsors with multiple lobes.
Figure 20D:
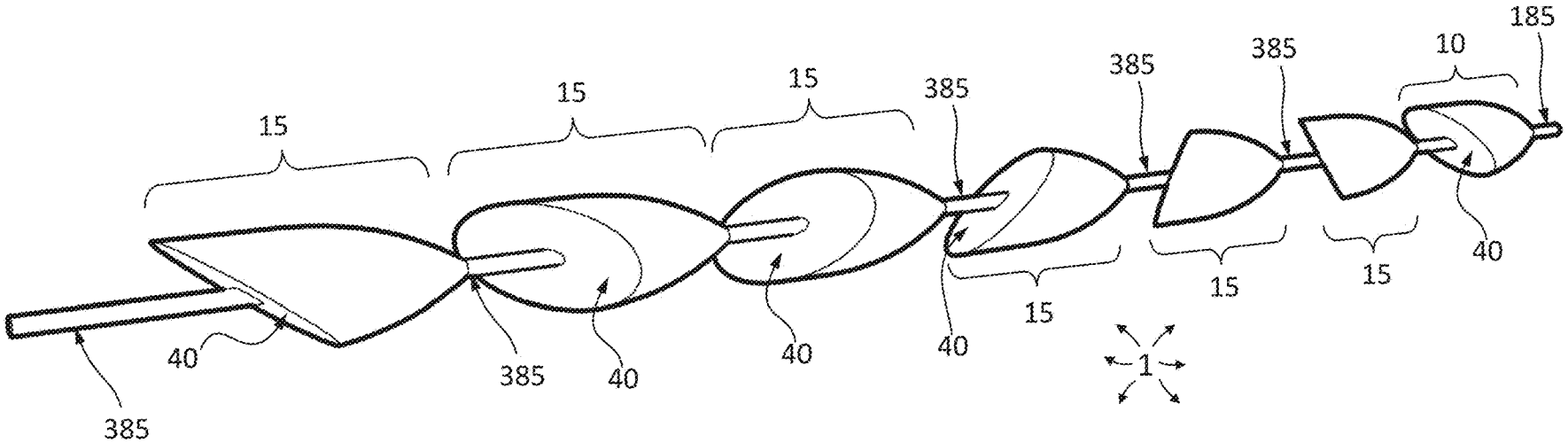
FIG. 20D shows multiple Eddy Propulsors affixed one after the other onto a common drive shaft and having different rotational phases.

Most aspects of the Eddy Propulsors described thus far have only one face 40, but this is not a limitation as evidenced by Eddy Propulsor 100 or 102. Eddy Propulsors can have a plurality of faces 40. We refer to such Eddy Propulsors as having multiple "lobes". FIG. 20A shows four different Eddy Propulsors having 1-, 2-, 3-, and 4-lobes. In multi-lobed Eddy Propulsors, the face of each lobe has a receding surface 40 with a receding edge 10. Thus, multi-lobed Eddy Propulsors may generate multiple bound edge vortices, one for each receding edge. The embodiments shown here employ identical lobes, faces, and receding edges on each lobe. In contrast, it is possible to make Eddy Propulsors with heterogeneous lobe geometries, with differing lobes and faces on a single Eddy Propulsor, such as lobes having differing faces, differing lengths, differing widths, differing curved surfaces including complex 3D curves, etc. FIG. 20B shows a host 380 of Eddy Propulsors having single and multiple lobes, each with their respective faces 40 and receding edges 10. Furthermore, as shown in FIG. 20C, it is possible to assemble or arrange the multiple Eddy Propulsors 10 axially along the axis of rotation A and mounted to a common drive shaft 385, for example with some Eddy Propulsors positioned upstream of others. For such axially arrayed Eddy Propulsors 380, it is possible for the faces 50 to be fixed in the same phase of rotation, as seen in FIG. 20C, or with different, distinct phases of rotation, as shown in FIG. 20D. Additionally, it is possible for Eddy Propulsors to have differing distances of fore/aft lobe displacement and for a single Eddy Propulsor with multiple lobes to have those lobes displaced differently fore and aft, splayed differently, and phased differently. A plurality of Eddy propulsors can be arranged coaxially and distributed along a shaft as above, or two or more Eddy Propulsors could be coaxial but occupy the same longitudinal extent, so that the Eddy Propulsors are configured as closely nested bodies of differing radii and rotating within one another. Alternatively, a plurality of Eddy Propulsors might be configured to rotate about a plurality of non-coaxial axes of rotation, for example configured as an array of Eddy Propulsors, where the bodies of the plurality are arranged as longitudinally coincident but not coaxial, and where the bodies of the plurality are configured to rotate in arbitrary directions and at arbitrary rates. The plurality of Eddy Propulsors in the arrangements above need not possess identical dimensions of bodies, lobes, or rotational velocities.

Figure 21:
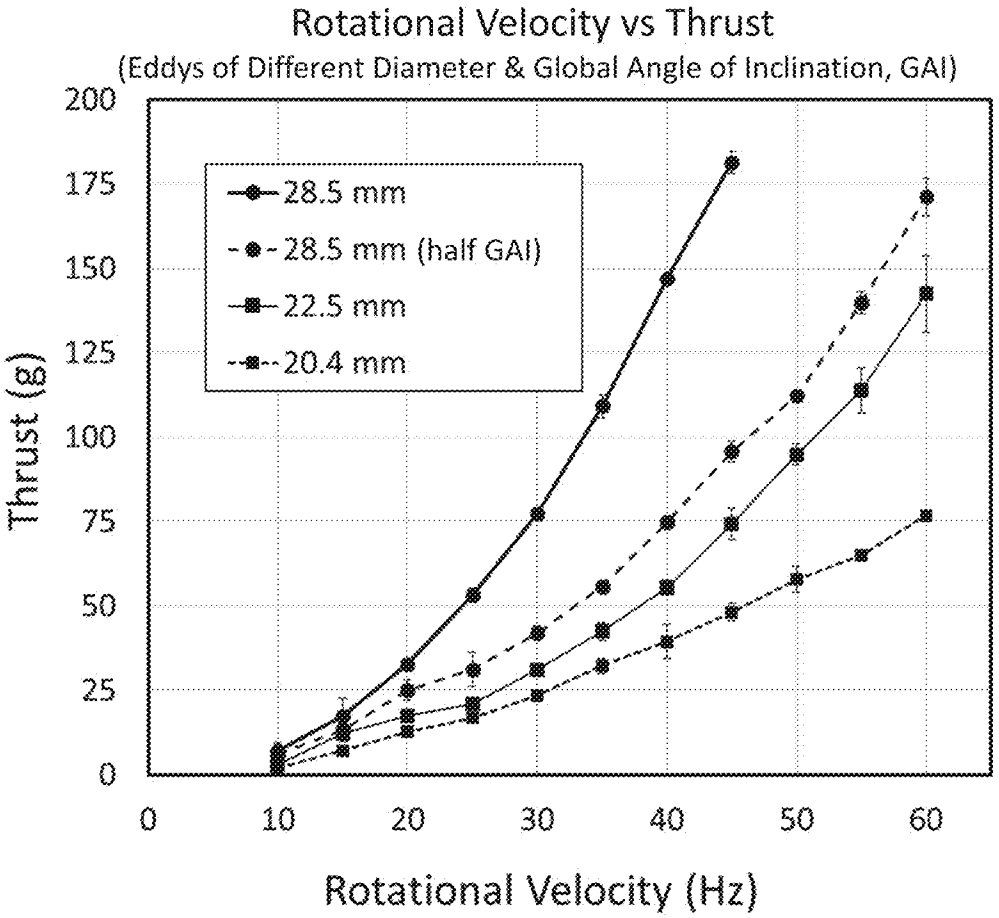
FIG. 21 shows the thrust generated by Eddy Propulsors having different diameters and different global angles of inclination.

FIG. 21 shows the thrust of different Eddy Propulsors having different diameters and global angles of inclination (GAI). Under the conditions and ranges of parameters tested, Eddy Propulsors having larger diameters and larger GAIs generate more thrust at the same rotational velocities.

Figure 22B:
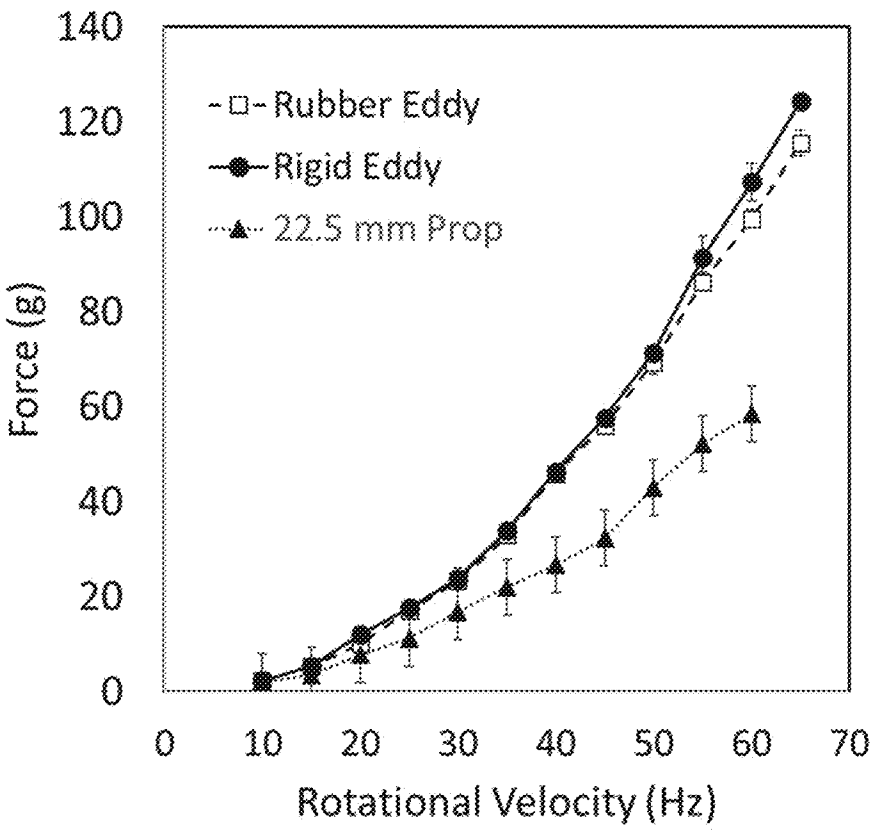
FIG. 22B graphs thrust generated by a pair of identically shaped Eddy Propulsors, one made of rubber and the other of rigid plastic, and by a propeller made of rigid plastic, all of the same diameter.
Figure 22A:
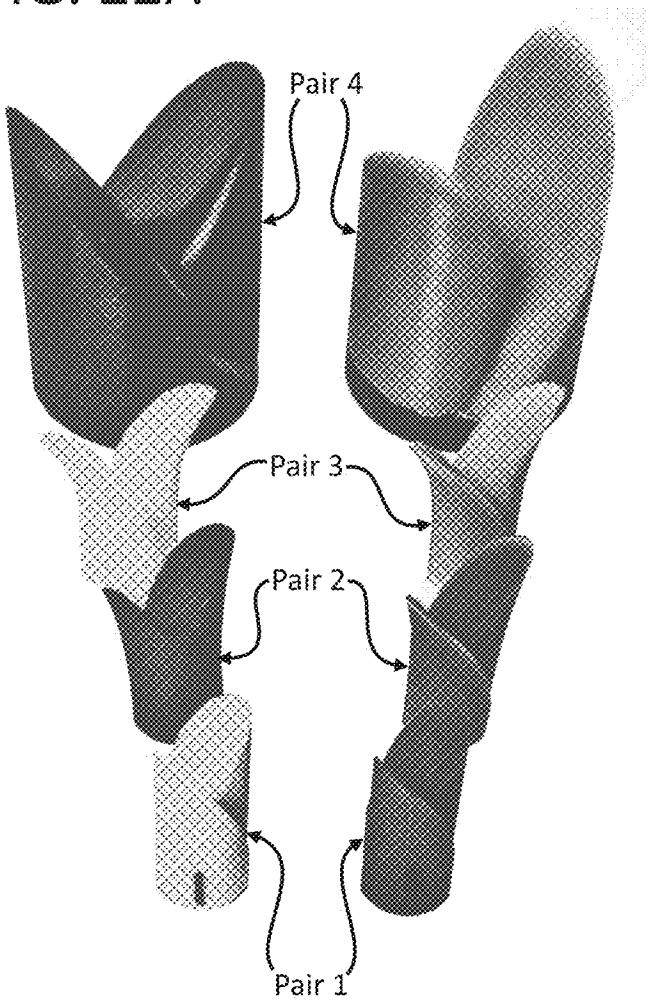
FIG. 22A shows embodiments of Eddy Propulsors made of rigid plastics and of rubbers having different stiffnesses.

Eddy Propulsors can be made from a broad range of materials, unlike a propeller. A propeller is thin and so must be constructed of rigid materials to handle thrust loads. An Eddy Propulsor can be made from both rigid and softer elastomeric materials. FIG. 22A shows four pairs of two-lobed Eddy Propulsors with each pair having identical shapes, but made from rigid plastic (polylactic acid, Young's Modulus >100 MPa) on the left and softer rubber (polyurethane elastomer, Young's Modulus 2 to 4 MPa) on the right. FIG. 22B presents a graph showing the thrust generated by Pair 2. The thrusts generated by the rigid and the rubber Eddy Propulsors are nearly identical and, again, about twice the thrust generated by a propeller having the same diameter. Eddy Propulsors have been constructed from wood, brass, Delrin, nylon, ice, and several composite materials.

Figure 23A:
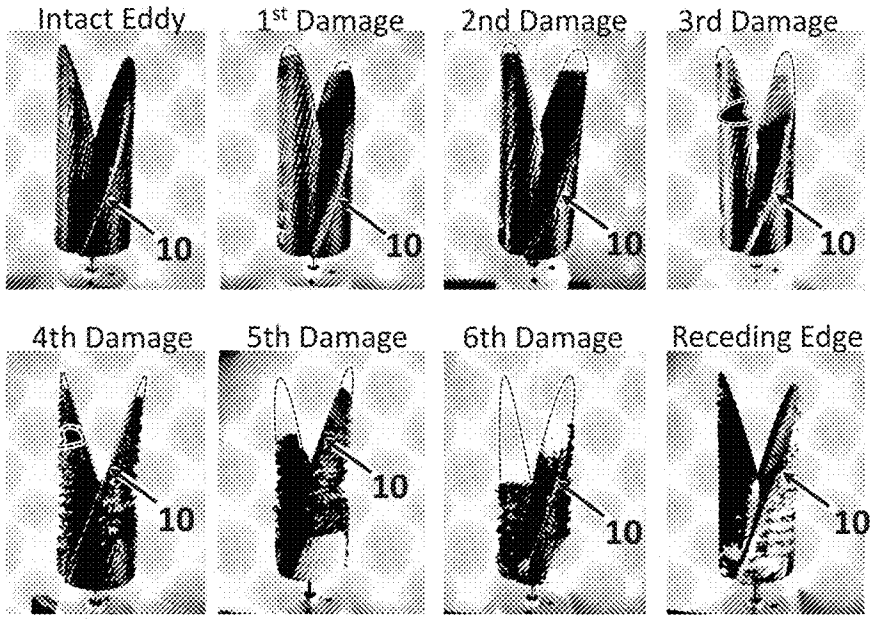
FIGS. 23A and 23B demonstrate how Eddy Propulsors continue generating thrust despite significant damage.
Figure 23B:
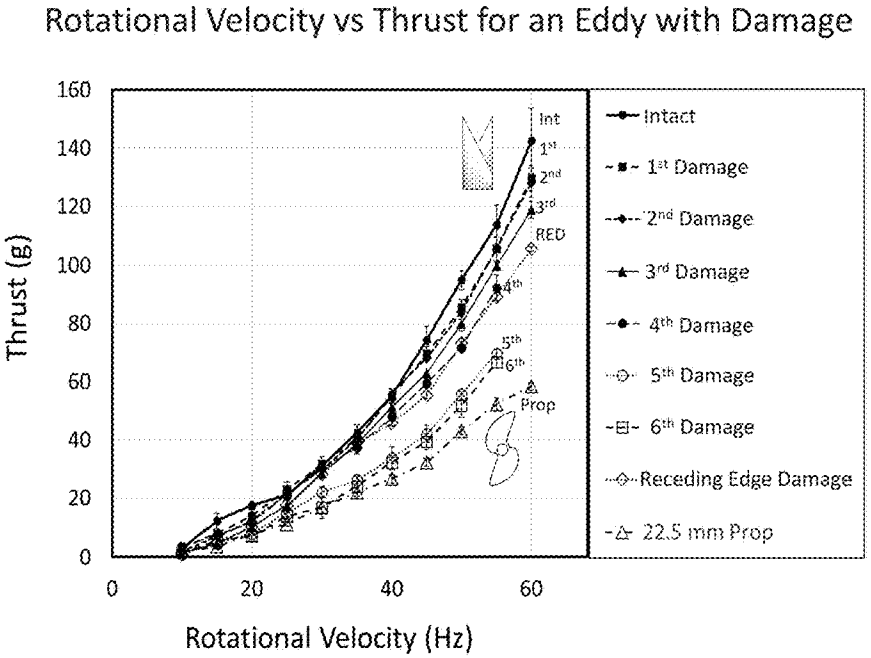

Different portions of the receding edge contribute differently to generating the bound edge vortex, with the foremost and aftmost regions contributing least in the two-lobed Eddy Propulsor shown in FIGS. 23A and 23B. In the prototypes tested, those regions in which the receding edge approaches being perpendicular to the axis of rotation A (i.e., the tangent vector T is nearly perpendicular to the axis of rotation A such that the local angle of inclination approaches 90°) contribute less to thrust. This is because the receding edge is aligned nearly parallel to the circumferential flow over the adjacent rump surface, presenting no step in the flow and, thus, generating little vorticity. This is demonstrated experimentally in FIGS. 23A and 23B in which damage to the tips (foremost regions) of the Eddy Propulsor produce only small decreases in thrust ($1^{st}$, $2^{nd}$, $3^{rd}$, and $6^{th}$ Damage). In contrast, damage to the adjacent rump surface and to the receding edge where the receding edge has a larger smaller angle of inclination (decreasing from 90°) result in larger decreases in thrust ($4^{th}$, $5^{th}$, and Trailing Edge Damage).

Thrust generation by Eddy Propulsors is resilient in the face of damage. FIG. 23A shows a series of photographs of a two-lobed Eddy Propulsor that has been subjected to repeated, cumulative damage. The graph in FIG. 23B shows the thrust generated by the damaged two-lobed Eddy Propulsor, as the two-lobed Eddy Propulsor is subjected to progressively severe damage (Intact through $6^{th}$ Damage). The final Eddy Propulsor ($6^{th}$ Damage) has completely lost one lobe and retains only a fraction of the other lobe, and its rump surface is badly scraped and scarred. Thrust declines as damage progresses, but even the most damaged Eddy Propulsor generates more thrust than an intact propeller (Prop) of equal diameter! Interestingly, another identical Eddy Propulsor ("Trailing Edge", TED) only had its adjacent rump surfaces and receding edges damaged, and this Eddy Propulsor showed a significant drop in thrust, demonstrating the importance of the adjacent rump surface and receding edge in generating thrust via a bound edge vortex, especially the portion of the receding edge and rump surface approximately mid-way (central approximately 50%) between the forward tip and the rear of the Eddy Propulsor. This can be seen as the most damaged lobe progresses from having its tip cut off ($4^{th}$ damage) to having its central ($5^{th}$ damage) because this removed the middle half of the receding edge on one lobe.

It is important to note that as an Eddy Propulsor generates thrust, the direction of flow past the receding edge becomes a combination of circumferential flow over the rump surface and aftward flow arising from the Eddy Propulsor's movement of surrounding fluid. This causes the direction of flow over the receding edge to align more parallel to the axis of rotation. The faster the flow generated by the Eddy Propulsor, the more parallel the alignment (with respect to the axis of rotation and aftward) of the resulting flow over the receding edge. Eddy Propulsors should be designed with this consideration in mind.

Figure 24B:
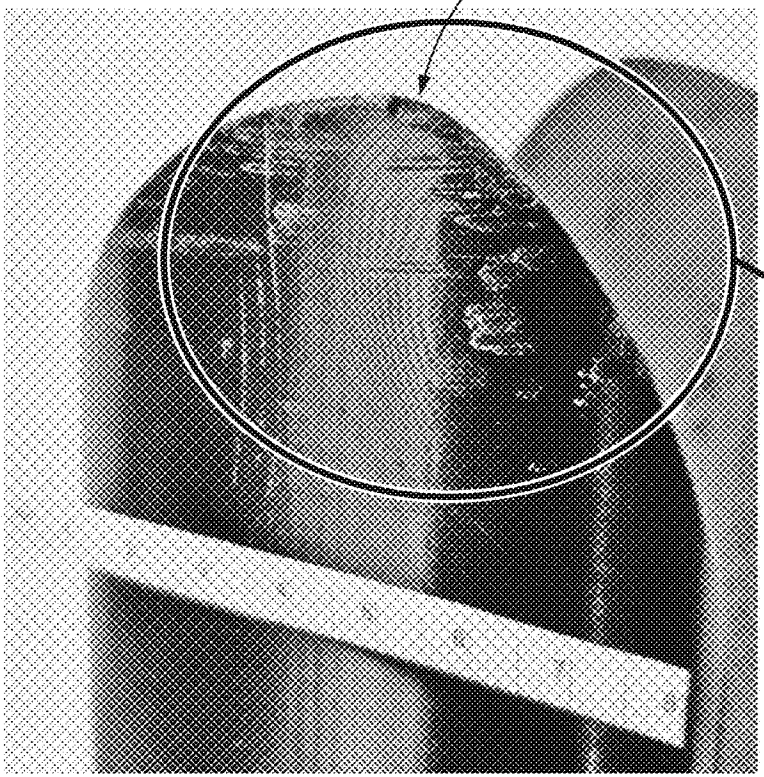
FIGS. 24A and 24B show minor tip damage on a two-lobed plastic Eddy Propulsor after collision with large rocks.
Figure 24A:
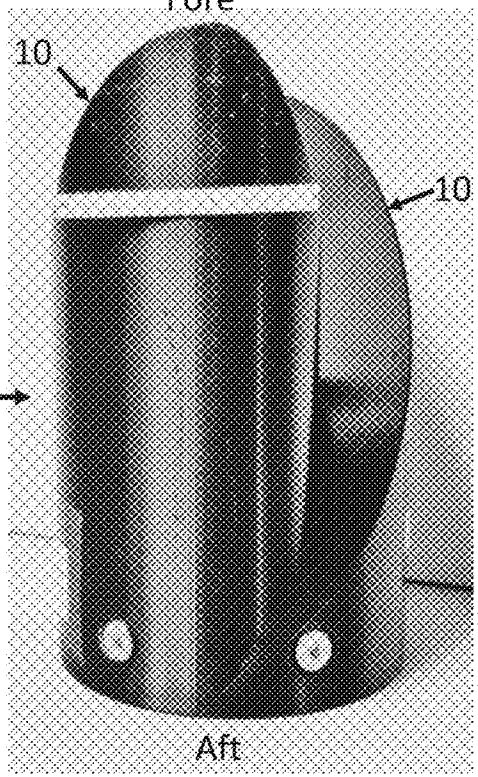

Eddy Propulsors are also resistant to damage because they are monolithic (as opposed to a propeller's thin blades) and because the Eddy Propulsor's adjacent rump surface shields the receding edge from significant damage. Furthermore, the receding edge, being the site of a reduction in the radius, is the inverse of a projecting, impactable obstacle. An Eddy Propulsor mounted to an electric trolling motor (Minn Kota 55 lb thrust) was smashed directly into large boulders (approximately 1 meter in diameter) while running the Eddy Propulsor at high speed. FIG. 24A shows one such rigid plastic two-lobed Eddy Propulsor 100 that had been run into large boulders. FIG. 24B presents a close-up of the forward end of one lobe of Eddy Propulsor 100. Damage to the Eddy Propulsor was limited to minor scuffing on the rump surface ("Damage zone", outlined region) and a small chip near the tip ("Chipped edge"). The Eddy Propulsor continued its performance unabated. A propeller would have bent or broken against the boulders, rendering the propeller useless, and disabling the vessel.

Section 3—Eddy Propulsors Configured as Pushing Propulsors

As explained in Section 1, a pushing propulsor, for example to push a boat, has a much more practical commercial market. Accordingly, Section 3, describes Eddy Propulsors in a pushing configuration more fully.

Figure 25B:
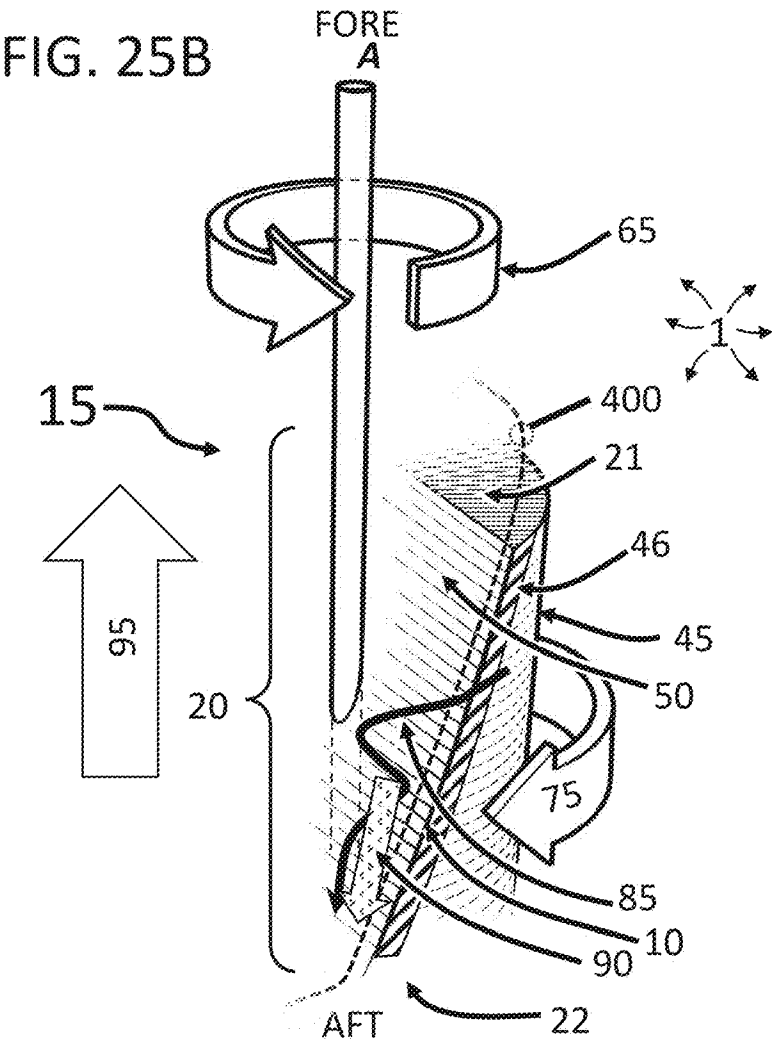
FIGS. 25A and 25B illustrate the different parameters associated with the receding edge of an Eddy Propulsor.
Figure 25A:
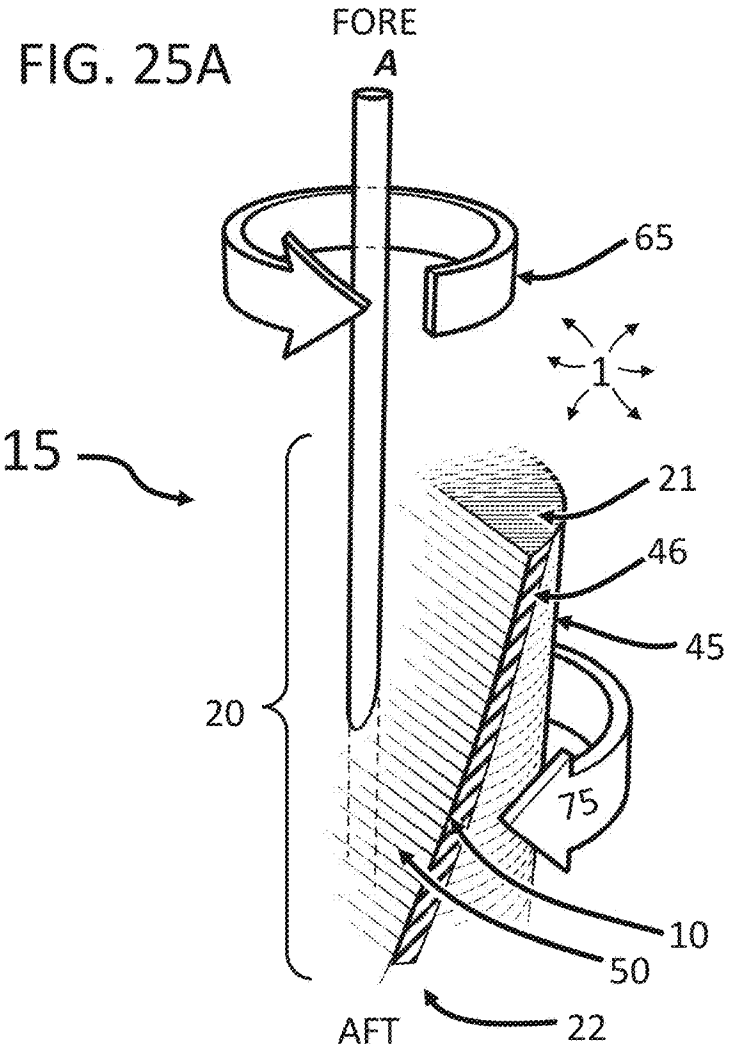

Consider FIGS. 25A and 25B that focus on the receding edge 10 and associated structures for an Eddy Propulsor 15. An Eddy Propulsor 15 is a rotating fluid propulsor at least partially immersed in a fluid 1. The body 20 of Eddy Propulsor 15 rotates about an axis of rotation A with rotational velocity 65. The body 20 of Eddy Propulsor 15 further possesses a fore end 21 and an aft end 22. The body 20 of Eddy Propulsor 15 is enclosed by at least two surfaces, at least one receding surface 50 and at least one rump surface 45. The at least one receding surface 50 is shown here as a flat plane, but the at least one receding surface 50 can have complex 3-dimensional (3D) shape, including locally convex and concave regions. The at least one rump surface 45 bounds the remainder of the body 20 of Eddy Propulsor 15. The at least one rump surface 45 and the face 40 of an Eddy Propulsor can also have a complex 3D shape. The at least one receding surface 50 and the at least one rump surface 45 join to form an at least one receding edge 10. We further define a portion of the rump surface 45, as the adjacent rump surface 46 that borders the receding edge 10 and extends over the rump surface.

FIG. 25B shows the motion of fluid 1 relative to the Eddy Propulsor 15. Over the rump surface 45, there is a substantially circumferential counter-flow 75 that has an opposite rotational sense to the rotational velocity 65. As the fluid 1 flows past the adjacent rump surface 46 and over the receding edge 10, the circumferential counter-flow 75 enters a region of low-pressure 400 created by recession of the receding surface 50 (note: this is the same as low pressure region 175 described in FIG. 8B), and the fluid forms a bound edge vortex 85 that is bound to the receding surface 50 as Eddy Propulsor 15 rotates. Note that like the circumferential counter-flow 75, the bound edge vortex 85 rotates with opposite rotational sense to the rotational velocity 65. Owing to the inclination of the receding edge 10 relative to the circumferential counter-flow 75, fluid motion in the bound edge vortex 85 has a significant axial component 90 directed aft. This aft axial flow 90 of fluid generates forward thrust 95 on the body 20 of Eddy Propulsor 15.

Figure 26B:
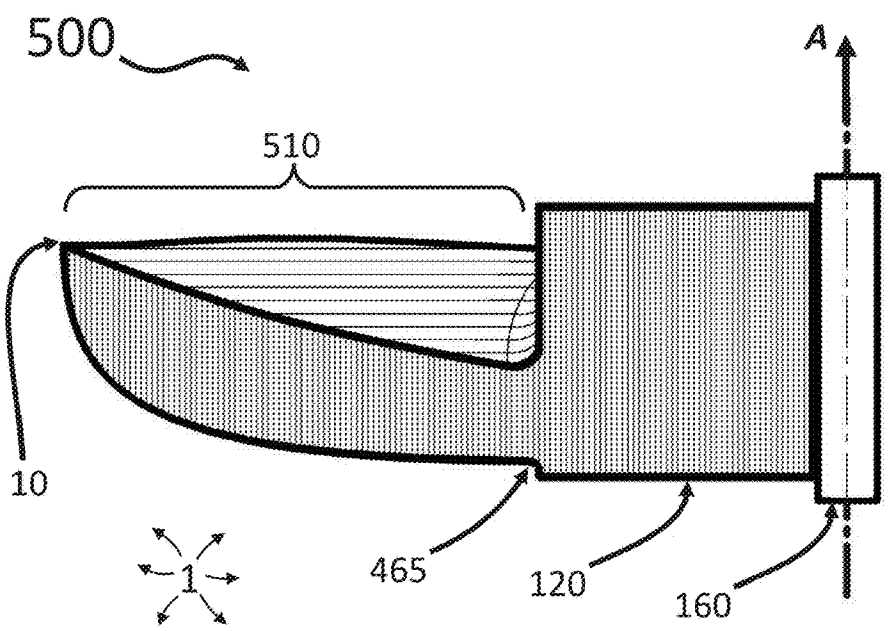
FIG. 26A (Prior art) and 26B illustrate how an Eddy Propulsor is much thicker in cross-section than a conventional propeller.
Figure 26A:
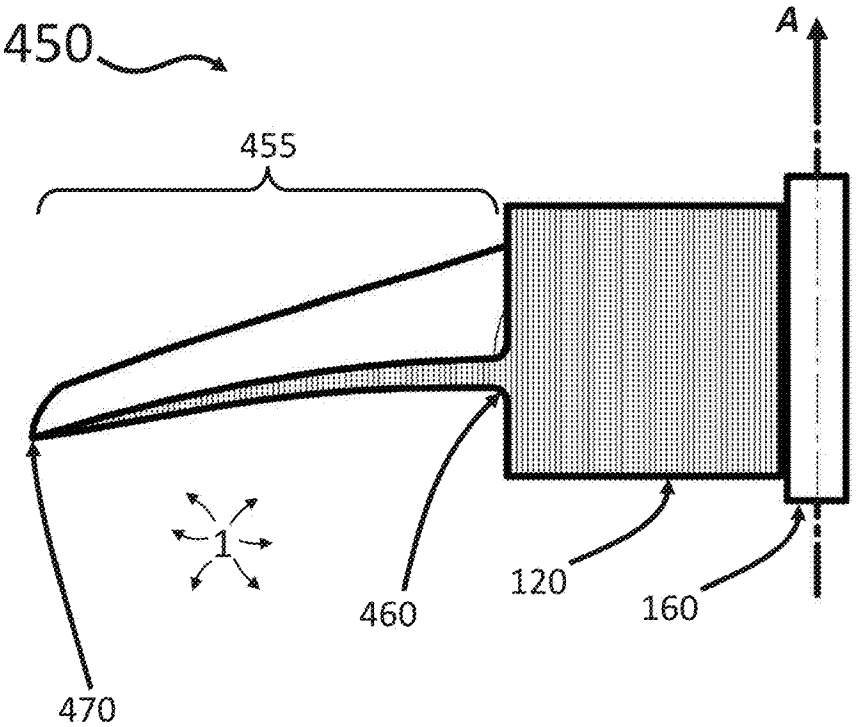
FIG. 26A (Prior Art)
Figure 27B:
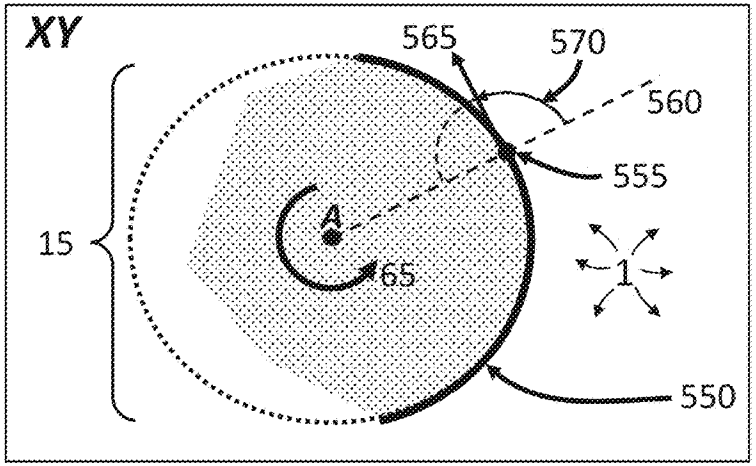
FIGS. 27A through 27C illustrate the local angle of inclination along the receding edge of an Eddy Propulsor.

As discussed above (FIGS. 16 through 19B) the receding edge angle 315 and the axial $T_A$ and transverse $T_T$ thicknesses describe the receding edge 10 of an Eddy Propulsor 15. The values given earlier yield transverse thicknesses and axial thicknesses that are many times those for the blade of a conventional propeller, making the lobes of an Eddy Propulsor appear thick, blocky, and substantial relative to the blade of a propeller. Conversely, a propeller looks fragile and dangerous with thin, slicing blades while an Eddy Propulsor 15 looks thick and substantial with no slicing edges, as shown later in this specification. FIGS. 26A and 26B show cross sections through a conventional propeller 450 (FIG. 26A) and a pushing Eddy Propulsor 500 (FIG. 26B). Common to both are a drive shaft 160 and a hub 120. The blade 455 of the propeller 450 is thicker at its base 460 and thins out to its tip 470. In fact, it is common practice to sharpen the blade tips and other edges of propellers in an attempt to reduce drag and improve the performance of the propeller. Conversely, the lobe 510 of this embodiment Eddy Propulsor 500 is much thicker at its base 465 and along the entire lobe out to the receding edge 10 (about 5.5 times thicker on average). This makes the lobe 510 vastly stiffer in bending than the blade 455 of the propeller owing to the large increase in the second moment of area of the lobe. the flexural stiffness, K, of a cantilevered beam (like a propeller blade 455 or the lobe 510 of an Eddy 500) is proportional to E*I, where E is the Young's modulus of the material of which the beam is made and where I is the second moment of area of the beam. The second moment of area of a beam is proportional to the fourth power of the thickness of the beam. This means that the flexural stiffness K of the lobe 510 of the Eddy 500 shown in FIG. 27B is over 900 times stiffer that the propeller blade 455 shown in FIG. 27A. This means that materials with much lower Young's Modulus, allowing an Eddy to be as stiff when made of plastic as a propeller made of stainless steel. This has tremendous advantages for cost of materials and cost of manufacture. Furthermore, plastics (for example polyurethane, ABS, nylon, polycarbonate, or similar polymer or elastomeric material) confer advantages unobtainable with metals. One is that an Eddy stiff enough to propel a large boat can simultaneously be elastically deformable enough to flex and rebound upon impacts by that would otherwise permanently deform or break a metal propeller. An unbreakable Eddy could be manufactured out of a highly flexible, resilient polymer capable of elastic recoil from strains greater than 25%. Polymers exhibiting greater values of fully recoverable elastic strain, for example 100% strain, or even 500% strain, could be combined with Eddy lobe thicknesses substantially equal to the radial extent of the lobe from the hub (thus creating very large values for the second moment of area) to permit an Eddy to be both compliant enough to be indestructible and yet stiff enough to propel a vessel. Another advantage of Eddy's shape combined with polymeric materials is that an Eddy could be manufactured out of clear material (for example a clear polycarbonate) with a refractive index substantially similar to that of water, making such an Eddy effectively invisible to fish, or visually difficult or impossible to detect by an enemy. Yet another advantage of a clear Eddy is that the Eddy can possess at least one internal light source, for example Light-Emitting Diodes (LED), that could be cast in place when the Eddy is molded or instead later fit into internally molded cavities. The LED could be internally powered or externally powered. The light source might be activated cyclically to serve as a safety marker when the Eddy is spinning, or the light source can be used to attract fish, or the light source could be continuously illuminated for use as an area light source at night. Still another use is anti-fouling: if the LED incorporated into the Eddy emits ultraviolet light, then the Eddy could be illuminated to discourage or kill organisms that would otherwise settle upon, encrust, and foul the surface of the Eddy propulsor, reducing efficiency.

The shapes of Eddy Propulsors can be quite complex, so further definition of the receding edge 10 is warranted.

Figure 27C:
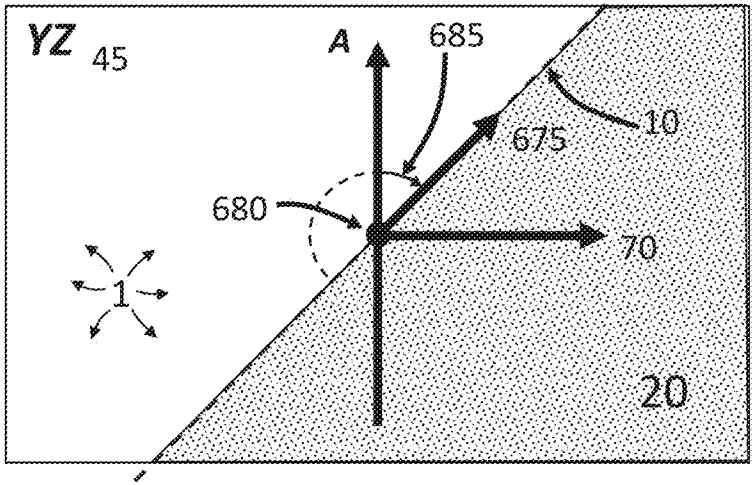
Figure 27A:
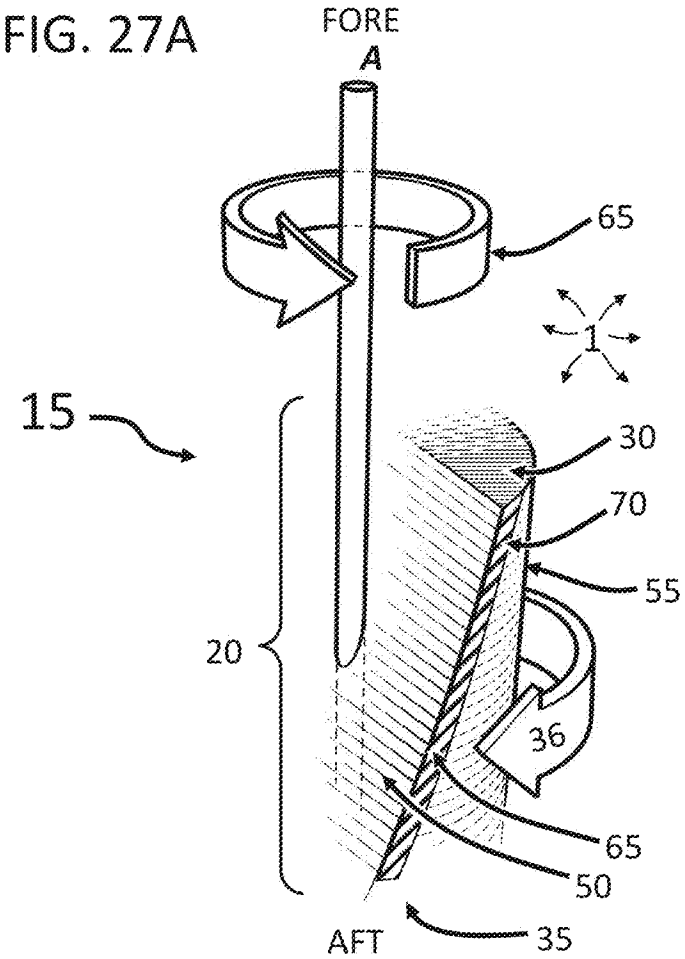

FIGS. 27A and 27B further define the shape of the receding edge 10 of Eddy Propulsor 15. FIG. 27A is a repeat of FIG. 25A, for convenient reference. FIG. 27B shows a plan projection of the body 20 of Eddy Propulsor 15 onto a transverse plane XY, with a plan view or projection 550 of the receding edge 10. At a given point 555 on the plan projection 550 of the receding edge 10, a radial axis 560 extends from the axis of rotation A through point 555, and there is a plan projection 565 of the tangent vector T to the receding edge 10. A "transverse edge angle" 170 is the angle formed by the radial axis 160 and the plan projection 165 of the tangent T. Note that if the plan projection of the receding edge is a circle, as in this example, the transverse edge angle 570 is 90° at all points on this plan projection; however, for more complex shapes, the transverse edge 570 angle can vary. In a first exemplary aspect, the receding edge has a transverse edge angle 170 in the range of 62° and 139°, inclusive. In a more specific aspect, the transverse edge angle 170 can range from 45° to 135°, inclusive. In a still more specific aspect, the transverse edge angle 170 can range from 60° to 120°, inclusive.

FIG. 27C further defines the shape of the receding edge 10 of Eddy Propulsor 15 by examining the plan projection 675 of the tangent vector T onto a YZ-plane. Here, the axis of the rotational velocity A, the plan projection 675 of the tangent T at a point 680 on the receding edge 10, and the direction of rotational motion 70 of that point 675 creates a local angle of inclination 685 formed by the axis of rotational velocity A and the tangent vector T when sweeping in the direction rotational motion 70. In a first exemplary aspect, the local angle of inclination 685 is within the range 2° to 112°, inclusive. In a more specific exemplary aspect, the local angle of inclination 685 is within the range 15° to 105°, inclusive. In an even more specific exemplary aspect, the local angle of inclination 685 is within the range 30° to 95°, inclusive.

It is important to note that the transverse thickness $T_T$, the axial thickness $T_A$, the transverse edge angle 570, and the local angle of inclination 685 are defined locally at point P, and point P is any point on the edge formed by the junction of the face and the rump surface of an Eddy Propulsor which might have complex shape. Thus, these parameters (the transverse thickness $T_T$, the axial thickness $T_A$, the transverse edge angle 570, and the local angle of inclination 685) can change along this edge. Any portion of the edge formed by the junction of the face and the rump surface of an Eddy Propulsor, which can be complex in shape, can perform as a receding edge if it recedes and if it has appropriate ranges for the transverse thickness $T_T$, the axial thickness $T_A$, the transverse edge angle 570, and the local angle of inclination 685.

Figure 28:
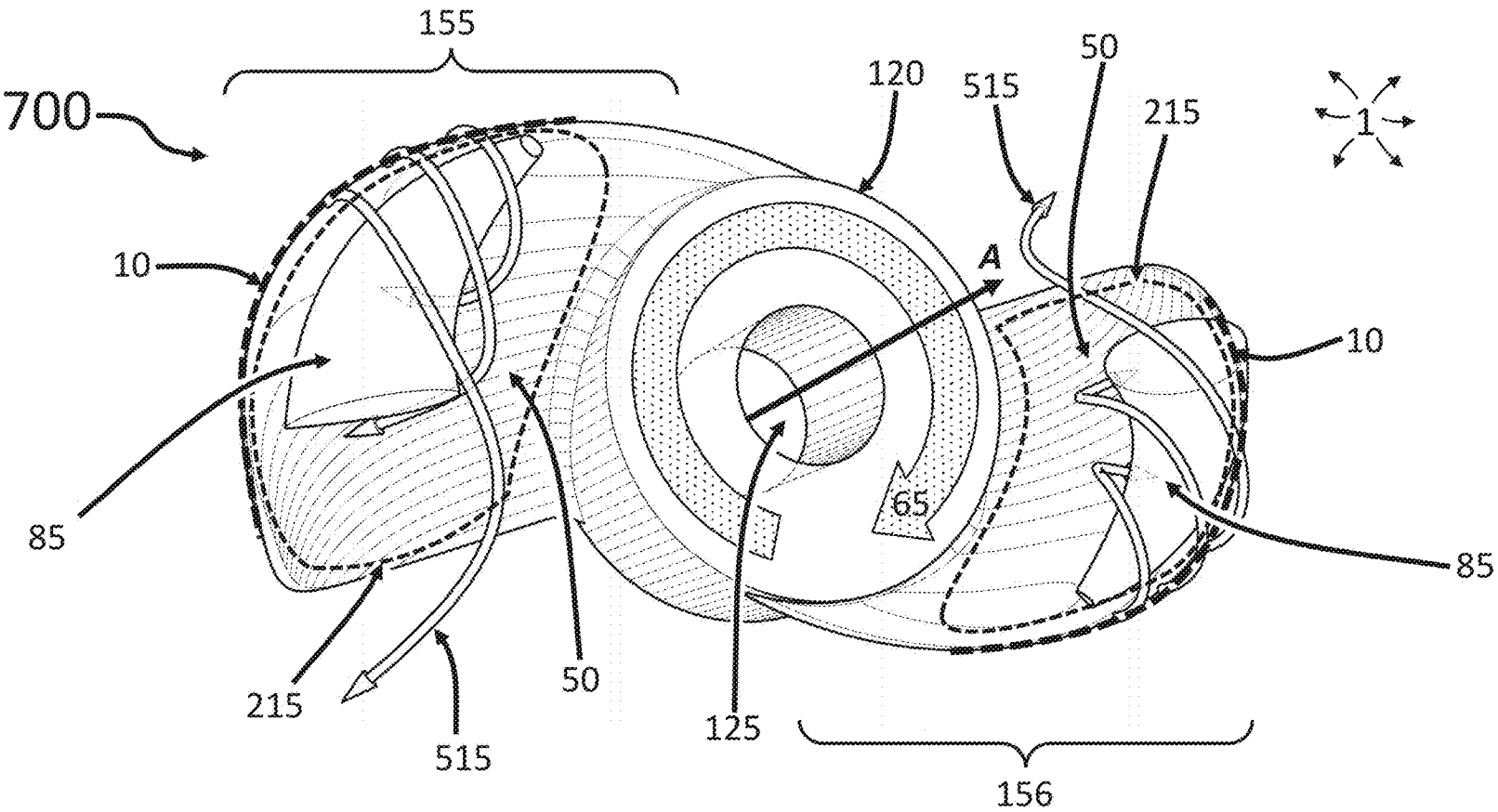
FIG. 28 shows a two-lobed Eddy Propulsor showing the extent of the region of low pressure and the bound edge vortex on the receding surface of each lobe.

FIG. 28 illustrates an Eddy Propulsor 700 designed for pushing. Immersed in fluid 1, the Eddy Propulsor 700 has a central hub 120 with a bore 125 for accepting a drive shaft. The Eddy Propulsor 700 has rotational velocity 65 around the axis of rotation A. There is a first lobe 155 extending to the left from the hub and a second hub 156 extending to the right. The receding surfaces 50 are visible from this perspective. The rump surfaces are on the far side of the Eddy Propulsor 700 and thus are not visible. Each lobe 155 and 156 has a receding edge 10 extending along the forward and outer reaches of the lobes 155 and 156. As Eddy Propulsor 700 rotates, a region of low pressure 215 forms over each receding surface 50 and fluid flows over the receding edges 10 with little or no radial component. The fluid streamlines 515 bend toward the region of low pressure 215 and roll up, forming a bound edge vortex 85 having a substantial aft-directed axial component of fluid flow that generates forward thrust on the body 20 of the Eddy Propulsor 700.

Figure 29A:
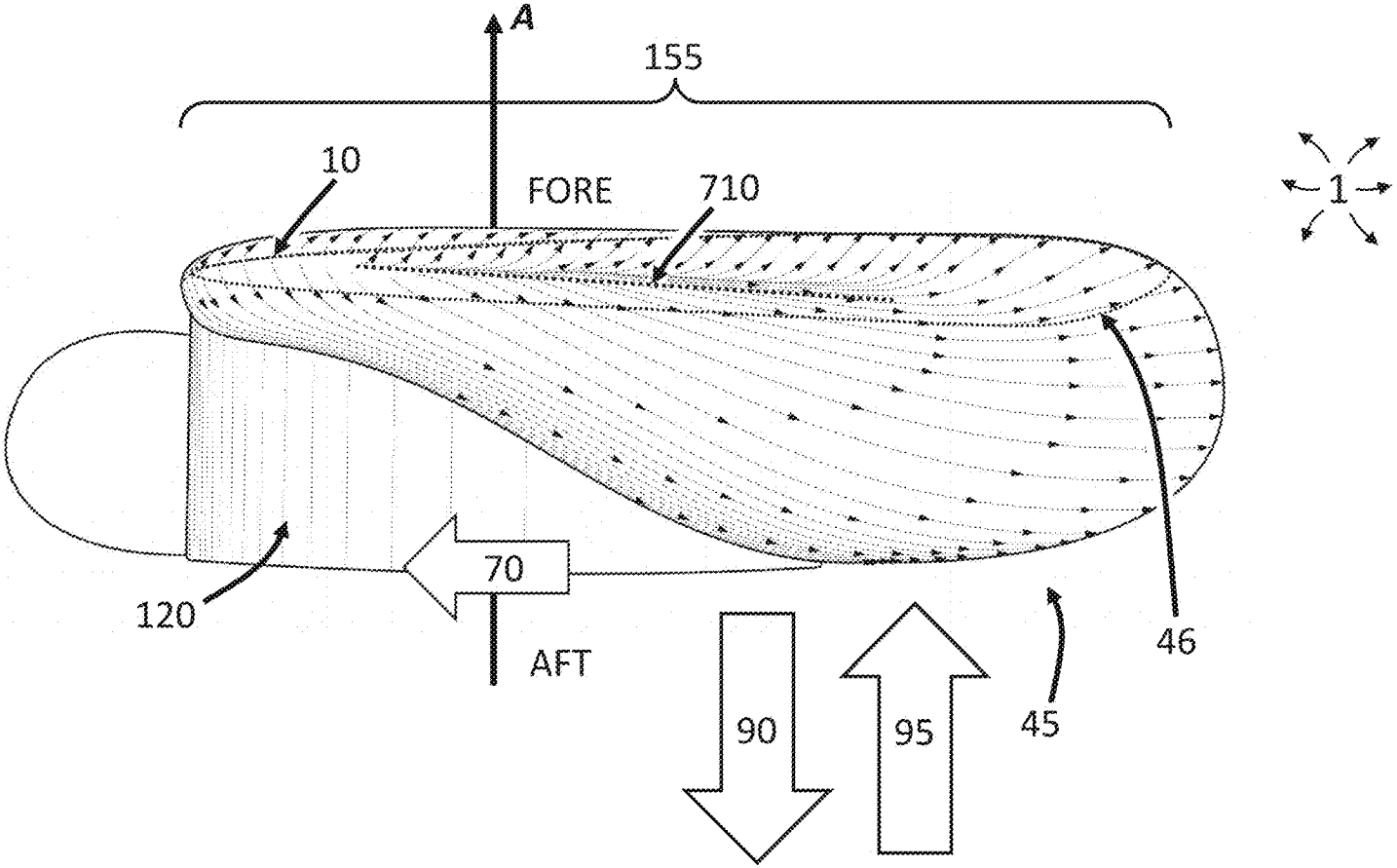
FIGS. 29A through 29D show the shape of streaklines on the surface of an Eddy Propulsor that was run in water and revealing a divergence of flow on the adjacent rump surface.

FIG. 29A presents the results of an experiment to visualize the directions of movement of fluid 1 over Eddy Propulsor 700. The Eddy Propulsor 700 was attached to a Minn Kota trolling motor. The base color of the Eddy Propulsor 700 was white, and the Eddy Propulsor 700 was rapidly sprayed with black lacquer paint which is water insoluble. Immediately after spraying and long before the paint could dry, the Eddy Propulsor 700 was immersed in water and the motor turned on high speed for approximately 10 seconds. The Eddy Propulsor 700 was then removed from the water and allowed to dry. The result is a black-and-white pattern of streaks formed by the water's flow over the surface of the Eddy Propulsor 700. Here, those streaks appear as arrows over the surface of Eddy Propulsor 700, which is presented in side view (from the distal end of one lobe 155 toward the hub 120), and only the rump surface 45 of lobe 155 is visible. Several features can be observed from this test: the fluid over most of the rump surface is left-to-right in this image, opposite the direction of rotational motion 70. Further, the fluid diverges over the adjacent rump surface 46. There is a visible divergence 710 with the fluid flow aft of divergence 710 having a pronounced aft-directed component and the fluid flow forward of the divergence 710 having a pronounced forward-directed component. Note, especially that the flow foreword of the divergence 710 moves forward which is opposite the direction of net flow 90 generated by Eddy 700! This pattern is evidence for the presence of the bound edge vortex.

Figure 29B:
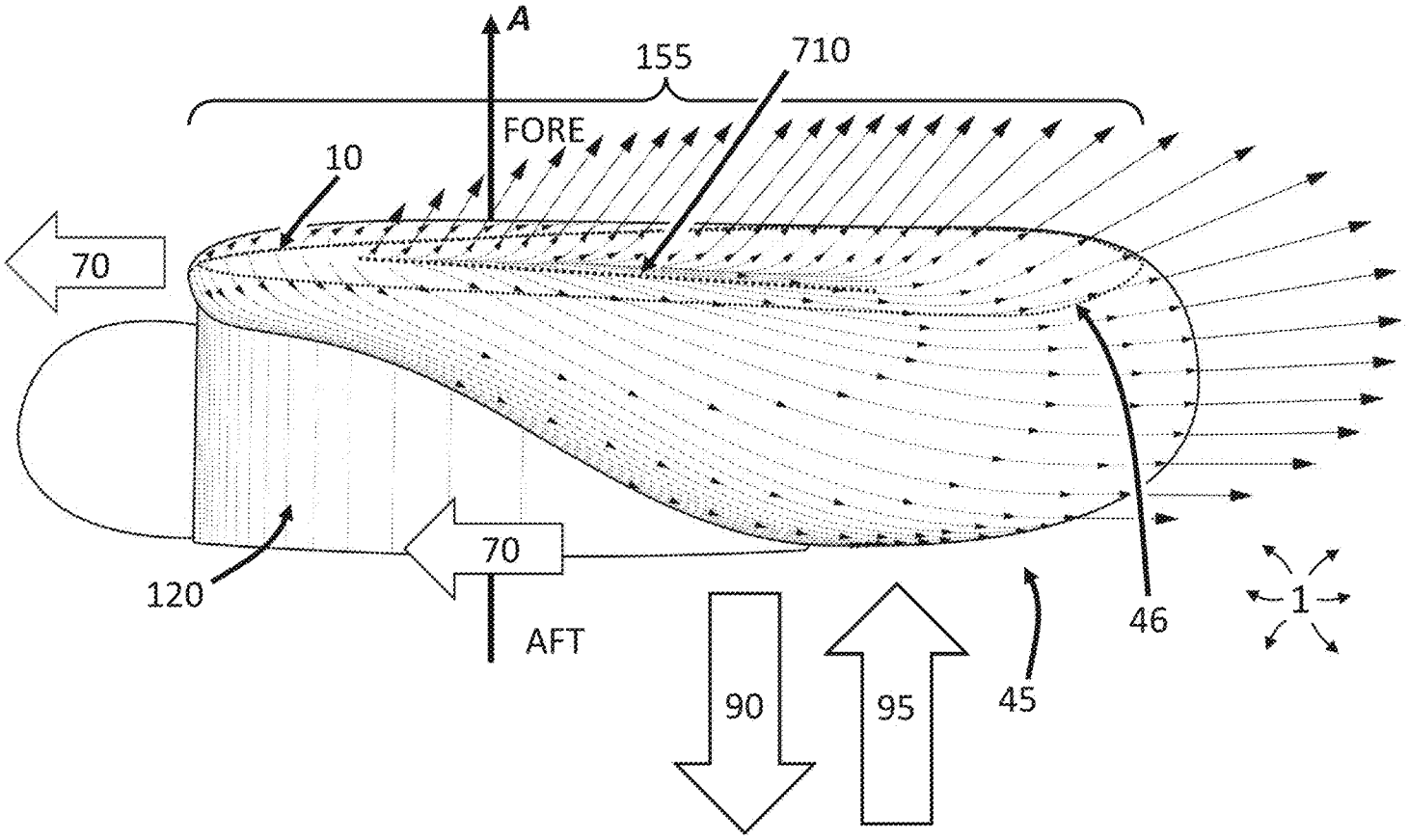

FIG. 29B extends the flow lines outward from the streaklines traced in FIG. 30A.

Figure 29C:
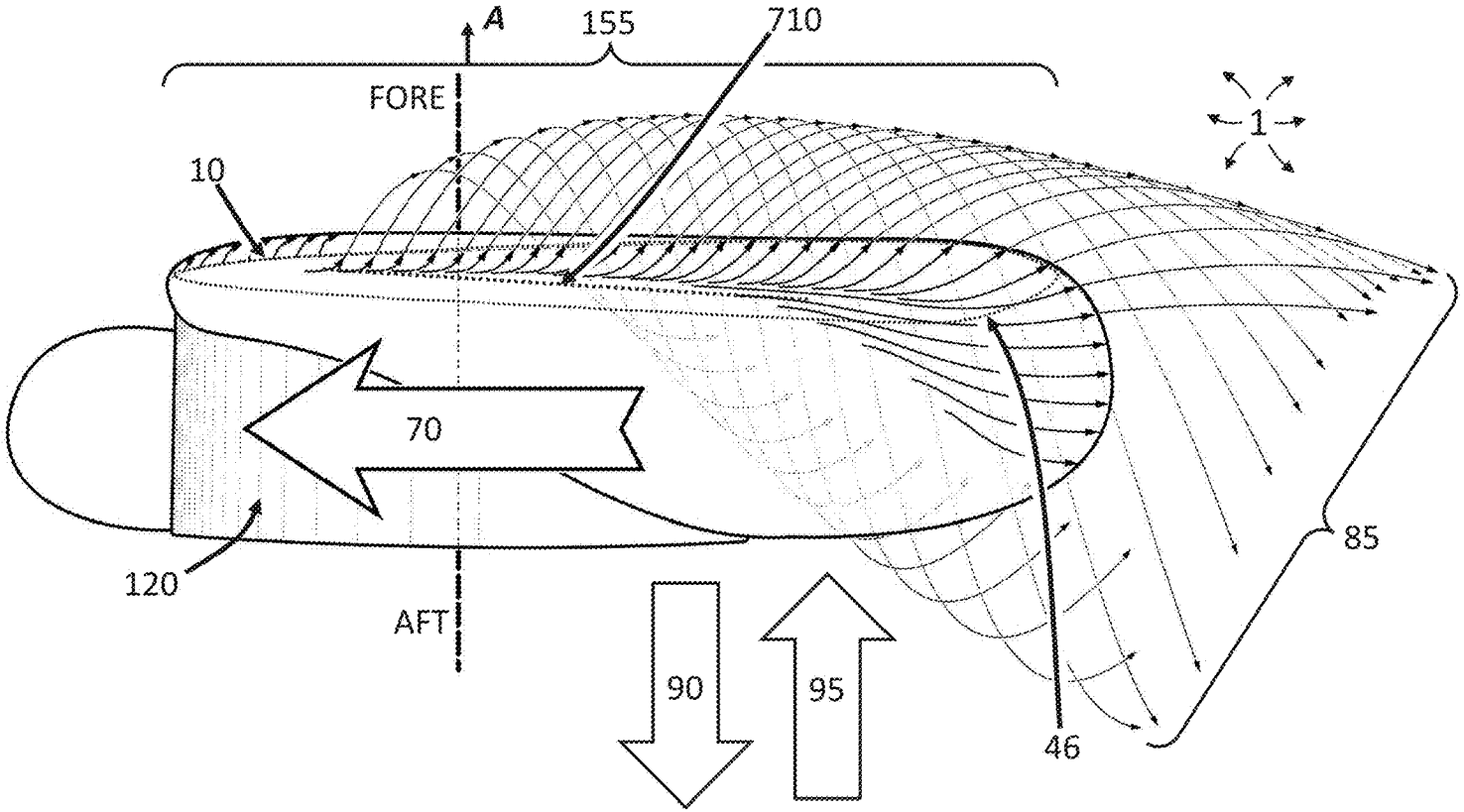

FIG. 29C extends the flow lines further to illustrate how they are bent into the page, and over the low pressure region on the receding face of the Eddy Propulsor 700 to form the bound edge vortex 85.

Figure 29D:
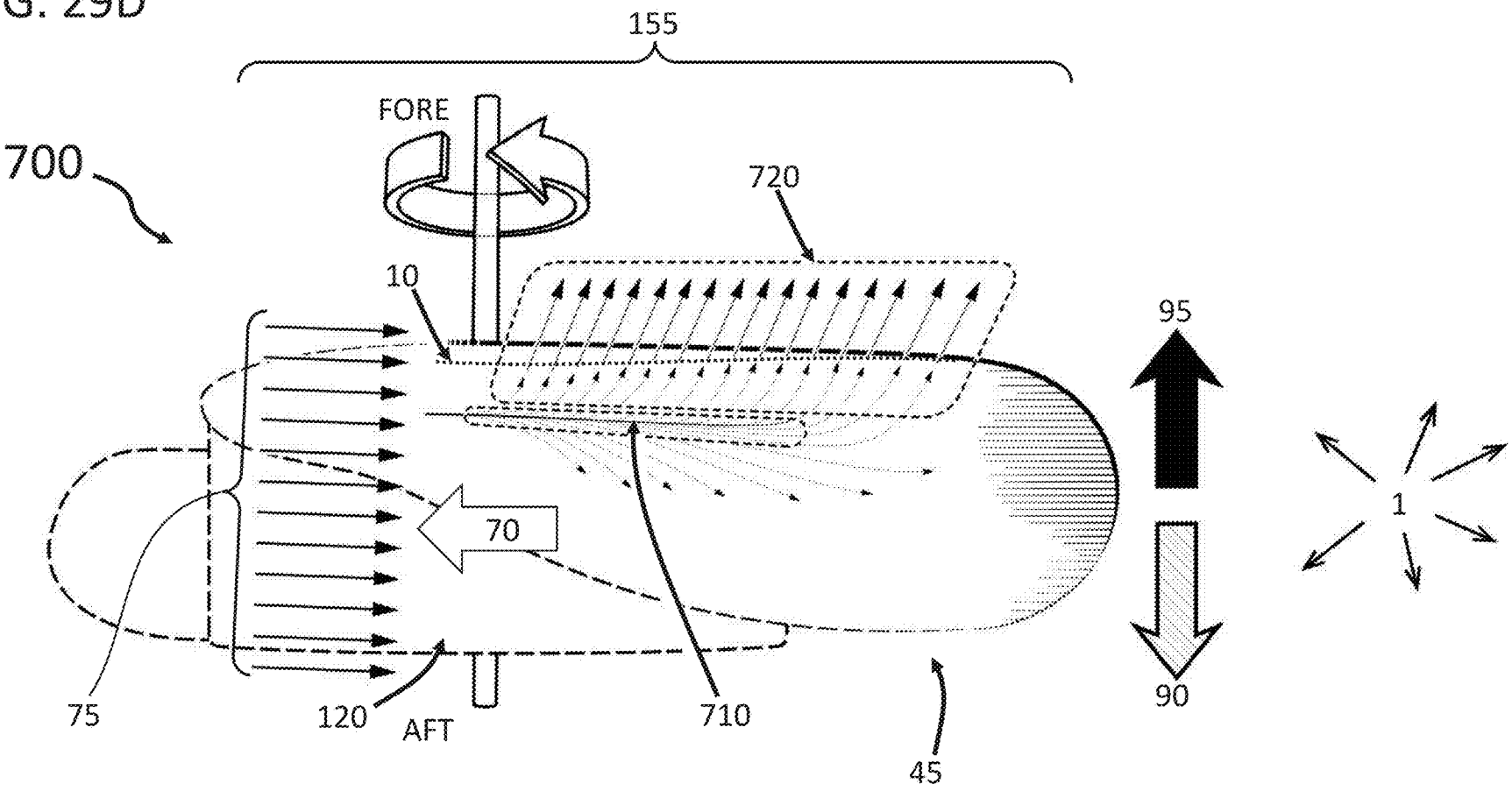

FIG. 29D diagrams some of the features of the flow shown in FIGS. 29A to 29C: the direction of rotational motion 70 (right-to-left) of the lobe 155, the direction of counter-flow 75 (left-to-right), the line of divergence 710 with a region of forward-directed flow 720 forward of the line of divergence 710 with the rest of the flow over the lobe being aft-directed, the direction of forward thrust 95 and the direction of net fluid flow 90 driven by rotation of Eddy Propulsor 700.

Figure 30:
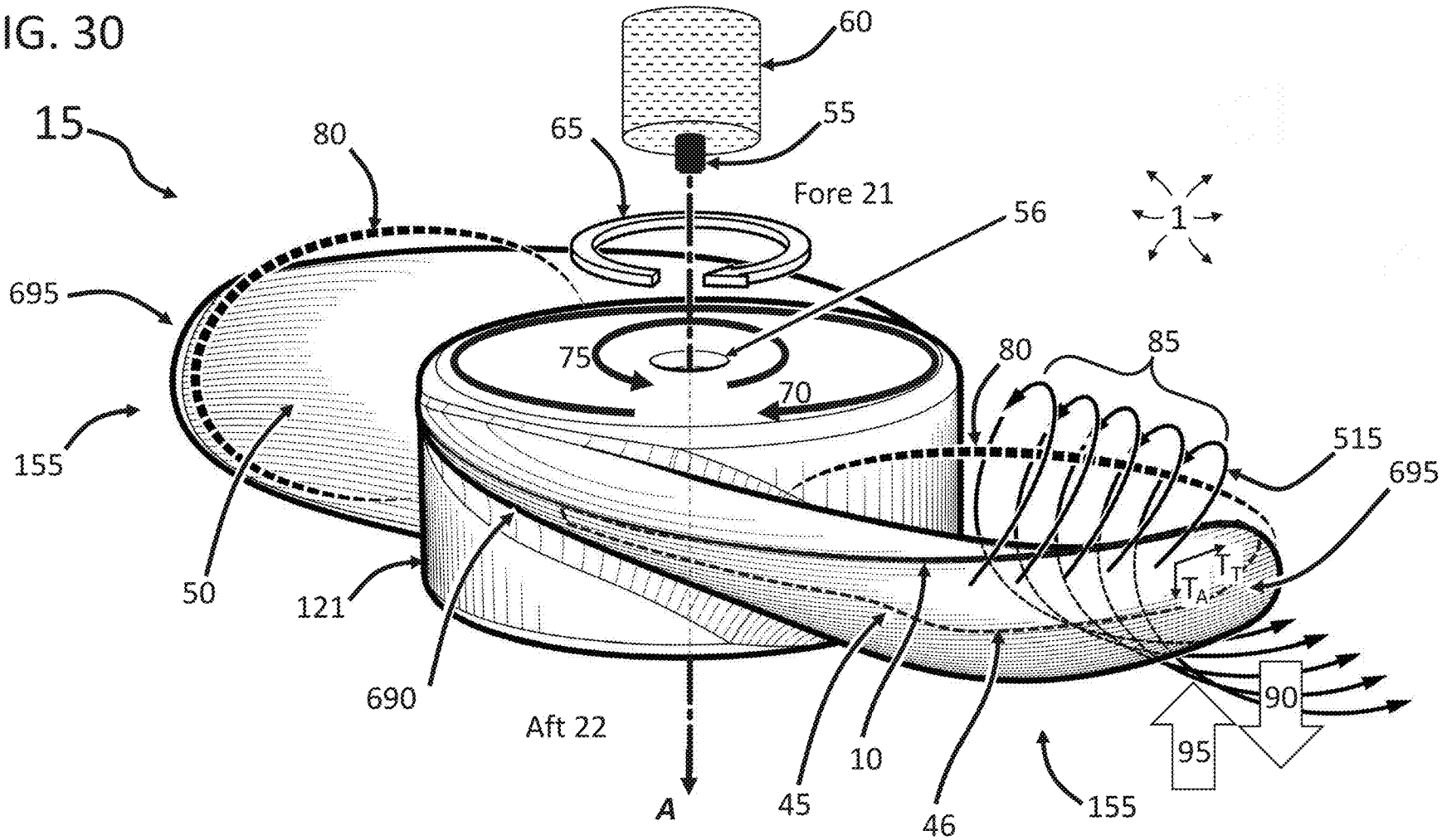
FIG. 30 presents a two-lobed Eddy Propulsor with prominent features identified.

It is evident from FIGS. 1C, 9A and 9B, and provided for clarity in FIG. 30, that an Eddy Propulsor 15 is a device for inducing fluid flow relative to itself, comprising a body 20 configured to be brought into contact with fluid 1. The body 20 possesses a fore end 21, an aft end 22, and an axis of rotation A about which the body 20 is configured to rotate. The body 20 further comprises a central structure 121, such as a hub, possessing torque acceptance means 56 configured to accept and convey a torque from a torque generator 60 to the body 20, and where the torque so conveyed manifests as a rotational velocity 65 of the body 20 about the axis of rotation A and driving every point on the surface of body 20 with a rotational motion 70 in a plane perpendicular to the axis of rotation A. The body 20 of Eddy Propulsor 15 further comprises at least one monolithic cantilevered lobe 155 extending radially away from the axis of rotation A, the lobe 155 possessing one proximal end 690 affixed to the central structure 121, and a distal end 695. The lobe 155 further possesses a receding surface 50 substantially inclined with respect to the axis of rotation A such that the receding surface 50 recedes away from the fluid 1 as the body 20 rotates, and a rump surface 45 that encloses substantially the rest of the lobe. Where the receding surface 50 and the rump surface 45 intersect, that intersection defines a receding edge 10, and further, receding edge 10 is bordered by an adjacent rump surface 46 that from every point on the receding edge 10 extends axially aft along the rump surface 45 from the receding edge 10 at least an axial thickness $T_A$, and from every point on the receding edge 10 extends around the rump surface 45 from the receding edge 10 in the direction of rotational motion at least a transverse thickness $T_T$. Further, provided a fluid 1 in contact with the body 20, the rotational velocity 65 of the body 20 about axis of rotation A results in a counter-flow 75 over the body 20 of the Eddy Propulsor 15, and the adjacent rump surface 46 is so configured such that counter-flow 75 over the adjacent rump surface 46 has substantially no radial component, and has a component in the direction opposite the direction of rotational motion, so that the counter-flow 75 flows past the receding edge 10 at an angle having little or no radial component and with a non-zero component in the direction opposite the rotational motion 70. Thus, where the receding surface 50, being pulled away from the fluid 1 by the rotational velocity 65 induces a low-pressure region 80 directly over the receding surface 50 such that the low-pressure region 80 travels with the receding surface 50 as the body 20 rotates with respect to the fluid 1. Further, where the low-pressure region 80, being directly adjacent to that portion of the counter-flow 75 flowing past receding edge 10, thus generates a bound edge vortex 85 over a substantial portion of the receding surface 50, where the bound edge vortex 85 rotates substantially in the opposite direction as the rotational velocity 65, and where the bound edge vortex 85 further reduces the fluid pressure over the receding surface 50, and the inclination of the receding surface 50 relative to the axis of rotation A causes the bound edge vortex 85 to have a substantial aft-directed axial component 90 of fluid flow that generates forward thrust 95 on the body 20 of the device.

Eddy Propulsors can be additively combined with other mechanisms of generating thrust. For example, it is possible to modify the proximal end of an Eddy lobe into a more traditional lifting foil to optionally enhance thrust there. Provided that the Eddy thrust effect described in this specification remains operant, combining other fluid thrust-generating mechanisms with an Eddy propulsor might increase the magnitude of the low-pressure region over the receding face of the Eddy, and so might increase the magnitude of the thrust generated by the bound-edge vortex.

Figure 31A:
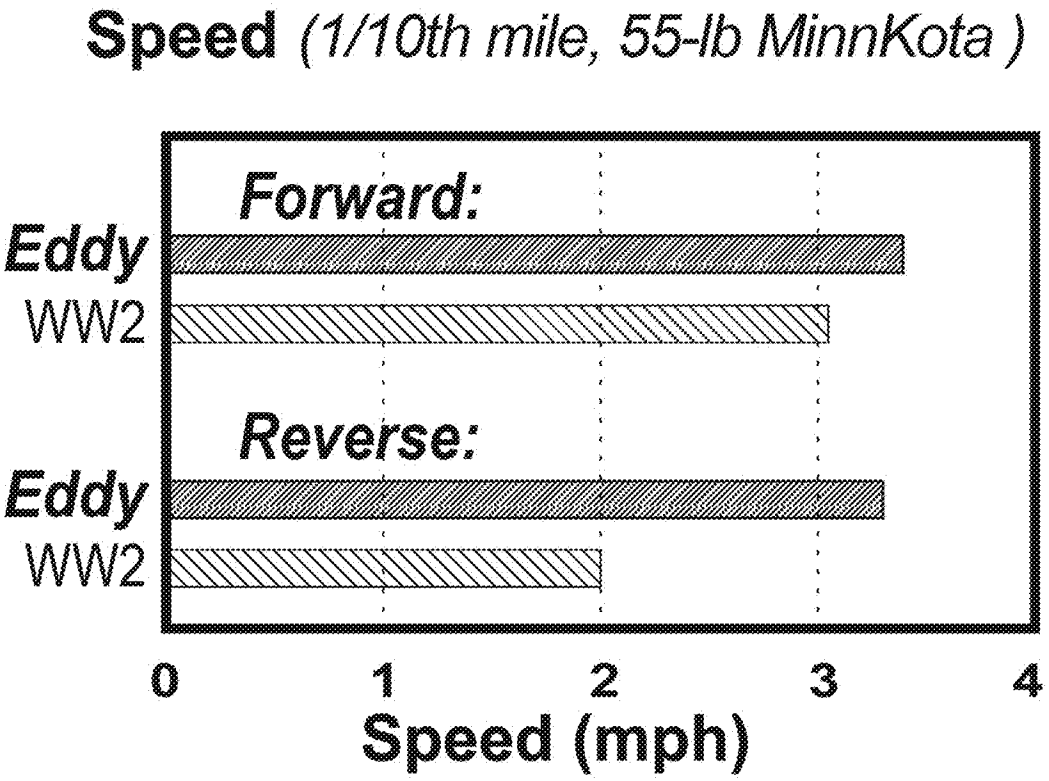
FIG. 31A shows the results of speed tests comparing an Eddy Propulsor and a commercially available propeller on a trolling motor.

FIG. 31A presents the results of real-world trials comparing an Eddy Propulsor. For these trials, the performance of an Eddy Propulsor is compared against a trolling prop, the Minn Kota Weedless Wedge 2 (WW2) on a Minn Kota Endura 55 trolling motor. The boat and loading of the boat was identical for all tests. FIG. 31A shows that the Eddy Propulsor (Eddy) was faster over a $1/10^{th}$ mile course going forward. Interestingly, both propulsors were tested in reverse by simply swiveling the motor 180°. The Eddy Propulsor was much faster in reverse, covering the course nearly as quickly as forward. This near equivalence is highly unusual because most propellers are less effective in reverse, as witnessed by the much slower time for the WW2.

Figure 31B:
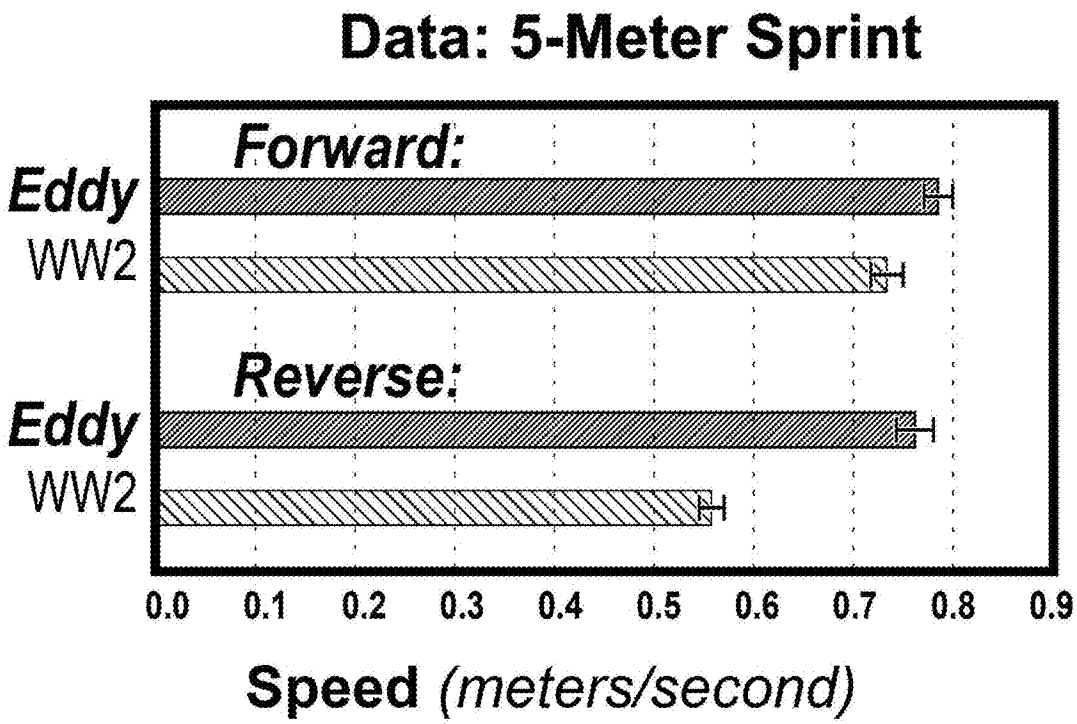
FIG. 31B shows the results of a sprint test comparing an Eddy Propulsor and a commercially available propeller on a trolling motor.

FIG. 31B presents the results of a trial testing acceleration by measuring speed over a short course—a "5-meter sprint". The Eddy Propulsor excelled again, with faster speed in forward and, more dramatically, in reverse.

Figure 31C:
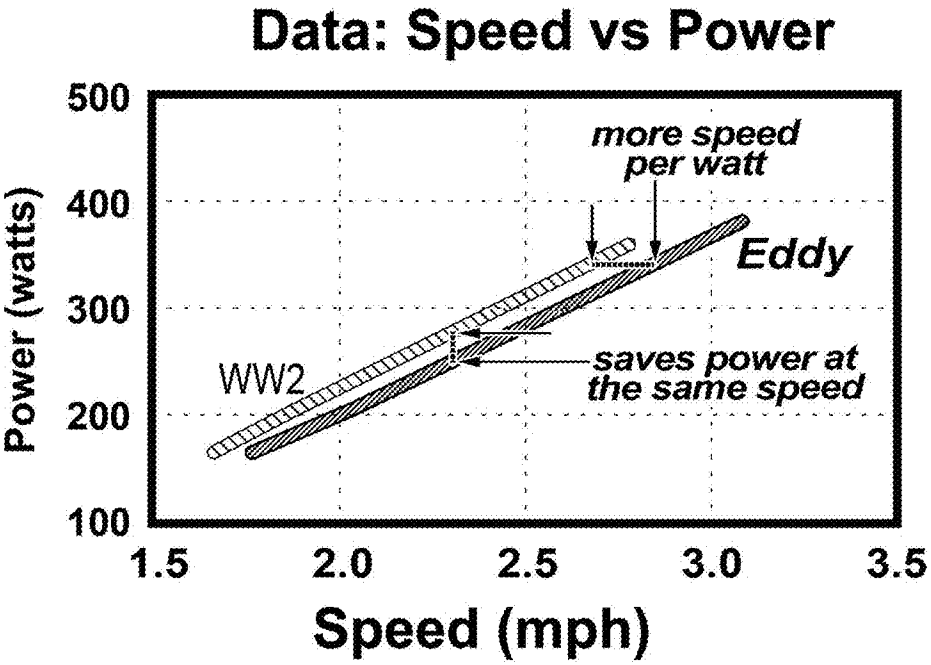
FIG. 31C compares the power consumption of an Eddy Propulsor and a commercially available propeller on a trolling motor.

FIG. 31C plots power consumption (in Watts) for both propulsors at different motor speed settings. (The Minn Kota Endura 55 has 5 fixed speed setting.) For each setting, the speed and power consumption was recorded and plotted. FIG. 31C shows that the Eddy Propulsor was also more efficient, achieving a speed at lower power consumption for all speeds (or as another way to look at it, achieving higher speeds for the same power consumption.)

Section 4—Other Aspects and Applications of Eddy Propulsors

Figure 32B:
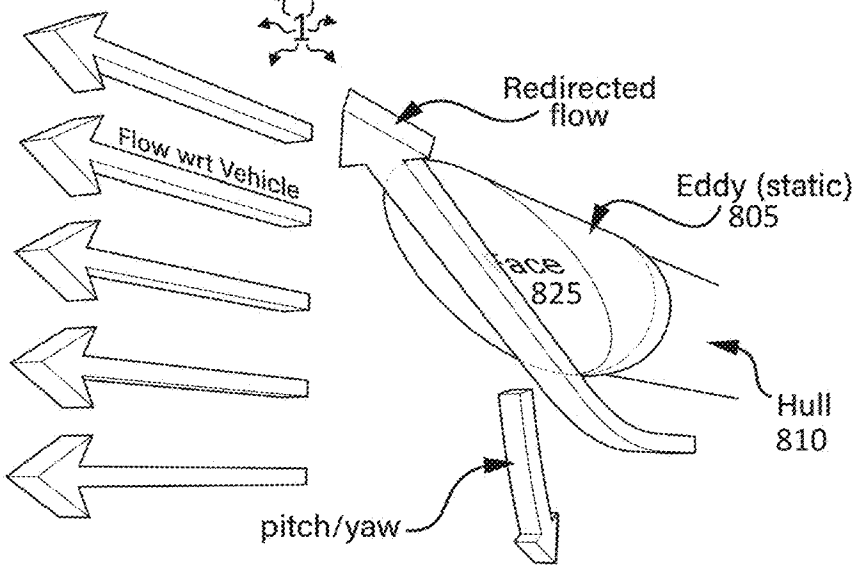
FIG. 32A and FIG. 32B show two means for static steering of a craft with Eddy Propulsors.
Figure 32A:
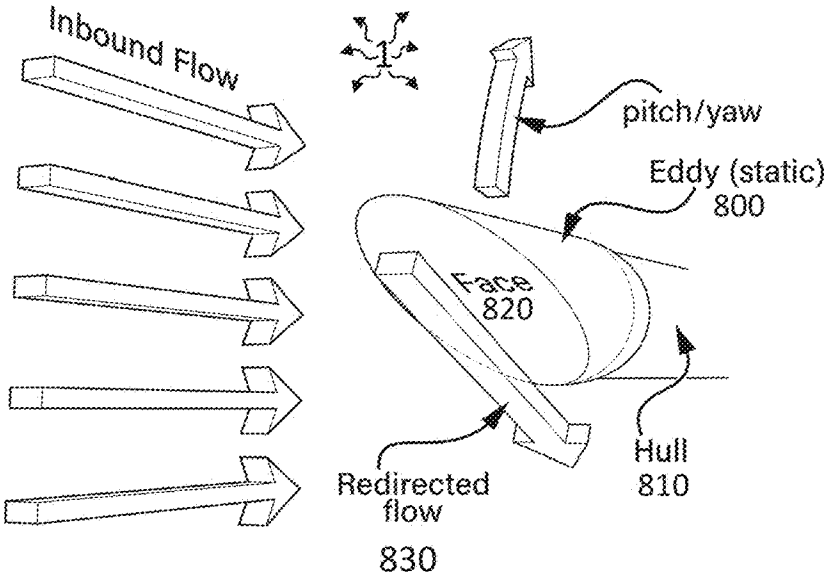

A one-lobed Eddy Propulsor generates off-axis forces when its rotational velocity changes as a function of the rotational phase or position, allowing a craft to be steered by its Eddy Propulsor. This happens in two different ways: static steering and dynamic steering. FIGS. 32A and 32B illustrate two means for static steering. In both cases, the Eddy Propulsor transitions from rotating to stopping, and steering occurs due to off-axis forces induced by the inclined face of the Eddy Propulsor. In the example in FIG. 32A, a forward-facing rotating Eddy Propulsor 800 (i.e., the Eddy Propulsor is pulling) stops rotating. The forward motion of the craft 810 continues inertially causing oncoming fluid to be diverted along the inclined face 820 of the Eddy Propulsor 800. This redirects the oncoming flow 830 which thereby exerts a reaction turning force or moment causing the hull of the craft 810 to turn (either pitch, or yaw, or a combination). FIG. 32B presents another example of static steering with a one-lobed Eddy Propulsor is depicted where an aft-facing Eddy Propulsor 805 is now used during steering solely as a rudder. If the Eddy Propulsor 805 is not rotating while the hull of the craft 815 is moving through the fluid, then fluid deflects in one direction over the face 820 of the Eddy Propulsor 805 exerting a reaction force causing the hull of the craft 810 to turn in the opposite direction (either pitch, or yaw, or a combination according to the rotational position of the Eddy Propulsor). If the phase position of the Eddy Propulsor (800 or 805) can be selected, then the direction of turning can be controlled. Additionally, a craft 810 can have a forward-facing Eddy Propulsor 800 attached to one end and a second aft-facing Eddy Propulsor 805 on the other end, and both Eddy Propulsors can be used to pull and steer the craft 810 whereby the first Eddy Propulsor 800 pulls in a first direction and a second Eddy Propulsor 805 pulls in a second direction. Finally, a craft can have an array of Eddy Propulsors oriented in multiple directions and attached at multiple locations to propel and steer the craft. This arrangement can comprise a plurality of Eddy Propulsor bodies configured to rotate in mutual proximity and in various spatial arrangements. The simplest craft capable of deft maneuvering could have as few as two Eddy Propulsors, one on each end of a simple hull. For example, a cylindrical hull with a single-lobed Eddy Propulsor on a first forward end and a single-lobed Eddy Propulsor on a second aft end, such that their respective receding faces are oriented in opposite directions to generate thrust in opposed directions, where the two Eddy Propulsor bodies are configured to rotate at arbitrary rotational velocities permits the generation of arbitrary fluid forces and moments with respect to the hull of the craft, enabling complete freedom of movement as described in more detail below.

Figure 33:
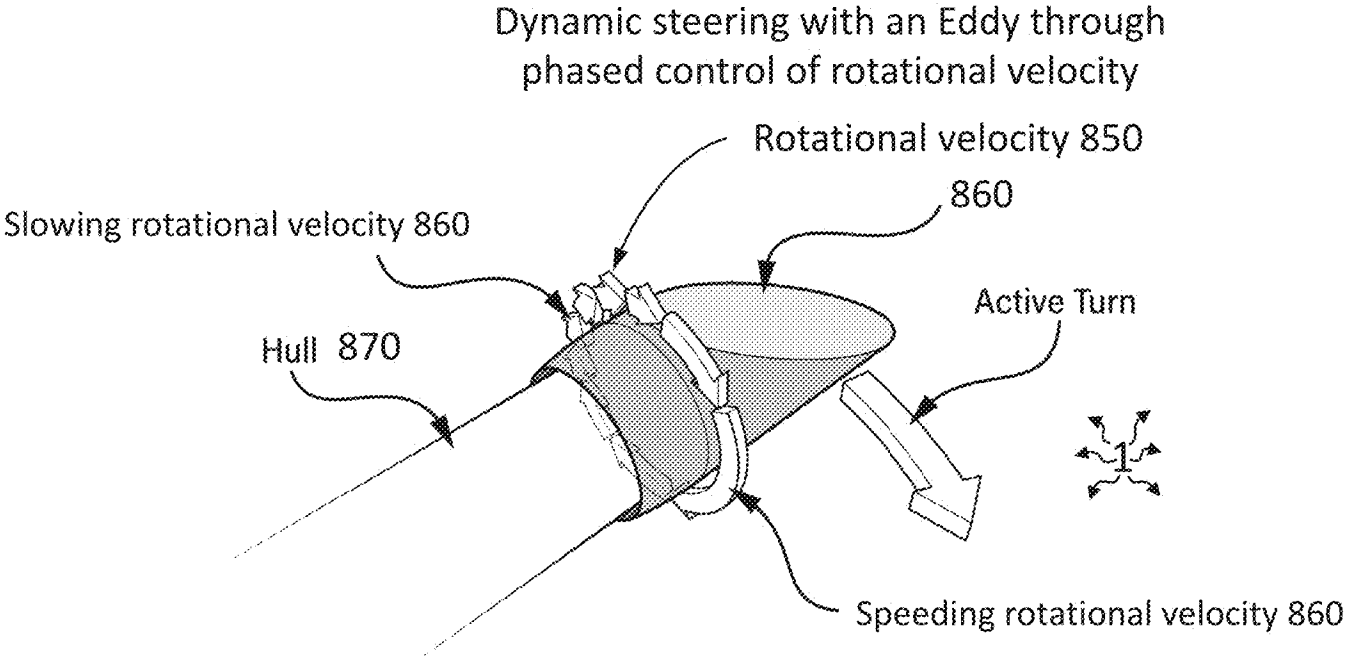
FIG. 33 shows a means for dynamic steering of a craft with an Eddy Propulsor.

Dynamic steering is illustrated in FIG. 33. If the rotational velocity 850 of a one-lobed Eddy Propulsor (a phase-controllable rotational velocity Eddy Propulsor 860) on an underwater craft is modulated at least as a function of the Eddy Propulsor's rotational position or phase, then fluid loading on the phase-controllable rotational velocity Eddy Propulsor 860 will generate off-axis thrust forces sufficient to maneuver the craft, and if the phase of deceleration/acceleration is controlled, especially if these are in opposing directions (i.e. of opposite phase) then the hull of the craft 870 will turn. Thus, even just a single phase-controllable rotational velocity Eddy Propulsor 860 can be used to both propel and steer the craft without ever stopping the Eddy Propulsor from rotating. The combination of both static and dynamic steering makes an Eddy Propulsor-propelled craft both simple in the extreme and highly maneuverable. The control of the rotational velocity can be arbitrary, at a constant rate, a non-constant rate, or aperiodic, thus enabling the craft to set any desired course with complete three-dimensional freedom to accelerate in any direction, brake to avoid colliding with obstacles, and the like. The maneuverability of a craft using one or more Eddy Propulsors might be directed by a user remotely or onboard, or the craft can be partially or fully autonomous. To be autonomous, the Eddy-propelled craft may further comprise at least one sensor configured to detect at least a state of the device over time, a first signal output from the at least one sensor that is at least in part a function of the state of the device over time, a controller configured to receive at least the first signal, and where the controller has a control function configured to modify a control output in response to at least the first signal, and where the control output directs the rotational velocity of the torque generator and so the rotational velocity of at least one Eddy Propulsor body associated with the craft, thus changing the state of the craft over time, thus enabling closed-loop control of the craft. The state of the device may be comprised of the rotational velocity of at least one Eddy Propulsor associated with the craft, or the orientation of the craft in space or with respect to an object, external field, or an external signal, or one or more features of the surrounding environment including the sum of the fluid forces acting on the craft, or a craft mission status, or any of these in combination, or any other signal output from a sensor capable of sensing a condition and communicating that output to the controller. The control function can be configured, for example, to enable the closed-loop control of maneuvering with respect to the fluid.

Figure 34B:
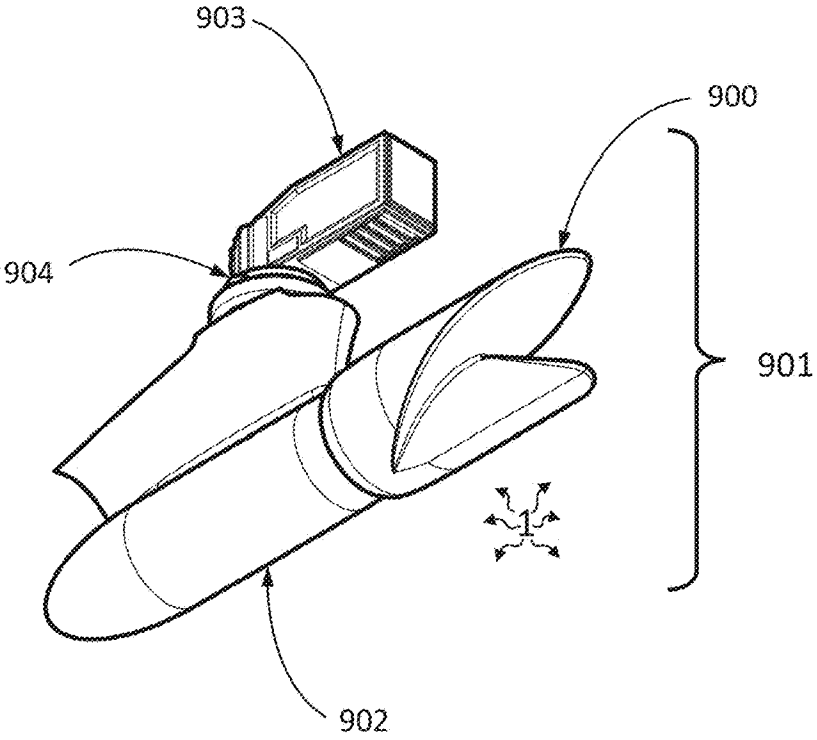
FIGS. 34A and 34B show two oblique views of a two-lobed Eddy Propulsor configured as an azimuth pod.
Figure 34A:
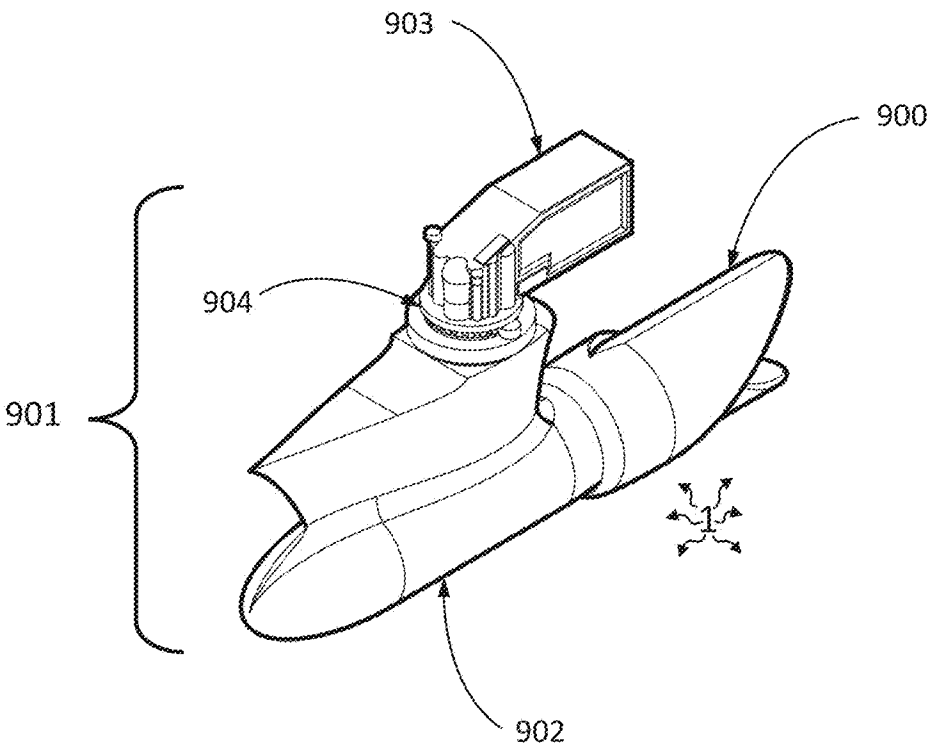

FIGS. 34A and 34B show two oblique views of a two-lobed Eddy Propulsor 900 configured as an azimuth pod 901. Here, the motor driving the two-lobed Eddy Propulsor 900 is located inside the pod body 902 which mounts to the hull of a ship (not shown). An azimuth drive motor 903 is mounted inside the hull, passing through the hull at azimuth rotational joint 304 and drives the azimuth pod body 285 and thus the Eddy Propulsor 14 to different azimuthal positions relative to the hull. Thus, the two-lobed Eddy Propulsor 14 can create thrust pushing the boat in any direction within the 360° rotation of the rotational joint 330.

Figure 35:
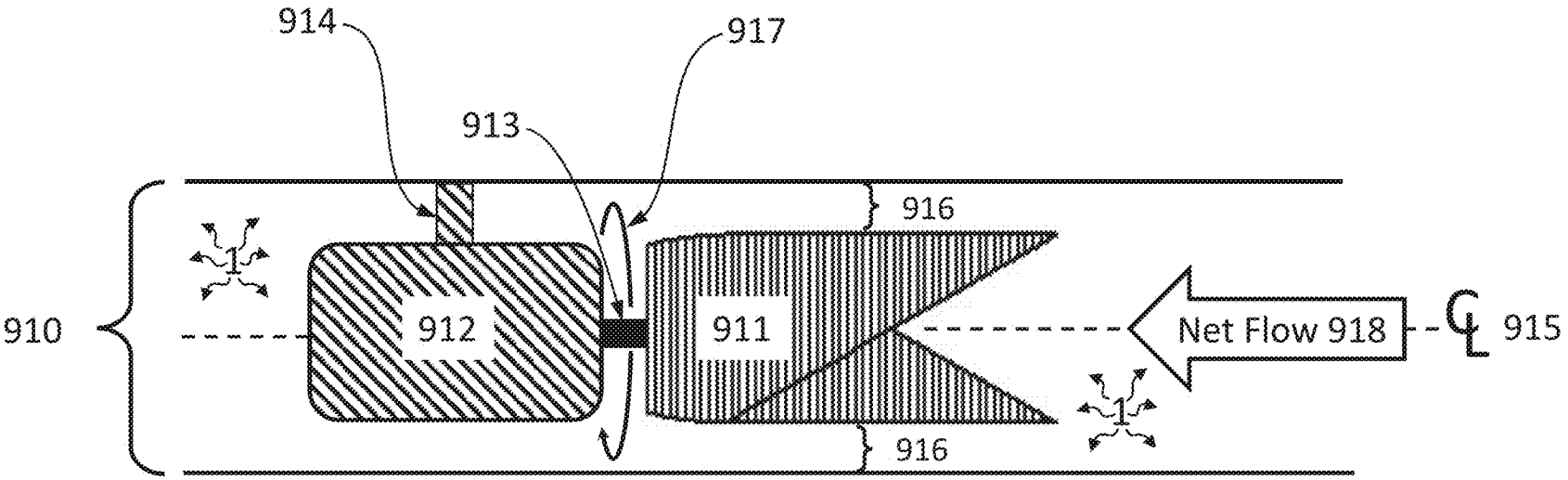
FIG. 35 shows an Eddy Propulsor configured to act as a pump.

FIG. 35 illustrates how an Eddy Propulsor can be used to pump fluid through a pipe. A pipe 910 immersed in or filled with fluid 1 has an Eddy Propulsor 911 (depicted here as a two-lobed Eddy Propulsor, but any number of lobes can be used) driven by a motor 912 connected to Eddy Propulsor 911 by a drive shaft 913. The motor is configured to be stationary with respect to the pipe; the motor may be mounted to the wall of the pipe by motor mount 914 and held at the centerline 915 of the pipe. The Eddy Propulsor 911 depicted here has an outer diameter smaller than the inner diameter of the pipe 910, so a circular or annular gap 916 exists between the Eddy Propulsor 911 and the wall of the pipe 910. When the Eddy Propulsor 911 rotates with rotational velocity 917 fluid is drawn into and impelled through the circular gap 916, creating a net flow 918 inside the pipe. Such a pump can operate with no part-on-part contact, reducing shear stresses on the fluid or the contents therein, decreasing wear on parts and thus the need for maintenance, and reduces some of the sources of noise.

Figure 36:
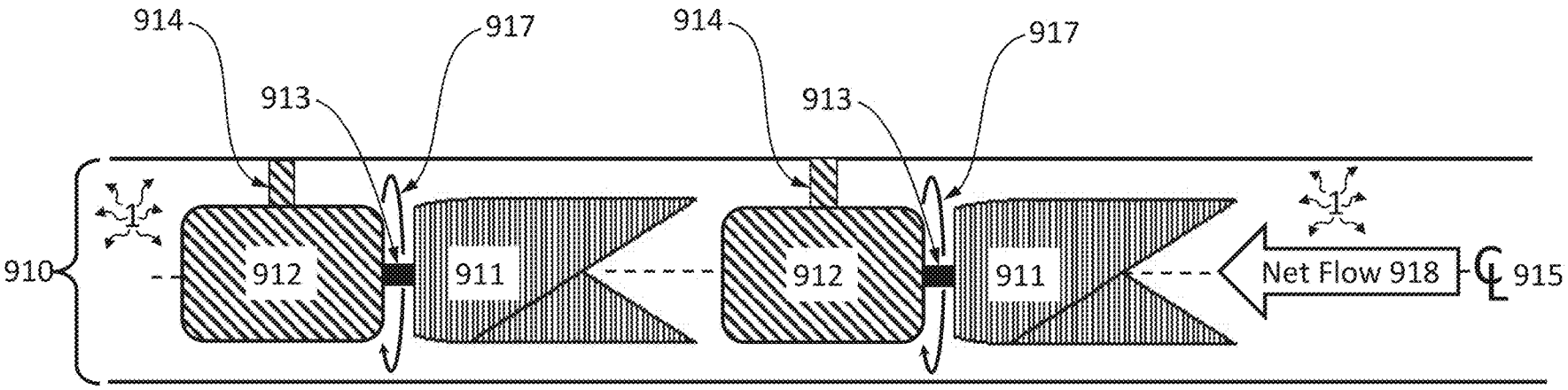
FIG. 36 shows multiple Eddy Propulsors configured along the length of a pipe to act as a pump.

FIG. 36 illustrates the use of multiple Eddy Propulsors 910/motors 920 in-line to pump fluid in a pipe. Such a combination of Eddy Propulsors in-line can boost flow along long pipes or generate larger pressure heads.

Figure 37:
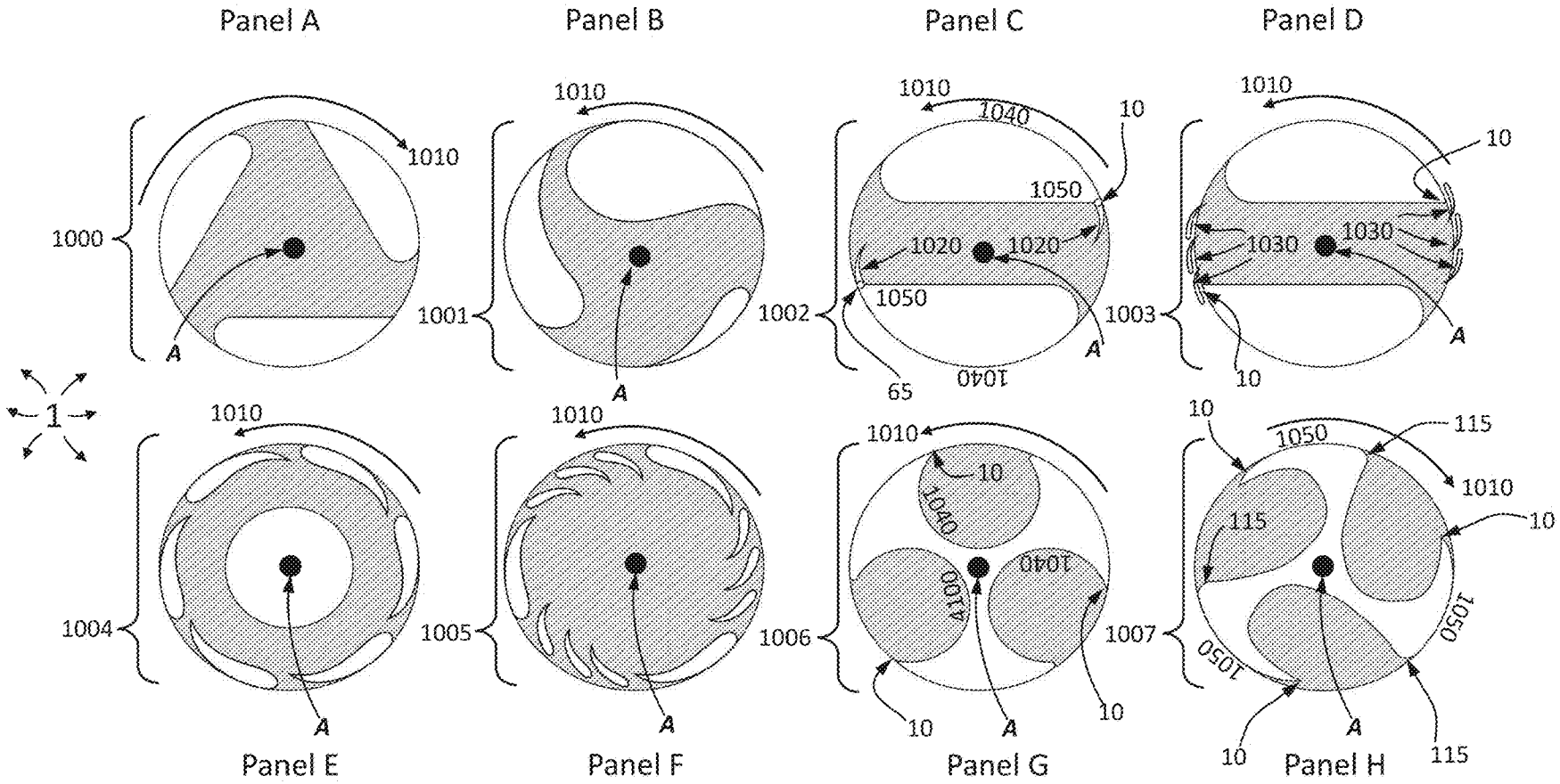
FIG. 37 Panel A through Panel H show examples of Eddy Propulsors having multiple lobes of varying size and shape and movable lobes acting as flaps.

FIG. 37 Panels A through H depicts cross-sections of various embodiments of Eddy Propulsors, looking aftward along the axis of rotation A (hatched sections are fluid, solid white sections are sections through lobes). Panel A shows a section through a 3-lobed Eddy Propulsor 1000 where the lobes are congruent to each other, and where the rotation 1010 is clockwise. Panel B depicts a section through a 3-lobed Eddy Propulsor 1001 where the lobes are not congruent, and so differ in their shape, so affecting the fluid encountered, and where the rotation is counter-clockwise. Panel C shows a section through a two-lobed Eddy Propulsor 1002 where the receding edges 10 possess articulated flaps 1020 with articulations 1050 and where the rotation is counter-clockwise. Panel D shows a section through a two-lobed Eddy Propulsor 1003 where the receding edges 10 have associated slats 1030, and where the rotation is counter-clockwise. Panel E shows a section through a 6-lobed Eddy Propulsor 1004 where the lobes are congruent to each other and create a vortex that draws fluid aftward through the hollow center of that Eddy Propulsor 1004, and where the rotation is counter-clockwise. Panel F shows a section through a two-lobed Eddy Propulsor 1005 where the lobes are not congruent to each other, where some of the lobes are articulated and so can change position with respect to one another and to the axis of rotation A, and where the rotation is counter-clockwise. Panel G shows a section through a 3-lobed Eddy Propulsor 1006 where the lobes are congruent to each other, where the rotation is counter-clockwise, and where the receding edge 10 of each lobed project toward one another, and where the three faces 1040 of the Eddy Propulsor 1006 form a deep channel only partially communicating with the fluid surrounding the Eddy Propulsor 1006, so that rotating the Eddy Propulsor 1006 about the axis of rotation A induces vortices to form within the deep channels, so that the vortices so formed are "captured" within the deep channels. Panel H shows a section through a 3-lobed Eddy Propulsor 1007 where the lobes are congruent to each other, and where the rotation is clockwise, and where the receding edge 10 is located closer to the axis of rotation A than the outmost extent of the rump surface 1050 of the Eddy Propulsor 1007, and where each receding edge 10 trips its bound edge vortex inwards, changing the nature of the vortices so formed.

While Eddy Propulsors generate fluid flow via at least one vortex induced by the distinctive features of the body (for example one or more versions or combinations of receding edges, inclined faces, and the like as described elsewhere herein), Eddy Propulsors are not limited to monolithic forms. For example, the body 15 of an Eddy Propulsor 20 may include receding edges which themselves possess articulated extensions. Panel C of FIG. 37 shows one embodiment of an Eddy Propulsor 1003 where the receding edge 10 possesses at least one articulated flap 1030 configured to hinge on axis substantially aligned with that of the receding edge 10. The flaps 1020 can rotate on their hinge 1050 to fold away against (or even into one or more recesses in) the face 1050 of the Eddy Propulsor 1002, or the flaps 1020 can rotate on their hinge to reflect back against (or even into a recess in) the rump surface 1040, or the flaps 1020 can rotate to any position in between as desired. The rotational position of a flap 1020 may even be controlled as a function of the rotational position of the Eddy Propulsor about the axis of rotation A, such the size of the bound edge vortex created by the receding edge 10 changes, growing or shrinking as a function of the rotational position of the Eddy Propulsor 1002, so cyclically changing the strength of the fluid forces generated as the Eddy Propulsor rotates about the axis of rotation A. In this way, even a symmetrical Eddy Propulsor (for example, a symmetrical two-lobed Eddy Propulsor) can generate off-axis maneuvering forces enabling a vehicle to pitch, roll, turn, or move in a complex fashion through a fluid even though the Eddy Propulsor only ever spins about the axis of rotation A. FIG. 37 Panel D shows one embodiment of an Eddy Propulsor 1003 where slats 1030 are associated with the receding edge 10. These slats 1030 may be rigidly mounted in position with respect to the receding edge 10 of the Eddy Propulsor 1003, or they may be articulated or configured to change position with respect to the receding edge 10. Changing the spatial relationship of the slats 4010 with respect to the receding edge 10 can change the magnitude of the fluid forces there. As disclosed for the flaps 1020 above, changing the position of the slats 1030 with respect to the receding edge 10 as a function of the phase of rotation of the Eddy Propulsor 1003 about the axis of rotation A can generate off-axis fluid forces to allow a craft to maneuver by pitching, yawing, turning, or otherwise changing the direction of travel through a fluid.

With exception of FIG. 37 Panel E, the nature of the body of the Eddy Propulsor in each of the other sectional views (in other panels) is left out for clarity of the sections. It is possible that any or all of the lobes shown in these figures are themselves unitary with the body of the Eddy Propulsor, or it is possible that the lobes shown are not fixed with respect to each other via them being a monolithic unit, but are themselves articulated, and so configured to change position with respect to each other, or with respect to the body of the Eddy Propulsor, or with respect to the axis of rotation. This property permits useful variations.

It is worth noting that one or more cross-sections that orbit an axis of rotation A may be a part of a single, monolithic Eddy Propulsor that has a solid portion of its body located at or about the axis of rotation A and so when rotating about the axis of rotation A may draw fluid aftward around itself, or, the cross-sections may be a portion of an Eddy Propulsor that possesses a body with a hollow center the inner walls of which are located substantially away from the axis of rotation A, such that the hollow-core Eddy Propulsor may draw fluid aftward not around its body, but aftward through its hollow core body and so substantially along the axis of rotation A. The cross-sectional shapes of an Eddy Propulsor may also orbit the axis of rotation A whilst comprising an Eddy Propulsor body composed of multiple lobes that may or may not be a single monolithic object. For example, a plurality of cross-sections may reveal a constellation of lobes configured to rotate about the axis of rotation A, forming a multi-lobed Eddy Propulsor, which may draw fluid around the Eddy Propulsor structure, through the Eddy Propulsor structure, or a combination as desired.

It is also noted that the operational steps described in any of the exemplary aspects herein are described to provide examples and discussion. The operations described may be performed in numerous different sequences other than the illustrated sequences. Furthermore, operations described in a single operational step may actually be performed in a number of different steps. Additionally, one or more operational steps discussed in the exemplary aspects may be combined. It is to be understood that the operational steps illustrated in the diagrams may be subject to numerous different modifications as will be readily apparent to one of skill in the art. Those of skill in the art will also understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The previous description of the disclosure is provided to enable any person skilled in the art to make or use the disclosure. Various modifications to the disclosure will be readily apparent to those skilled in the art, and the generic principles defined herein may be applied to other variations. Thus, the disclosure is not intended to be limited to the examples and designs described herein but is to be accorded the widest scope consistent with the principles and novel features disclosed herein.

What is claimed is:

1. A device for inducing fluid flow relative to itself, comprising:

a. a body configured to be brought into contact with a fluid, the body possessing:

i. a fore end, an aft end, and an axis of rotation about which the body is configured to rotate, and ii. a central hub possessing torque acceptance means configured to accept and convey a torque from a torque generator to the body, and where the torque so conveyed manifests as a rotational velocity of the body of the device about the axis of rotation and driving every point on the surface of the body with a rotational motion in a plane perpendicular to the axis of rotation, iii. at least one monolithic cantilevered lobe extending radially away from the axis of rotation, the lobe possessing one proximal end affixed to the hub, and a distal end, with the lobe further possessing:

1. A receding surface inclined with respect to the axis of rotation such that the receding surface recedes away from the fluid as the body rotates, and 2. A rump surface that encloses the rest of the lobe, and 3. Where the receding surface and the rump surface intersect, forming there a receding edge, and 4. Where the receding edge is bordered by an adjacent rump surface that:

a. from every point on the receding edge extends axially aft along the rump surface from the receding edge at least an axial thickness, and b. from every point on the receding edge extends around the rump surface from the receding edge in the direction of rotational motion at least a transverse thickness, and iv. where, providing a fluid in contact with the body, the rotational velocity of the body about axis of rotation results in a counter-flow over the device, and the adjacent rump surface being so configured such that counter-flow over the adjacent rump surface a. has no radial component, and b. has a component in the direction opposite the direction of rotational motion, so that the counter-flow flows past the receding edge at an angle having little or no radial component and with a non-zero component in the direction opposite the rotational motion, and v. where the receding surface, being pulled away from the fluid by the rotational velocity thus induces a low-pressure region directly over the receding surface such that the low-pressure region travels with the receding surface as the body rotates with respect to the fluid, and vi. where the low-pressure region, being directly adjacent to the counter-flow flowing past the receding edge, thus generates a bound edge vortex over a substantial portion of the receding surface, where the bound edge vortex rotates in the opposite direction as the rotational velocity, and vii. where the bound edge vortex further reduces the fluid pressure over the receding surface, and, viii. an inclination of the receding surface relative to the axis of rotation causes the vortex to have a substantial aft-directed axial component of fluid flow that generates forward thrust on the body of the device.

2. The device in claim 1, where the body possesses a plurality of lobes.

3. The device in claim 1, where the fluid is water or another liquid.

4. The device in claim 1, where the fluid is air or another gas.

5. The device in claim 1, where the torque acceptance means is configured as a driveshaft bore for a motor.

6. The device in claim 2, where a portion of each lobe is additionally configured partially as a lifting foil, so that the lobe can produce thrust via both a bound edge vortex and via lift.

7. The device as in claim 1, where the device is manufactured out of a highly flexible, resilient polymeric material capable of elastic recoil from strains greater than 25%.

8. The device as in claim 7, where the device manufactured out of the highly flexible, resilient polymeric material capable of elastic recoil further comprises the at least one lobe configured to both sustain thrust loads in water for propelling a boat and absorb impacts by deforming elastically to rebound back to a configuration sustaining the thrust loads.

9. The device as in claim 1, where the substantial portion of the receding surface over which the vortex is generated comprises at least 10% of the receding surface.

10. The device as in claim 1, where the substantial portion of the receding surface over which the vortex is generated further comprises effectively all of the receding surface.

11. The device in claim 1, where the receding surface is planar.

12. The device in claim 1, where the receding surface is non-planar.

13. The device in claim 1, where the lobe is configured to possess blunt edges, and so is incapable of cutting objects that the device encounters in the fluid.

14. The device as in claim 1, further comprising a plurality of bodies configured to rotate in mutual proximity.

15. The device as in claim 1, where the rotational velocity of the body is controlled in a non-constant, arbitrary fashion to produce transverse forces for steering.

* * * * *